US008384750B2

(12) United States Patent
Matsutani

(10) Patent No.: US 8,384,750 B2
(45) Date of Patent: Feb. 26, 2013

(54) PRINTING APPARATUS

(75) Inventor: Megumi Matsutani, Okazaki (JP)

(73) Assignee: Brother Kogyo Kabushiki Kaisha, Nagoya-Shi, Aichi (JP)

( * ) Notice: Subject to any disclaimer, the term of this patent is extended or adjusted under 35 U.S.C. 154(b) by 106 days.

(21) Appl. No.: 13/051,492

(22) Filed: Mar. 18, 2011

(65) Prior Publication Data

US 2011/0242256 A1 Oct. 6, 2011

(30) Foreign Application Priority Data

Mar. 31, 2010 (JP) ..... 2010-084500
Mar. 31, 2010 (JP) ..... 2010-084501
Mar. 31, 2010 (JP) ..... 2010-084502

(51) Int. Cl.
*B41J 2/35* (2006.01)

(52) U.S. Cl. ..... 347/211

(58) Field of Classification Search ..... 347/211, 347/191, 193, 195, 196, 171
See application file for complete search history.

(56) References Cited

U.S. PATENT DOCUMENTS 4,127,883 A 11/1978 Mestdagh
4,567,488 A 1/1986 Moriguchi et al.
4,880,325 A 11/1989 Ueda et al.
4,892,425 A 1/1990 Shimizu et al.
4,915,516 A 4/1990 Shimizu et al.
4,927,278 A 5/1990 Kuzuya et al.
4,983,058 A 1/1991 Nagae
5,188,469 A 2/1993 Nagao et al.
5,203,951 A 4/1993 Hattori et al.
5,223,939 A 6/1993 Imaizumi et al.
RE34,521 E 1/1994 Shimizu et al.
5,277,503 A 1/1994 Nagao
5,348,406 A 9/1994 Yoshiaki et al.
5,350,243 A 9/1994 Ichinomiya et al.
5,374,132 A 12/1994 Kimura
5,411,339 A 5/1995 Bahrabadi et al.

(Continued)

FOREIGN PATENT DOCUMENTS

EP 0329369 A2 8/1989
EP 0511602 A1 11/1992

(Continued)

OTHER PUBLICATIONS

International Preliminary Report on Patentability in PCT/JP2009/071568 on Nov. 15, 2011.

(Continued)

*Primary Examiner* — Kristal Feggins
(74) *Attorney, Agent, or Firm* — McCarter & English, LLP

(57) ABSTRACT

In a printing apparatus, each application period is set as fixed period of time ranging from main heating start point to next main heating start point to form successive printed dots on a printing medium in sub-scanning direction of thermal head. A control unit executes application of sub pulse for auxiliary heating which, when applied independently, cannot realize color development on the printing medium, but, when applied for compensating main heating by main pulse as applied in next application period can realize color development thereon, relating to each of heater elements under constraint such that sub pulse is applied within current application period wherein color development cannot be realized on the printing medium, irrespective of whether next application period wherein main pulse for main heating is applied to realize color development on the printing medium starts immediately after current application period wherein color development is not realized.

19 Claims, 28 Drawing Sheets

U.S. PATENT DOCUMENTS

| | | | | |
|---|---|---|---|---|
| 5,419,648 | A | 5/1995 | Nagao et al. | |
| 5,429,443 | A | 7/1995 | Kobayashi et al. | |
| 5,466,076 | A | 11/1995 | Kobayashi et al. | |
| 5,494,362 | A | 2/1996 | Kobayashi et al. | |
| 5,538,352 | A | 7/1996 | Sugiura | |
| 5,540,510 | A | 7/1996 | Sims et al. | |
| 5,564,843 | A | 10/1996 | Kawaguchi | |
| 5,593,237 | A | 1/1997 | Nozaki et al. | |
| 5,620,268 | A | 4/1997 | Yamaguchi et al. | |
| 5,653,542 | A | 8/1997 | Sugimoto et al. | |
| 5,659,441 | A | 8/1997 | Eckberg et al. | |
| 5,727,888 | A | 3/1998 | Sugimoto et al. | |
| 5,730,536 | A | 3/1998 | Yamaguchi | |
| 5,771,803 | A | 6/1998 | Takami | |
| 5,813,773 | A | 9/1998 | Kawai | |
| 5,825,724 | A | 10/1998 | Matsumoto et al. | |
| 5,964,539 | A | 10/1999 | Yamaguchi et al. | |
| 6,042,280 | A | 3/2000 | Yamaguchi et al. | |
| 6,048,118 | A | 4/2000 | Martinez et al. | |
| 6,059,469 | A | 5/2000 | Hirumi | |
| 6,116,796 | A | 9/2000 | Yamaguchi et al. | |
| 6,132,120 | A | 10/2000 | Yamaguchi et al. | |
| 6,168,328 | B1 | 1/2001 | Ueda et al. | |
| 6,190,069 | B1 | 2/2001 | Yamaguchi et al. | |
| 6,196,740 | B1 | 3/2001 | Yamaguchi et al. | |
| 6,317,156 | B1 | 11/2001 | Nagasaki et al. | |
| 6,334,724 | B2 | 1/2002 | Yamaguchi et al. | |
| 6,406,202 | B1 | 6/2002 | Unno et al. | |
| 6,435,744 | B1 | 8/2002 | Dunn et al. | |
| 6,476,838 | B1 * | 11/2002 | Italiano | 347/211 |
| 6,485,206 | B1 | 11/2002 | Takahashi | |
| 6,520,696 | B2 | 2/2003 | Huss et al. | |
| 6,709,179 | B2 | 3/2004 | Yamaguchi et al. | |
| 7,121,751 | B2 | 10/2006 | Harada et al. | |
| 7,128,483 | B2 | 10/2006 | Harada et al. | |
| D534,203 | S | 12/2006 | Harada et al. | |
| D542,334 | S | 5/2007 | Harada et al. | |
| 7,965,308 | B2 * | 6/2011 | Jauert et al. | 347/211 |
| 8,045,288 | B2 | 10/2011 | Ota et al. | |
| 8,109,684 | B2 | 2/2012 | Yamaguchi | |
| 8,162,553 | B2 | 4/2012 | Vandermeulen | |
| 8,164,609 | B2 * | 4/2012 | Liu et al. | 347/211 |
| 2002/0006303 | A1 | 1/2002 | Yamaguchi et al. | |
| 2002/0012558 | A1 | 1/2002 | Huss et al. | |
| 2002/0047063 | A1 | 4/2002 | Kaneda et al. | |
| 2004/0233269 | A1 | 11/2004 | Tsubota | |
| 2005/0172981 | A1 | 8/2005 | Byun | |
| 2006/0204304 | A1 | 9/2006 | Hioki et al. | |
| 2006/0233582 | A1 | 10/2006 | Horiuchi | |
| 2006/0239743 | A1 | 10/2006 | Naito | |
| 2007/0009306 | A1 | 1/2007 | Harada et al. | |
| 2007/0041772 | A1 | 2/2007 | Harada et al. | |
| 2007/0070168 | A1 | 3/2007 | Mindler et al. | |
| 2007/0237562 | A1 | 10/2007 | Kato et al. | |
| 2008/0050160 | A1 | 2/2008 | Yamaguchi et al. | |
| 2008/0080922 | A1 | 4/2008 | Vandermeulen | |
| 2008/0181708 | A1 | 7/2008 | Yamaguchi et al. | |
| 2008/0226373 | A1 | 9/2008 | Yamaguchi et al. | |
| 2008/0310904 | A1 | 12/2008 | Yamaguchi et al. | |
| 2009/0016795 | A1 | 1/2009 | Caveney et al. | |
| 2009/0202283 | A1 | 8/2009 | Kumazaki et al. | |
| 2011/0058884 | A1 | 3/2011 | Kato et al. | |

FOREIGN PATENT DOCUMENTS

| | | | |
|---|---|---|---|
| EP | 0629509 | | 12/1994 |
| EP | 0644506 | | 3/1995 |
| EP | 0684143 | | 11/1995 |
| EP | 734878 | | 10/1996 |
| EP | 1199179 | | 4/2002 |
| EP | 1284196 | A2 | 2/2003 |
| EP | 1516739 | | 3/2005 |
| EP | 1700705 | | 9/2006 |
| EP | 1707395 | | 10/2006 |
| EP | 2236304 | | 10/2010 |
| JP | 58-139415 | | 9/1983 |
| JP | 60-99692 | | 6/1985 |
| JP | 63-166557 | A | 7/1988 |
| JP | 63-203348 | A | 8/1988 |
| JP | 63-254085 | A | 10/1988 |
| JP | 3-093584 | A | 4/1991 |
| JP | 3-120680 | | 5/1991 |
| JP | 3063155 | | 9/1991 |
| JP | 3-118672 | | 12/1991 |
| JP | 4-37575 | | 2/1992 |
| JP | 4-133756 | | 5/1992 |
| JP | 5-16342 | | 3/1993 |
| JP | 5-63067 | | 3/1993 |
| JP | 5-155067 | | 6/1993 |
| JP | 5-54225 | | 7/1993 |
| JP | 5-78565 | | 10/1993 |
| JP | 5-80765 | U | 11/1993 |
| JP | 5-294051 | | 11/1993 |
| JP | 6-12053 | | 2/1994 |
| JP | 6-21953 | U | 3/1994 |
| JP | 6-124406 | | 5/1994 |
| JP | 6-152907 | A | 5/1994 |
| JP | 6-53560 | U | 7/1994 |
| JP | 6-183117 | | 7/1994 |
| JP | 6-191081 | A | 7/1994 |
| JP | 6-210889 | A | 8/1994 |
| JP | H06-74348 | | 10/1994 |
| JP | 6-328800 | | 11/1994 |
| JP | 7-1805 | | 1/1995 |
| JP | 7-9743 | | 1/1995 |
| JP | 7-25123 | | 1/1995 |
| JP | 7-47737 | | 2/1995 |
| JP | 7-61009 | | 3/1995 |
| JP | 7-69497 | | 3/1995 |
| JP | 7020725 | | 3/1995 |
| JP | 7-89196 | | 4/1995 |
| JP | 7-101133 | | 4/1995 |
| JP | 7-108702 | A | 4/1995 |
| JP | H07-089115 | | 4/1995 |
| JP | 7137327 | | 5/1995 |
| JP | 7-40456 | | 7/1995 |
| JP | 7-237314 | A | 9/1995 |
| JP | 7-251539 | | 10/1995 |
| JP | 7-276695 | A | 10/1995 |
| JP | 7276695 | | 10/1995 |
| JP | 7-290803 | | 11/1995 |
| JP | 7-314864 | | 12/1995 |
| JP | 7-314866 | | 12/1995 |
| JP | H07-314865 | | 12/1995 |
| JP | 8-25768 | | 1/1996 |
| JP | 8-39909 | | 2/1996 |
| JP | 8-58211 | A | 3/1996 |
| JP | 8-118738 | | 5/1996 |
| JP | 8-252964 | A | 10/1996 |
| JP | 8-267839 | A | 10/1996 |
| JP | 8-290618 | | 11/1996 |
| JP | 2596263 | | 4/1997 |
| JP | 9-134557 | | 5/1997 |
| JP | 9-141986 | A | 6/1997 |
| JP | 9-188049 | | 7/1997 |
| JP | 9-188050 | | 7/1997 |
| JP | 10-056604 | A | 2/1998 |
| JP | 10-181063 | A | 7/1998 |
| JP | 11-78188 | | 3/1999 |
| JP | 11-105351 | | 4/1999 |
| JP | 11-129563 | | 5/1999 |
| JP | 11-263055 | | 9/1999 |
| JP | 2000-25251 | | 1/2000 |
| JP | 2998617 | | 1/2000 |
| JP | 2000-43336 | | 2/2000 |
| JP | 2000-85224 | | 3/2000 |
| JP | 2000-103129 | | 4/2000 |
| JP | 2000-103131 | | 4/2000 |
| JP | 2000-135843 | | 5/2000 |
| JP | 2000-198258 | | 7/2000 |
| JP | 2001-11594 | | 1/2001 |
| JP | 2001-48389 | | 2/2001 |
| JP | 2001-121797 | A | 5/2001 |
| JP | 2001-310540 | | 11/2001 |
| JP | 2001-319447 | | 11/2001 |
| JP | 2002-42441 | | 2/2002 |
| JP | 3266739 | B2 | 3/2002 |

| | | | |
|---|---|---|---|
| JP | 2002-104568 | | 4/2002 |
| JP | 2002-179300 | | 6/2002 |
| JP | 2002-308481 | | 10/2002 |
| JP | 2002192769 | | 10/2002 |
| JP | 2002-367333 | | 12/2002 |
| JP | 3357128 | | 12/2002 |
| JP | 2003-048337 | A | 2/2003 |
| JP | 2003-251902 | | 9/2003 |
| JP | 2003-285522 | | 10/2003 |
| JP | 3543659 | | 4/2004 |
| JP | 2004-291591 | | 10/2004 |
| JP | 2004-323241 | | 11/2004 |
| JP | 2005-088597 | A | 4/2005 |
| JP | 2005-231203 | | 9/2005 |
| JP | 2005-280008 | | 10/2005 |
| JP | 2005297348 | | 10/2005 |
| JP | 4061507 | | 11/2005 |
| JP | 2006096030 | | 4/2006 |
| JP | 2006-142835 | | 6/2006 |
| JP | 2006-182034 | | 7/2006 |
| JP | 2006-240310 | A | 9/2006 |
| JP | 2006-248059 | | 9/2006 |
| JP | 2006-272895 | | 10/2006 |
| JP | 2006-272977 | | 10/2006 |
| JP | 2006-289991 | | 10/2006 |
| JP | 2007-196654 | A | 8/2007 |
| JP | 2007-296863 | | 11/2007 |
| JP | 4003068 | | 11/2007 |
| JP | 2008-80668 | | 4/2008 |
| JP | 2008-509823 | A | 4/2008 |
| JP | 2008083432 | | 4/2008 |
| JP | 2008-229855 | A | 10/2008 |
| JP | 2009-28976 | | 2/2009 |
| JP | 2009-509812 | A | 3/2009 |
| JP | 2009-184832 | A | 8/2009 |
| JP | 2011-110843 | A | 6/2011 |
| JP | 2011-110845 | A | 6/2011 |
| JP | 2011-110848 | A | 6/2011 |
| WO | 00/32401 | | 6/2000 |
| WO | 03/080350 | | 10/2003 |
| WO | 2006/024913 | | 3/2006 |
| WO | 2006/090842 | | 8/2006 |
| WO | 2009/107534 | A1 | 9/2009 |

OTHER PUBLICATIONS

International Preliminary Report on Patentability in PCT/JP2010/055324 on Nov. 15, 2011.
International Preliminary Report on Patentability in PCT/JP2010/055326 on Nov. 15, 2011.
International Preliminary Report on Patentability in PCT/JP2010/050253 on Nov. 15, 2011.
Notification of reasons for rejection issued in the related Japanese Application No. 2009-088241, Nov. 15, 2011, JPO, Japan.
Japanese Office Action in JP 2010-041323 on May 22, 2012.
Japanese Office Action in JP 2010-084499 on Jun. 12, 2012.
Japanese Office Action in JP 2008-331639 on Mar. 27, 2012.
Japanese Office Action in JP 2008-331638 on Mar. 27, 2012.
Japanese Office Action in JP 2009-156405 on Mar. 27, 2012.
Japanese Office Action in JP 2009-156406 on Mar. 27, 2012.
Japanese Office Action in JP 2009-156407 on Mar. 27, 2012.
Japanese Office Action in JP 2009-270221 on Mar. 27, 2012.
Japanese Office Action in JP 2009-086239 on May 8, 2012.
Japanese Office Action in JP 2009-086222 on Jun. 12, 2012.
International Preliminary Report on Patentability in PCT/JP2010/055310 on Apr. 11, 2012.
Japanese Office Action of JP 2010-084500 dated Jul. 13, 2012.
Japanese Office Action of JP 2010-084501 dated Jul. 3, 2012.
Japanese Office Action of JP 2010-084502 dated Jul. 3, 2012.
European Communication of EP 10711477.9 dated Sep. 6, 2012.
NZ Examination Report of NZ 596044 dated Sep. 28, 2012.
Japanese Office Action of JP 2009-270056 dated Nov. 13, 2012.
Japanese Office Action of JP 2009-297502 dated Nov. 13, 2012.
International Preliminary Report on Patentability of PCT/JP2009/071812 dated Aug. 14, 2012.
Japanese Office Action of JP 2009-086172 dated Sep. 11, 2012.
Japanese Office Action of JP 2009-088449 dated Sep. 11, 2012.

* cited by examiner

FIG. 5

EXAMPLE OF TABLE DATA PRINTING SPEED 80 mm/sec (APPLICATION CYCLE 875 μsec)

201

| 211 TMP.RANGE | 212 HEATED DOTS | 213 SUB PULSE TIME(μ sec) | 214 MAIN PULSE TIME(μ sec) | 215 MAIN PULSE CHP.TIME | 216 MAIN PULSE CHP.NUM. | 217 MAIN PULSE CHP-DUTY |
|---|---|---|---|---|---|---|
| UNDER 5°C | UNDER 32 | 280 | 70 | 525 | 30 | 59% |
| | 32~127 | 300 | 75 | 500 | 28 | 60% |
| | 128~511 | 350 | 88 | 438 | 25 | 61% |
| | OVER 512 | 368 | 92 | 415 | 24 | 61% |
| 5<T≦10 | UNDER 32 | 280 | 70 | 525 | 30 | 59% |
| | 32~127 | 300 | 75 | 500 | 28 | 60% |
| | 128~511 | 355 | 89 | 431 | 25 | 61% |
| | OVER 512 | 348 | 87 | 440 | 25 | 61% |
| 10<T≦15 | UNDER 32 | 270 | 68 | 538 | 31 | 58% |
| | 32~127 | 290 | 73 | 513 | 29 | 59% |
| | 128~511 | 340 | 85 | 450 | 26 | 61% |
| | OVER 512 | 355 | 89 | 431 | 25 | 61% |
| ⋮ | ⋮ | ⋮ | ⋮ | ⋮ | ⋮ | ⋮ |
| 77<T≦80 | UNDER 32 | 100 | 25 | 750 | 43 | 30% |
| | 32~127 | 125 | 31 | 719 | 41 | 36% |
| | 128~511 | 150 | 38 | 688 | 39 | 41% |
| | OVER 512 | 180 | 45 | 650 | 37 | 47% |

PRINTING APPARATUS

CROSS REFERENCE TO RELATED APPLICATIONS

The present application claims priority from Japanese Patent Applications Nos. JP 2010-084500, JP 2010-084501 and JP 2010-084502 all of which were filed on Mar. 31, 2010, the disclosure of which is incorporated herein by reference in its entirety.

TECHNICAL FIELD

The disclosure relates to a printing apparatus that employs a thermal head.

BACKGROUND

Temperature control with respect to heater elements constituting a thermal head includes control of a heating time and non-heating time within an application period wherein one printed dot is formed on a printing medium. The heating time refers to a period of time when a main pulse is applied to heat the heater elements to carry out printing, while the non-heating time refers to a period of time when the heated heater elements are cooled.

When the heater elements are heated by application of a main pulse, a portion of the heat is lost at the periphery of the heater elements at the time the printing process starts and at the time isolated printed dots are formed on the printing material during the printing process. This means that the heat generation may become insufficient.

Even if the heater elements are heated by application of a main pulse, if the heater elements adjacent the heated heater elements do not carry out printing, the heat of the heater elements which are heated by the heater elements that do not carry out printing is lost, which means that heat generation may become insufficient.

Also, even if the heater elements are heated by application of a main pulse, if the heater elements have not been heated in the next preceding application period, the temperature of the heater elements at the moment application of the main pulse starts is lower than in the case the heater elements have undergone heating in the next preceding application period. As a result, a rise in the temperature of these heater elements is delayed, which means that heating may become insufficient.

To solve this problem, a sub pulse is applied to compensate for the above-described shortage of heat generation in an application period corresponding to the cases described above. This sub pulse carries out auxiliary heating of the heater elements. The auxiliary heating time obtained by application of a sub pulse follows immediately after the heating time obtained by application of a main pulse.

Furthermore, a sub pulse is applied to compensate for the above-described shortage of heat generation in an application period corresponding to the cases described above. This sub pulse carries out auxiliary heating of the heater elements. The auxiliary heating time obtained by application of a sub pulse follows immediately after the heating time obtained by application of a main pulse.

Accordingly, heating time obtained by application of a main pulse, heating time obtained by application of a sub pulse and non-heating time may all be included in one application period.

Accordingly, in such cases, even if heater elements are heated by application of a main pulse, if the heater elements adjacent the heated heater elements do not carry out printing, a pulse may be applied to the heater elements that do not carry out printing to supply an amount of heat that fails to trigger printing, helping to compensate for the shortage of applied energy.

Furthermore, in some cases, even if heater elements are heated by application of a main pulse, if the heater elements adjacent the heated heater elements do not carry out printing, a pulse may be applied to the heater elements that do not carry out printing to supply an amount of heat that fails to trigger printing, helping to compensate for the shortage of applied energy.

However, as application periods become shorter with higher-speed printing, shorter application periods make it increasingly difficult to adjust the heating times obtained by application of the main pulse and sub pulse as applied in shorter application periods.

As a standard solution, the respective application times for the main pulse and sub pulse can be made shorter correspondingly with shorter application periods. As a result, this offers a solution from the point of view of time. However, in order to heat the heater elements to a point where a shortage of generated heat amount no longer occurs in a shorter heating time, it becomes necessary to increase the applied voltage or otherwise lower the resistance value of the heater elements in the thermal head and increase the current which flows to the heater elements of the thermal head. This requires an improvement in the voltage withstanding property and current capacity with respect to the IC constituting the driving circuit of the thermal head.

Also, another solution that was given includes improving efficiency in transferring heat generated at the heater elements of the thermal head to the printing medium. For this purpose, it is necessary to improve the heat-transfer performance of a thin-film portion in the thermal head comprising heater elements with respect to the printing medium.

However, the above-described solutions exceed the framework of any regular study, which inevitably leads to higher costs.

Accordingly, even in the case the above-described solutions cannot be applied, the application period needs to be shortened in order to increase printing speed, and the ratio of the respective types of heating times using the main pulse or otherwise the sub pulse needs to be increased to secure the necessary heat generation amount required for printing in a shorter application period. As a result, the ratio of the non-heating time will inevitably become shorter. Thus, as the time required for cooling the heater elements which constitute the thermal head and are subject to a temperature increase becomes shorter, successive printing leads to heat accumulation which in turn leads to an uncontrollable rise in the temperature of the heater elements constituting the thermal head. This causes problems from the point of view of printing quality, such as the so-called [print blurring]/[printing tailing].

SUMMARY

The disclosure has been made in view of the above-described problems and its object is to provide a printing apparatus capable of high-speed printing obtained by heat history control of a thermal head which has undergone new energization correction.

To achieve the purpose of the disclosure, according to a first aspect thereof, there is provided a printing apparatus comprising: a thermal head provided with a line head including a plurality of heater elements arranged in a linear fashion;

conveying units that convey a printing medium in a sub-scanning direction which is in an orthogonal relation with the line head of the thermal head; and a control unit that controls the conveying units and the thermal head; said control unit carrying out an application process for causing the respective heater elements constituting the line head of the thermal head to selectively generate heat in each one of application periods which are repeated successively, to form printed dots on the printing medium which is conveyed by the conveying unit in the sub-scanning direction of the thermal head and as a result carry out printing, wherein each application period is set as a fixed period of time ranging from a main heating start point which shows when application of a main pulse for main heating which causes the printing medium to develop color starts at the line head of the thermal head to a next main heating start point, to cause successive printed dots to be formed on the printing medium in the sub-scanning direction of the thermal head; and the control unit carries out application of a sub pulse for auxiliary heating which, when applied independently, cannot cause the printing medium to develop color, but, when applied so as to compensate main heating by the main pulse as applied in a next application period can cause the printing medium to develop color, with respect to each of the heater elements constituting the line head of the thermal head in accordance with a following constraint (A):

(A) the sub pulse is applied in a current application period wherein the printing medium is not caused to develop color, irrespective of whether the next application period wherein the main pulse for main heating is applied to cause the printing medium to develop color starts immediately after the current application period wherein the printing medium is not caused to develop color.

BRIEF DESCRIPTION OF THE DRAWINGS

FIG. 5 shown an example of table data used in the control program for controlling the thermal head of the tape printing apparatus in accordance with the fourth drive control;

DETAILED DESCRIPTION

[1-1. External Configuration of the Disclosure]

Figure 8:
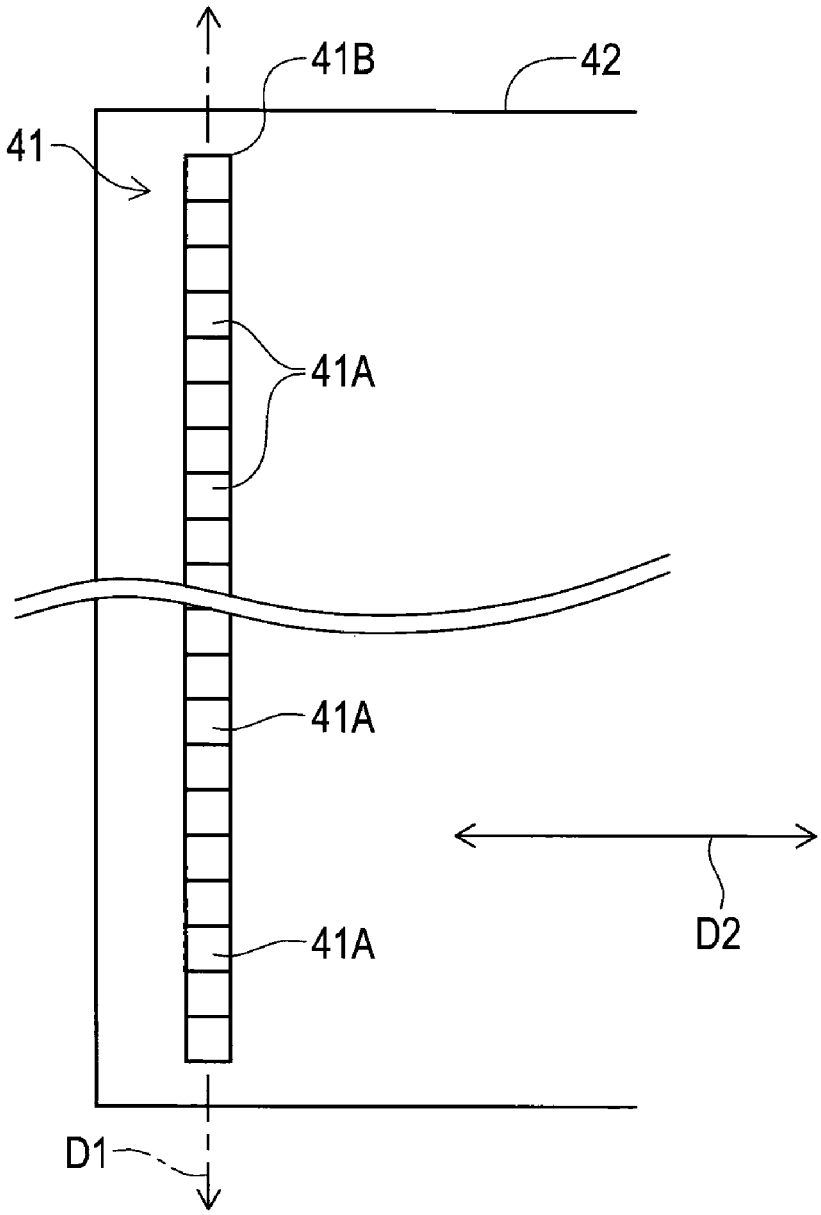
FIG. 8 is an enlarged diagram of the thermal head of the tape printing apparatus.

Next, a schematic configuration of the tape printing apparatus 1 directed to a first embodiment will be described by referring to the drawings. As shown in FIG. 8, a thermal head 41 is comprised of a line head 41B and the like which includes a plurality (for instance, 1024 or 2048 elements) of heater elements 41A which are arranged in one row. The direction in which the heater elements 41A are arranged in one row is the "main scanning direction D1 of the thermal head 41". With respect to this, a direction which is perpendicular to the "main scanning direction D1 of the thermal head 41" is a "sub-scanning direction D2 of the thermal head 41". Symbol 42 represents a plate on which the thermal head 41 is arranged.

Figure 10:
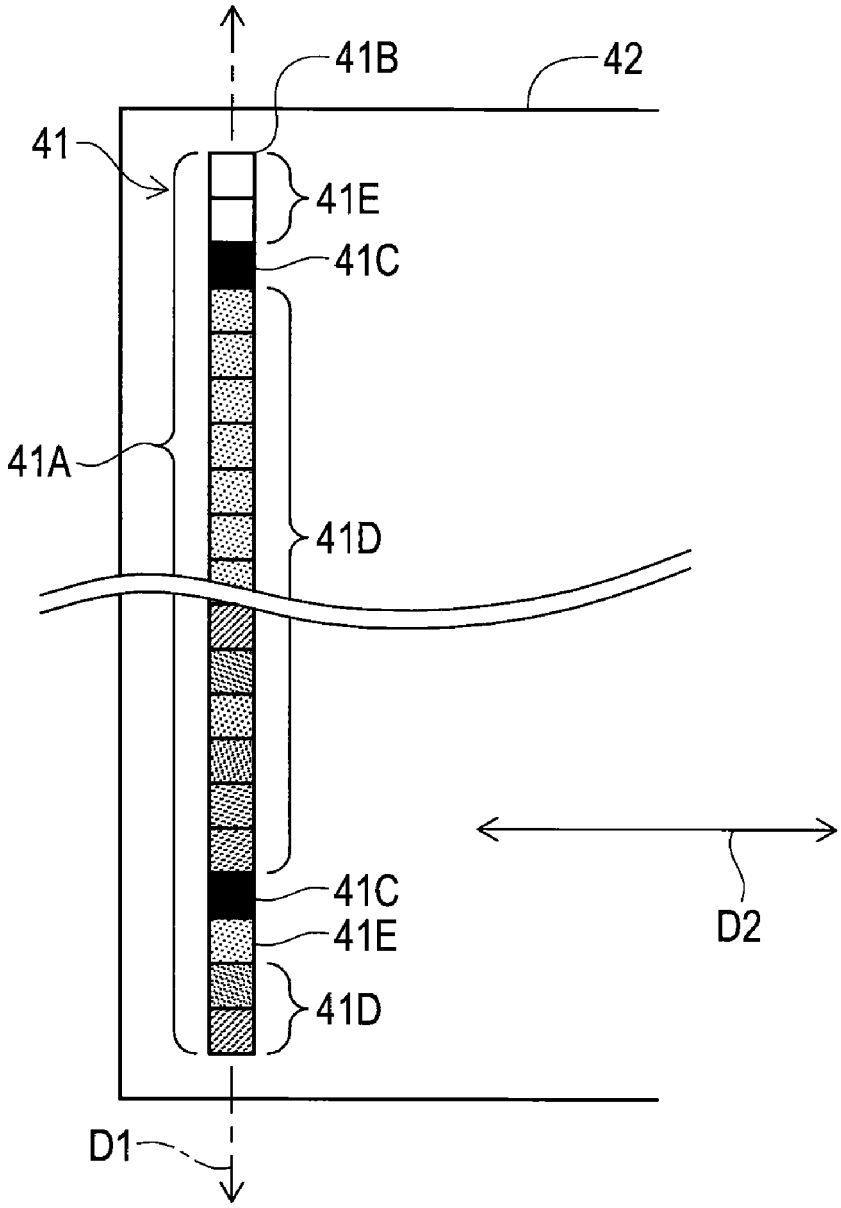
FIG. 10 is a diagram showing a drive state of each heater element that constitutes the thermal head of the tape printing apparatus.

In the first embodiment, once the thermal head 41 is driven and the line head 41B executes a printing process for each one line, the plurality of heater elements 41A constituting the line head 41B enter one of the following drive states (1) through (3), as shown in FIG. 10.

(1) a first heater element 41C which has undergone main heating;
(2) a second heater element 41D which has undergone auxiliary heating;
(3) a third heater element 41E which is not driven (has not undergone main heating or auxiliary heating).

Main heating refers to supplying energy which enables the printing medium to develop color. As will be described later, the tape printing apparatus according to the first embodiment uses an ink ribbon, and energy is supplied to the heater elements 41A which are subject to main heating and enter the drive state of the first heater element 41C to allow the ink on the ink ribbon to melt or sublimate.

Auxiliary heating refers to supplying energy which independently cannot cause the printing medium to develop color, but which, together with main heating, can cause the printing medium to develop color. As will be described later, the tape printing apparatus according to the first embodiment uses an ink ribbon, and enough energy is not supplied to the heater elements 41A which undergo auxiliary heating and enter the drive state of the second heater element 41D to allow the ink on the ink ribbon to melt or sublimate.

Figure 11:
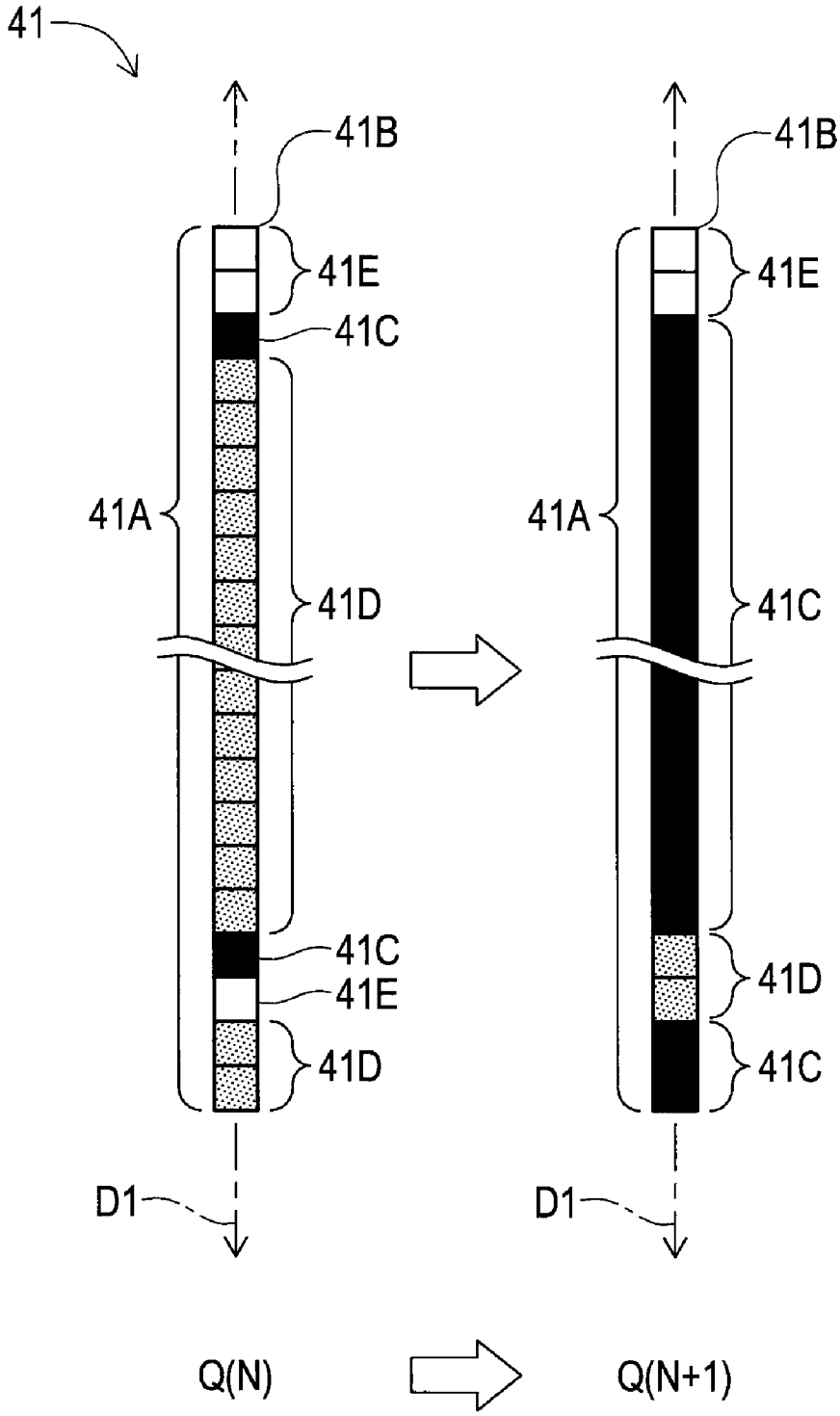
FIG. 11 is a diagram for illustrating condition to carry out auxiliary heating for the thermal head of the tape printing apparatus.

Here, auxiliary heating is limited to satisfying the conditions as shown in FIG. 11. More specifically, with respect to the heater elements 41A constituting the line head 41B in the thermal head 41, those heater elements which undergo auxiliary heating in the printing process Q(N) of the current I line, are subject to main heating in the printing process Q(N+1) of the next 1 line and enter the drive state of the first heater element 41C but are not subject to main heating in the printing process Q(N) of the current I line.

More specifically, the heater elements 41A constituting the line head 41B of the thermal head 41 do not include elements which are subject both to main heating and auxiliary heating in the respective printing processes such as . . . Q(N), Q(N+1), . . . of the respective one line.

Next, heat history control for main heating and auxiliary heating (drive control of thermal head 41) will now be described from the point of view of controlling pulse application to each of the heater elements 41A constituting the line head 41B of the thermal head 41, using FIG. 12 through FIG. 15. In FIG. 12 through FIG. 15, the horizontal axis represents time, while the vertical axis represents the voltage value or the current value of the applied pulse. The passage of time is shown from left to right, while the applied pulse is shown as low/active.

Figure 12:
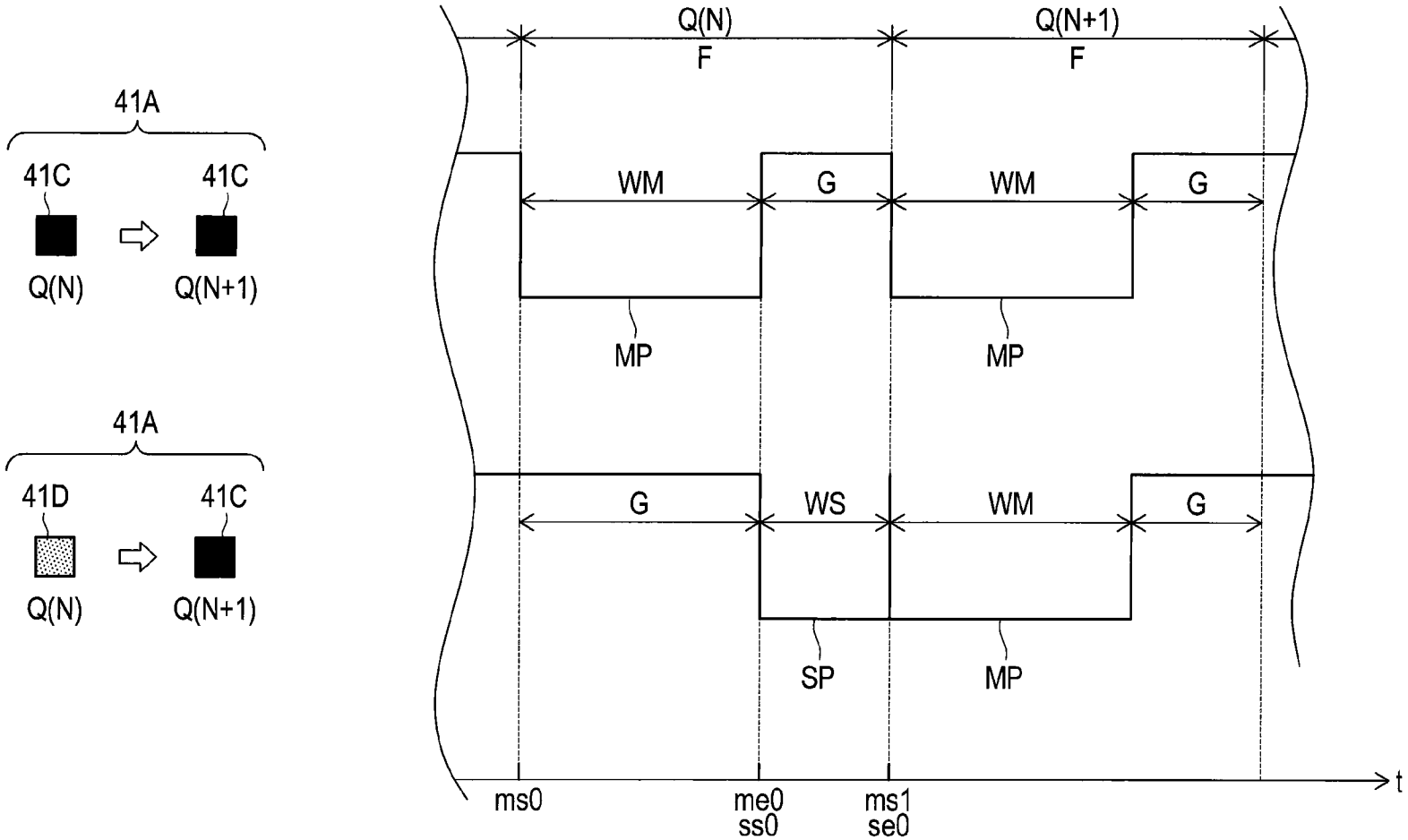
FIG. 12 is a diagram for illustrating heat history control of main heating and auxiliary heating for the thermal head of the tape printing apparatus from the viewpoint of pulse-application control to each heater element that constitutes a line head of the thermal head.

As shown at the upper level in FIG. 12, the heater elements 41A constituting the line head 41B in the thermal head 41 include heater elements 41A which undergo main heating both in the printing process Q(N) of the current one line and in the printing process Q(N+1) of the next one line, and enter the drive state of the first heater element 41C. With respect to such elements, the main pulse MP is applied in the printing process Q(N) of the current one line and another main pulse MP is applied in the printing process Q(N+1) of the next one line. More specifically, main heating is carried out by applying a main pulse MP to the heater elements 41A and energy is then supplied to enable the printing medium to develop color, causing these heater elements 41A to enter the drive state of the first heater element 41C.

Here, as shown at the upper level in FIG. 12, application period F as used with respect to one heater element 41A defines the period of time ranging from the main heating start point ms0, which shows when application of the main pulse MP starts in the printing process Q(N) of the current one line, until the main heating start point ms1, which shows when application of the main pulse MP starts in the printing process Q(N+1) of the next one line. Application period F is a fixed period of time and coincides with the time required for the printing processes such as . . . Q(N), Q(N+1) . . . of each one line. This application period F is successively repeated in the printing operation.

On the one hand, as shown at the lower level in FIG. 12, the heater elements 41A constituting line head 41B in the thermal head 41 include heater elements 41A which undergo auxiliary heating in the printing process Q(N) of the current one line and enter the drive state of the second heater element 41D, and also undergo main heating in the printing process Q(N+1) of the next one line and enter the drive state of the first heater element 41C. With respect to these heater elements 41A, a sub-pulse SP is applied in the printing process Q(N) of the current one line and, furthermore, a main pulse MP is also applied in the printing process Q(N+1) of the next one line. The sub-pulse SP is applied with respect to the heater elements 41A to carry out auxiliary heating. The sub-pulse SP alone cannot cause the printing medium to develop color, however, when applied to the heater elements 41A together with the main pulse MP, which is applied in the printing process Q(N+1) of the next one line (more specifically, the next application period F) for main heating, causing the heater elements 41A to enter the drive state of the second heater element 41D. This energy which is supplied to the heater elements 41A can cause the printing medium to develop color.

Here, with respect to the sub-pulse SP, the auxiliary heating end point which shows when application of the sub-pulse ends coincides with the end of the current application period F (specifically, the start point of the next application period F). In the example shown at the lower level in FIG. 12, the auxiliary heating end point se0 showing when application of the sub-pulse SP ends in the printing process Q(N) of the current one line coincides with the end of the application period F corresponding to the printing process Q(N) of the current one line (more specifically, the start point of the next application period F). As per the definition of the application period F as described above, the auxiliary heating end point se0 showing when application of the sub-pulse SP ends in the printing process Q(N) of the current one line coincides with the main heating start point ms1 showing when application of the main pulse MP starts in the printing process Q(N+1) of the next one line.

Determination of drive control of the thermal head 41 which is carried out in the first embodiment as seen from the point of view of pulse application control is as shown in the following steps (A) through (G).

(A) The application period F represents a fixed period of time with respect to one heater element 41A and ranges from the main heating start point ms0 showing when application of the main pulse MP starts in the printing process Q(N) of the current one line up to the main heating start point ms1 showing when application of the main pulse MP starts in the printing process Q(N+1) of the next one line.

(B) The application period F is successively repeated during printing.

(C) The main heating start point showing when application of the main pulse MP starts always coincides with the start point of the application period F.

(D) The auxiliary heating end point showing when application of the sub-pulse SP ends coincides with the end point of the application period F.

(E) The sub-pulse SP which is applied in the current application period F and the main pulse MP which is applied in the next application period F are applied successively.

(F) The main pulse MP and the sub-pulse SP cannot be applied together with respect to one and the same heater element 41A within the same application period F.

(G) When the main pulse MP is applied to certain heater elements 41A and the sub-pulse SP is applied to other heater elements 41A, these pulses may exist together in one application period F.

Further, with respect to drive control of the thermal head 41 as carried out in the first embodiment, an applied pulse width WM of the main pulse MP and an applied pulse width WS of the sub-pulse SP can be changed for each heater element 41A constituting the line head 41B of the thermal head 41. The pulse width may be changed based on the total number n of heater elements 41A to which the main pulse MP is to be applied (more specifically, first heater element 41C) within the application period F wherein the change takes place, and environmental data with respect to the temperature and voltage of the thermal head 41 within the application period F wherein the change takes place. Alternatively, the process of changing the pulse width does not necessarily have to be based on the above parameters.

The time frame in each application period F when the main pulse MP with the applied pulse width WM and the sub-pulse SP with the applied pulse width WS do not exist is employed as the non-heated time G for cooling the heater elements 41A.

In FIG. 12, in the application period F corresponding to the printing process Q(N) of the current one line, the main heating end point me0 showing when application of the main pulse MP ends as shown at an upper level in FIG. 12 coincides with the auxiliary heating start point ss0 showing when application of the sub-pulse SP starts as shown at a lower level in FIG. 12. However the applied pulse width WM of the main pulse MP and the applied pulse width WS of the sub-pulse SP can be changed as described above in the drive control of the thermal head 41 as carried out in the first embodiment. More specifically, in the example shown in FIG. 12, the main heating end point me0 showing when application of the main pulse MP ends as shown at an upper level in FIG. 12 and the auxiliary heating start point ss0 showing when application of the sub-pulse SP starts as shown at a lower level in FIG. 12 can be changed.

Figure 13:
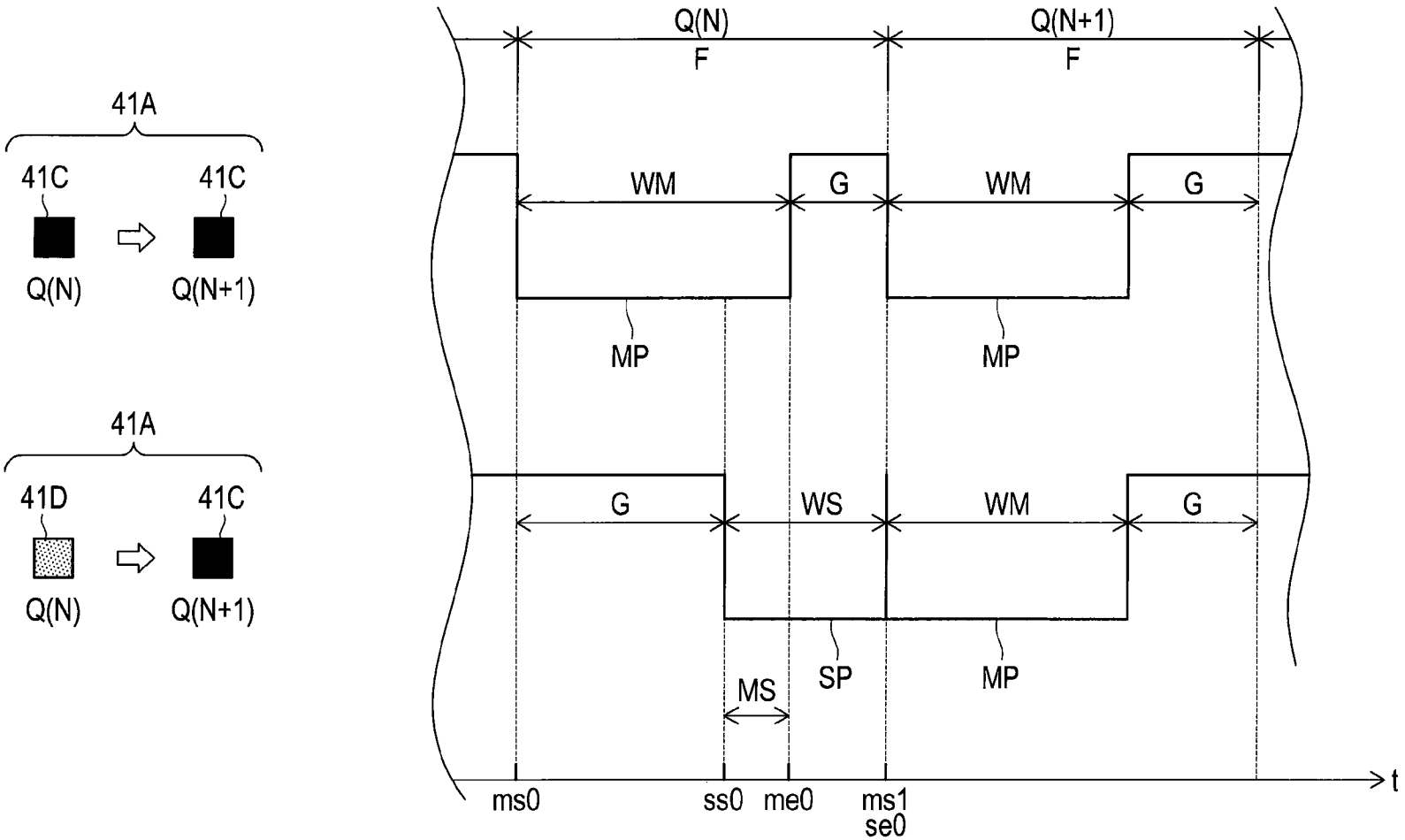
FIG. 13 is a diagram for illustrating heat history control of main heating and auxiliary heating for the thermal head of the tape printing apparatus from the viewpoint of pulse-application control to each heater element that constitutes the line head of the thermal head.

Accordingly, as shown in FIG. 13, the auxiliary heating start point ss0 showing when application of the sub-pulse SP starts as shown at a lower level in FIG. 13 occurs prior to the main heating end point me0 showing when application of the main pulse MP ends as shown at an upper level in FIG. 13, and this may result in an overlap time zone MS wherein the applied pulse width WM of the main pulse MP and the applied pulse width WS of the sub-pulse SP overlap.

In case such an overlap time zone MS wherein the applied pulse width WM of the main pulse MP and the applied pulse width WS of the sub-pulse SP overlap exists, the following actions can be performed on condition that the overlap time zone MS is shorter than the time required for pattern application data transfers to the thermal head 41. More specifically, these actions include: adjusting the auxiliary heating start point ss0 showing when application of the sub-pulse SP is started as shown at a lower level in FIG. 13 so as to coincide with the main heating end point me0 showing when application of the main pulse MP ends as shown at an upper level in FIG. 13, or conversely, adjusting the main heating end point me0 showing when application of the main pulse MP ends as shown at an upper level in FIG. 13 so as to coincide with the auxiliary heating start point ss0 showing when application of the sub-pulse SP starts as shown at a lower level in FIG. 13. Furthermore, the above-described actions can be performed even if the above condition is not satisfied.

Figure 14:
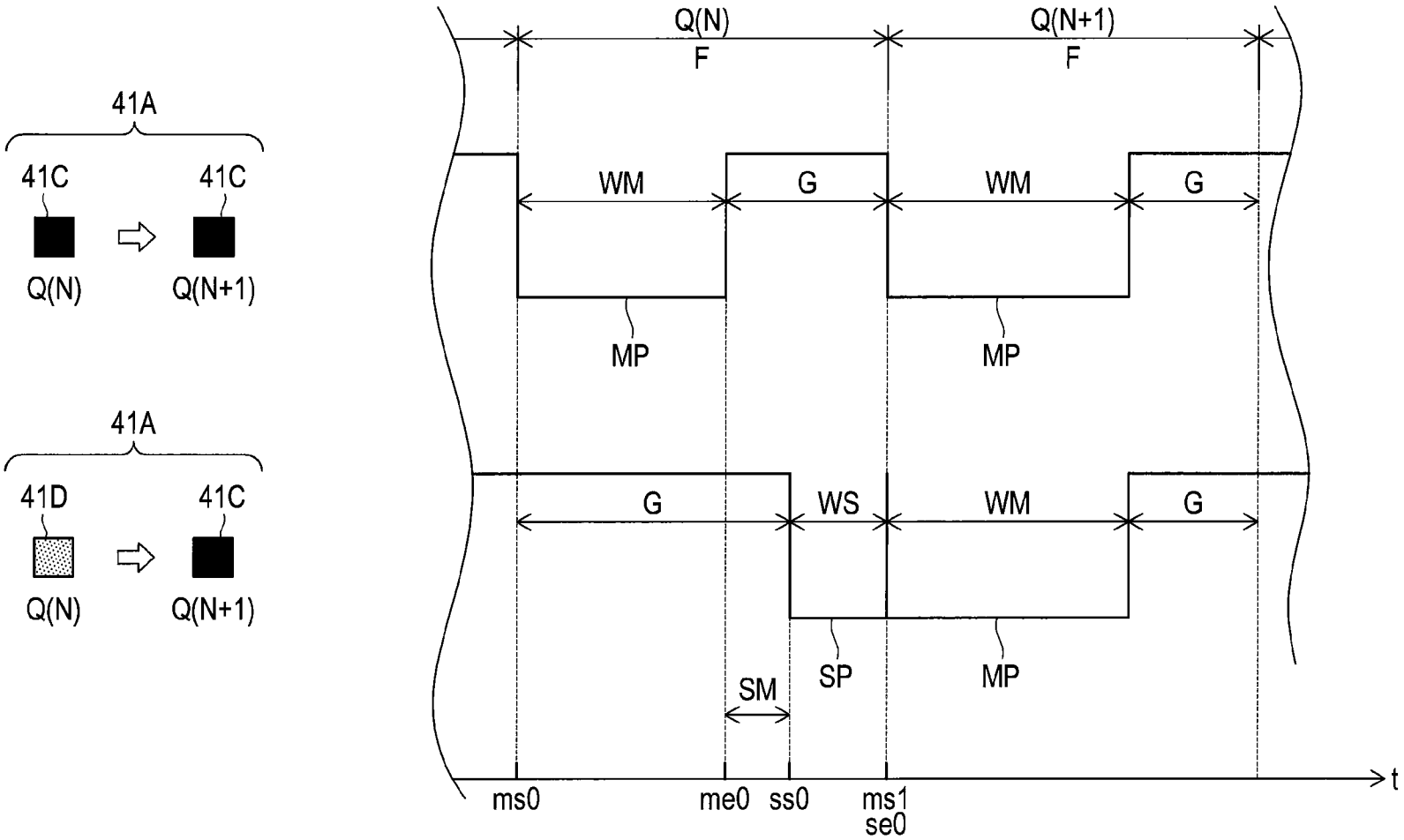
FIG. 14 is a diagram for illustrating heat history control of main heating and auxiliary heating for the thermal head of the tape printing apparatus from the viewpoint of pulse-application control to each heater element that constitutes the line head of the thermal head.

Conversely, as shown in FIG. 14, the auxiliary heating start point ss0 showing when application of the sub-pulse SP starts as shown at a lower level in FIG. 14 occurs subsequent to the main heating end point me0 showing when application of the main pulse MP ends as shown at an upper level in FIG. 14, and this may result in a separation time zone SM wherein the applied pulse width WM of the main pulse MP and the applied pulse width WS of the sub-pulse SP are separated.

In case such a separation time zone SM wherein the applied pulse width WM of the main pulse MP and the applied pulse width WS of the sub-pulse SP are separated exists, the following actions can be performed on condition that the separation time zone SM is shorter than the time required for pattern application data transfers to the thermal head 41. More specifically, these actions include: adjusting the auxiliary heating start point ss0 showing when application of the sub-pulse SP starts as shown at a lower level in FIG. 14 so as to coincide with the main heating end point me0 showing when application of the main pulse MP ends as shown at an upper level in FIG. 14, or conversely, adjusting the main heating end point me0 showing when application of the main pulse MP ends as shown at an upper level in FIG. 14 so as to coincide with the auxiliary heating start point ss0 showing when application of the sub-pulse SP starts as shown at a lower level in FIG. 14. Furthermore, the above-described actions can be performed even if the above condition is not satisfied.

Figure 15:
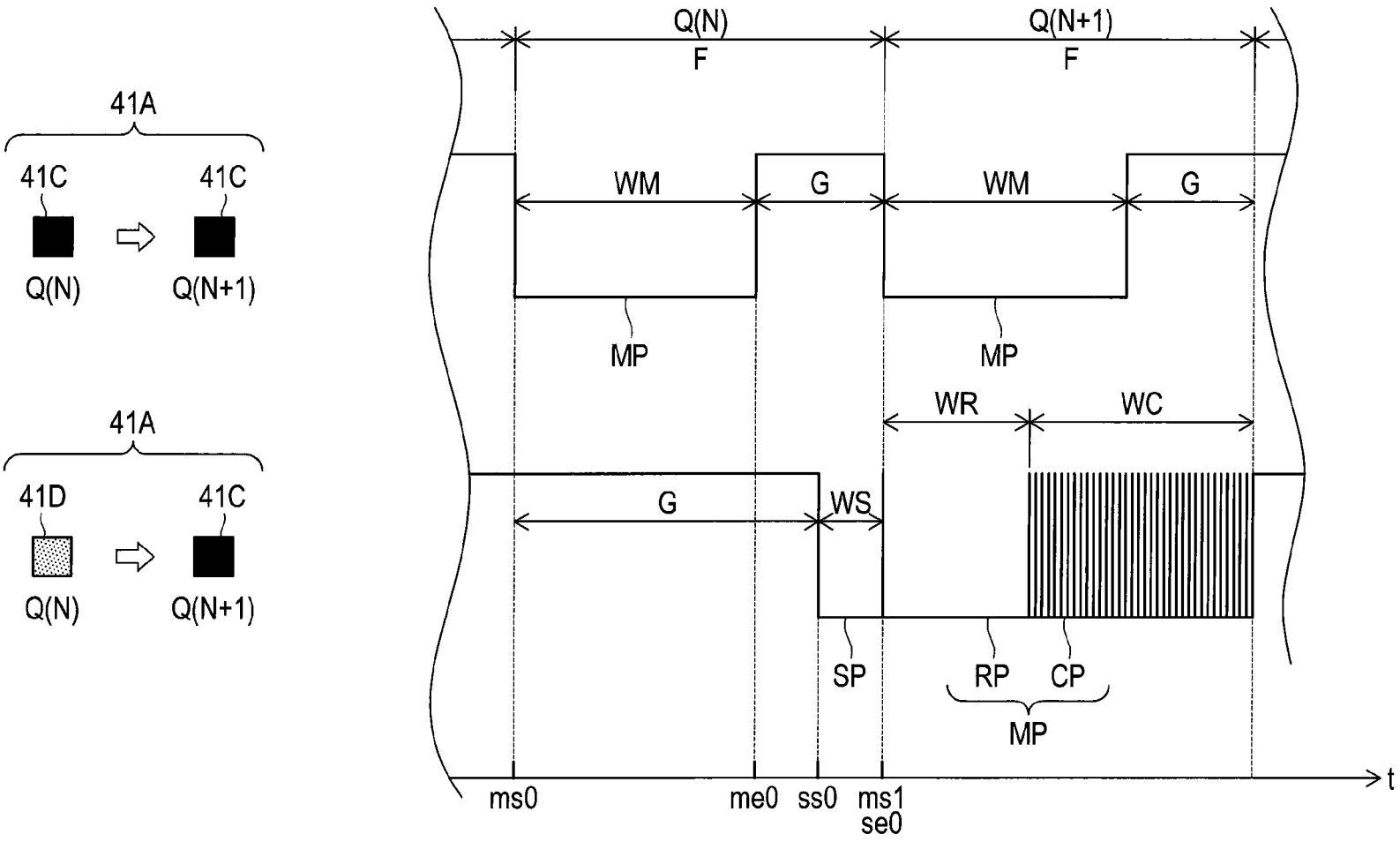
FIG. 15 is a diagram for illustrating heat history control of main heating and auxiliary heating for the thermal head of the tape printing apparatus from the viewpoint of pulse-application control to each heater element that constitutes the line head of the thermal head.

Furthermore, in the drive control of the thermal head 41 as carried out in the first embodiment, the applied pulse width WS of the sub-pulse SP can be changed for each of the heater elements 41A which constitute the line head 41B of the thermal head 41 based on the environmental data such as temperature and voltage and the like of the thermal head 41 within the application period F wherein the change occurs, as described above. In this case, the main pulse MP which is applied to the same heater element 41A in the next application period F following the sub-pulse SP whose applied pulse width WS has been changed as shown in FIG. 15 is comprised of a rectangular pulse RP and a chopping pulse CP. The ratio between the applied pulse width WR of a rectangular pulse RP and the applied pulse width WC of the chopping pulse CP can be changed. The change process may also be carried out with respect to heater elements 41A other than the heater elements 41A to which the sub-pulse SP with a changed applied pulse width WS has been applied.

[1-2 External Configuration of the Disclosure]

Next, schematic configuration of the tape printing apparatus 1 directed to the first embodiment will be described by referring to FIG. 6 and FIG. 7.

Figure 6:
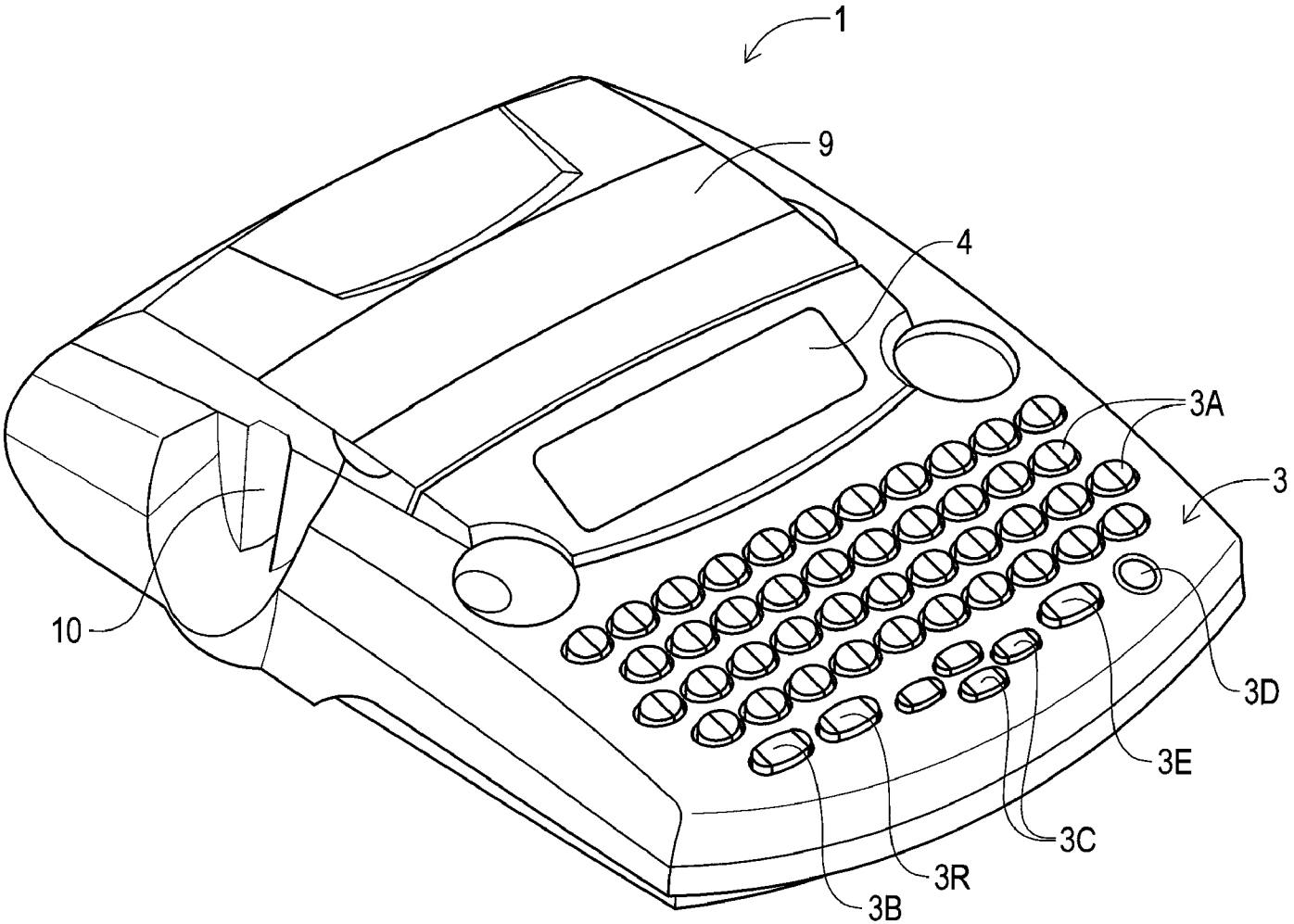
FIG. 6 is an external perspective view of the tape printing apparatus.

As shown in FIG. 6, the tape printing apparatus 1 is a printer for carrying out printing on a tape fed from a tape cassette 5 (refer to FIG. 7) housed inside a cabinet of the tape printing apparatus 1. The tape printing apparatus 1 includes a keyboard 3 and a liquid crystal display 4 on the top of the cabinet. Further, there is arranged a cassette holding portion 8 for holding the tape cassette 5. The cassette holding portion 8 is a rectangular shape when seen from top, placed inside the cabinet from a top portion thereof and covered by a housing cover 9. Beneath the keyboard 3, a control board (not shown) constituting a control circuit portion is arranged. A tape ejecting portion 10 for ejecting a printed tape is formed at the left side of the cassette holding portion 8. Further, a connection interface (not shown) is arranged at the right side of the tape printing apparatus 1. The connection interface is used for connecting the tape printing apparatus 1 to an external apparatus (e.g., a personal computer, etc.) in a manner of either wire line connection or wireless connection. Accordingly, the tape printing apparatus 1 is capable of printing out printing data transmitted from an external apparatus.

The keyboard 3 includes plural operation keys such as letter input keys 3A, a print key 3B, cursor keys 3C, a power key 3D, a setting key 3E, a return key 3R, etc. The letter input keys 3A are operated for inputting letters that create texts consisting of document data. The print key 3B is operated for commanding to print out printing data consisting of created texts, etc. The cursor keys 3C are operated for moving a cursor being indicated in the liquid crystal display 4 up, down, left or right. The power key 3D is operated for turning on or off the power of the main body of the tape printing apparatus 1. The setting key 3E is operated for setting various conditions (setting of printing density and the like). The return key 3R is operated for executing a line feeding instruction or various processing and for determining a choice from candidates.

The liquid crystal display 4 is a display device for indicating characters such as letters, etc. in plural lines, i.e., displaying printing data created by the keyboard 3.

Figure 7:
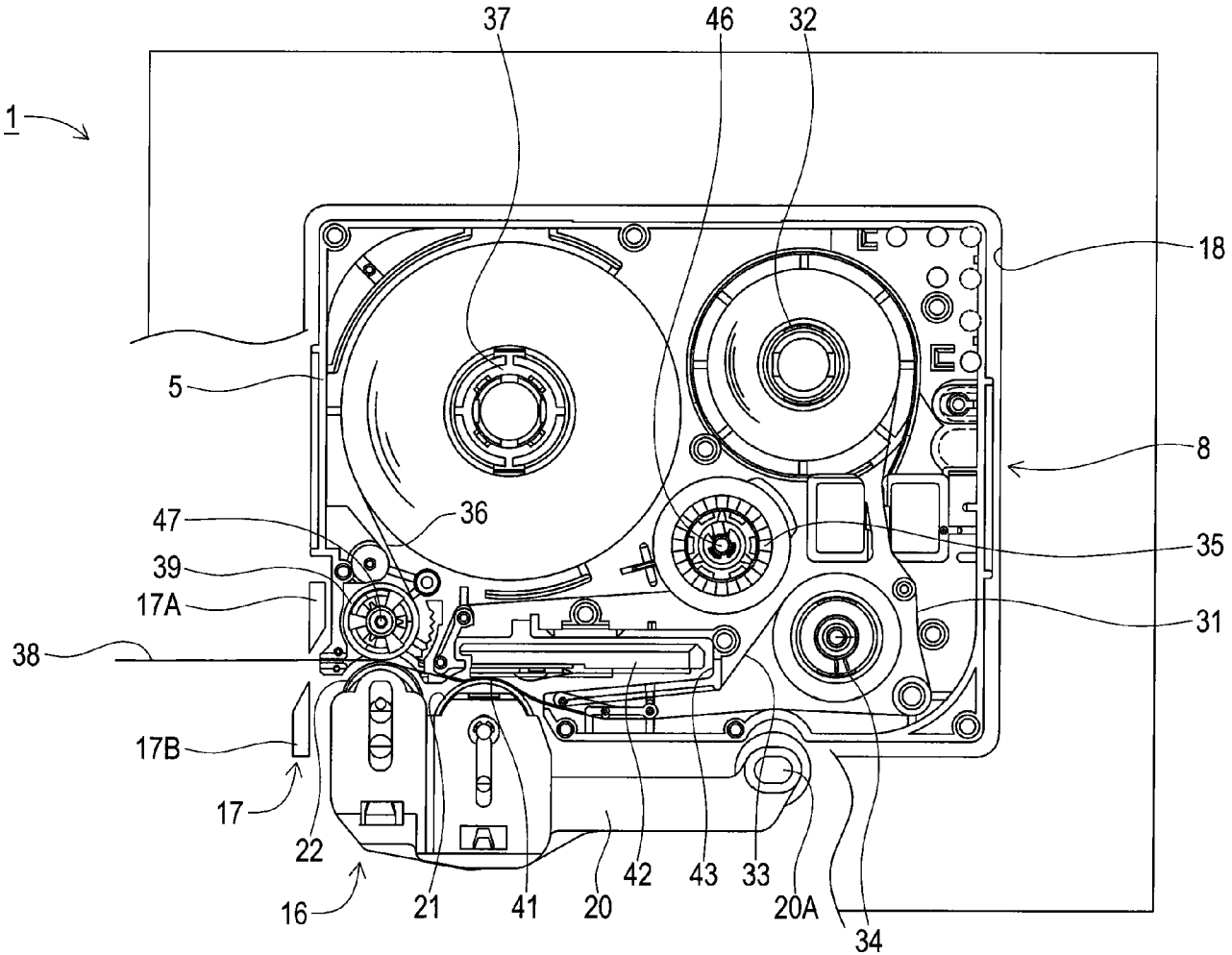
FIG. 7 is a top plan view showing a vicinity of a cassette holding portion of the tape printing apparatus.

As shown in FIG. 7, the tape printing apparatus 1 is configured such that the tape cassette 5 can be replaceably placed in the cassette holding portion 8 arranged inside thereof. Further, inside the tape printing apparatus 1, there are arranged a tape driving and printing mechanism 16 and tape cutting mechanism including a cutter 17. The tape printing apparatus 1 is capable of carrying out printing onto a tape fed from the tape cassette 5 by the tape driving and printing mechanism 16 in accordance with desired printing data. Further, the tape printing apparatus 1 is capable of cutting off a printed part of a tape with the cutter 17 constituting the tape cutting mechanism. The printed part of the tape thus cut off is ejected from the tape ejecting portion 10 formed on the left side of the tape printing apparatus 1.

Inside the tape printing apparatus 1, a cassette holding frame 18 is arranged. As shown in FIG. 7, the tape cassette 5 is replaceably placed into the cassette holding frame 18.

The tape cassette 5 includes a tape spool 32, a ribbon feeding spool 34, a used-ribbon-take-up spool 35, a base-material-sheet feeding spool 37 and a bonding roller 39 in a rotatably-supported manner, inside thereof. A surface tape 31 is wound around the tape spool 32. The surface tape 31 is made of a transparent tape such as PET (polyethylene terephthalate) film or the like. An ink ribbon 33 is wound around the ribbon seeding spool 34. On the ink ribbon 33, there is applied ink that melts or sublimes when heated so as to form an ink layer. A part of the ink ribbon 33 that has been used for printing is taken up in the used-ribbon-take-up spool 35. A double tape 36 is wound around the base-material-sheet feeding spool 37. The double tape 36 is configured so as to bond the surface tape 31 and a release tape to one side and the other side of a double-sided adhesive tape wherein the double-sided adhesive tape includes adhesive agent layers at both sides thereof with width the same as width of the surface tape 31. The double tape 36 is wound around the base-material-sheet feeding spool 37 so that the release tape is located outside. The bonding roller 39 is used for bonding the double tape 36 and the surface tape 31 together.

As shown in FIG. 7, in the cassette holding frame 18, an arm 20 is arranged around a shaft 20*a* in a pivotal manner. A platen roller 21 and a conveying roller 22 are rotatably supported at the front edge of the arm 20. Both the platen roller 21 and the conveying roller 22 employ a flexible member made of rubber or the like for their surfaces.

When the arm 20 fully swings clockwise, the platen roller 21 presses the surface tape 31 and the ink ribbon 33 against a thermal head 41 to be described later. At the same time, the conveying roller 22 presses the surface tape 31 and the double tape 36 against the bonding roller 39.

A plate 42 is arranged upright inside the cassette holding frame 18. The plate 42 includes a thermal head 41 at its side surface facing the platen roller 21. The thermal head 41 consists of a line head 41B or the like made up of a plurality (e.g. 1024 or 2048) of heater elements 41*a* aligned in the width direction of the surface tape 31 and the double tape 36.

In this connection, a direction that the heater elements 41*a* are aligned is defined as "main scanning direction D1 for the thermal head 41". Further, a direction that the surface tape 31 and the ink ribbon 33 moves passing the thermal head 41 is defined as "sub scanning direction for the thermal head 41".

Reverting to FIG. 7, when the tape cassette 5 is placed in a predetermined position, the plate 42 is fitted in a concave portion 43 of the tape cassette 5.

Further, as shown in FIG. 7, a ribbon-take-up roller 46 and a bonding-roller driving roller 47 are arranged upright inside the cassette holding frame 18. When the tape cassette 5 is placed in the predetermined position, the ribbon-take-up roller 46 and the bonding-roller driving roller 47 are inserted in the used-ribbon-take-up spool 35 and the bonding roller 39 of the tape cassette 5, respectively.

Figure 9:
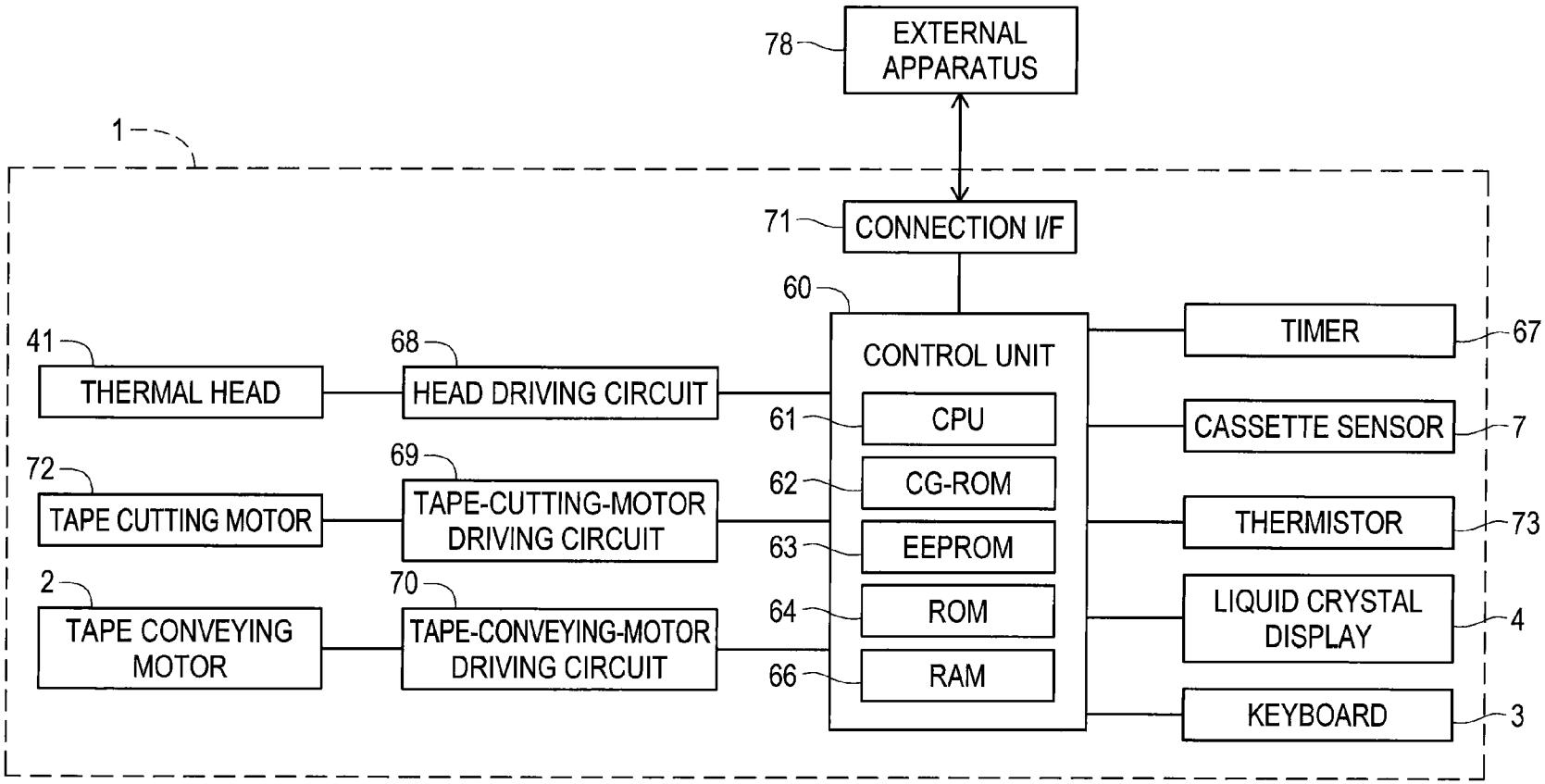
FIG. 9 is a block diagram showing control system of the tape printing apparatus.

In the cassette holding frame 18, there is arranged a tape conveying motor 2 (refer to FIG. 9). Driving force of the tape conveying motor 2 is transmitted to the platen roller 21, the conveying roller 22, the ribbon-take-up roller 46 and the bonding-roller driving roller 47, etc. via series of gears arranged along the cassette holding frame 18.

Accordingly, when rotation of an output shaft of the tape conveying motor 2 is started with supply of power to the tape conveying motor 2, rotation of the used-ribbon-take-up spool 35, the bonding roller 39, the platen roller 21 and the conveying roller 22 is started in conjunction with the operation of the tape conveying motor 2. Thereby, the surface tape 31, the ink ribbon 33 and the double tape 36 in the tape cassette 5 are loosed out from the tape spool 32, the ribbon feeding spool 34 and the base-material-sheet feeding spool 37, respectively, and are conveyed in a downstream direction (toward the tape ejecting portion 10 and the used-ribbon-take-up spool 35).

Thereafter, the surface tape 31 and the ink ribbon 33 are bonded together and go through a path between the platen roller 21 and the thermal head 41 in a superimposed state. Accordingly, in the tape printing apparatus 1 of the first embodiment, the surface tape 31 and the ink ribbon 33 are conveyed with being pressed by the platen roller 21 and the thermal head 41. The significant number of the heater elements 41*a* aligned on the thermal head 41 are selectively and intermittently energized (in a manner of pulse application) by a control unit 60 (refer to FIG. 9) in accordance with printing data and a printing control program to be described later.

Each heater element 41*a* gets heated by power supply and melts or sublimes ink applied on the ink ribbon 33. Therefore, ink in the ink layer on the ink ribbon 33 is transferred onto the surface tape 31 in a certain unit of dots. Consequently, a printing-data-based dot image desired by a user is formed on the surface tape 31 as mirror image.

After passing through the thermal head 41, the ink ribbon 33 is taken up by the ribbon-take-up roller 46. On the other hand, the surface tape 31 is superimposed onto the double tape 36 and goes through a path between the conveying roller 22 and the bonding roller 39 in a superimposed state. At the same time, the surface tape 31 and the double tape 36 are pressed against each other by the conveying roller 22 and the boding roller 39 so as to form a laminated tape 38. Of the laminated tape 38, a printed-side surface of the surface tape 31 furnished with dot printing and the double tape 36 are firmly superimposed together. Accordingly, a user can see a normal image of the printed image from the reversed side for the printed-side surface of the surface tape 31 (i.e., the top side of the laminated tape 38).

Thereafter, the laminated tape 38 is conveyed further downstream with respect to the conveying roller 22 to reach the tape cutting mechanism including the cutter 17. The tape cutting mechanism consists of the cutter 17 and the tape cutting motor 72 (refer to FIG. 9). The cutter 17 includes a fixed blade 17A and a rotary blade 17B. More specifically, the cutter 17 is a scissors-like cutter that cuts off an object to be cut off by rotating the rotary blade 17B against the fixed blade 17A. The rotary blade 17B is arranged so as to be able to rotate back and forth with reference to a shaft thereof with the aid of the tape cutting motor 72. Accordingly, the laminated tape 38 is cut off with the fixed blade 17*a* and the rotary blade 17B along operation of the tape cutting motor 72.

The laminated tape 38 thus cut off is ejected outside of the tape printing apparatus 1 via the tape ejecting portion 10. By peeling off the release paper from the double tape 36 and exposing the adhesive agent layer, the laminated tape 38 can be used as adhesive label that can be adhered to an arbitrary place. Incidentally, the mechanism of thermal transfer with the thermal head 41 will be described in detail later.

[1-3. Internal Configuration of the Disclosure]

Next, the control configuration of the tape printing apparatus 1 will be described by referring to drawings.

As shown in FIG. 9, inside the tape printing apparatus 1, there is arranged a control board (not shown) on which a control unit 60, a timer 67, a head driving circuit 68, a tape-cutting-motor driving circuit 69 and a tape-conveying-motor driving circuit 70 are arranged.

The control unit 60 consists of a CPU 61, a CG-ROM 62, an EEPROM 63, a ROM 64 and a RAM 66. Furthermore, the control unit 60 is connected to the timer 67, the head driving circuit 68, the tape-cutting-motor driving circuit 69 and the tape-conveying-motor driving circuit 70. The control unit 60 is also connected to a liquid crystal display 4, a cassette sensor 7, a thermistor 73, a keyboard 3 and a connection interface 71.

The CPU 61 is a central processing unit that plays a primary role for various system control of the tape printing apparatus 1. Accordingly, the CPU 61 controls various peripheral devices such as the liquid crystal display 4 etc. in accordance with input signals from the keyboard 3 as well as various control programs to be described later.

The CG-ROM 62 is a character generator memory wherein image data of to-be-printed letters and signs are associated with code data and stored in dot patterns. The EEPROM 63 is a non-volatile memory that allows data write for storing therein and deletion of stored data therefrom. The EEPROM 34 stores data that indicates user setting etc. of the tape printing apparatus 1.

The ROM 64 stores various control programs and various data for the tape printing apparatus 1. Accordingly, control programs to be described later are stored in the ROM 64.

The RAM 66 is a storing device for temporarily storing a processing result of the CPU 61 etc. The RAM 66 also stores printing data created with inputs by means of the keyboard 3, printing data taken therein from external apparatuses 78 via the connection interface 71.

The timer 67 is a time-measuring device that measures passage of predetermined length of time for executing control of the tape printing apparatus 1. More specifically, the timer 67 is referred for detecting start and termination of an energization (pulse application) period for a heater element 41A of the thermal head 41 in the control programs to be described later. Further, the thermistor 73 is a sensor that detects temperature of the thermal head 41 and attached on the thermal head 41.

The head driving circuit 68 is a circuit that serves to supply a driving signal to the thermal head 41 for controlling drive state of the thermal head 41 in response to a control signal from the CPU 61, along control programs to be described later. In this connection, the head driving circuit 68 controls to energize and de-energize each of the heater elements 41*a* based on a signal (strobe (STB) signal) associated with a strobe number assigned to each heater element 41A for comprehensively controlling heating manner of the thermal head 41. The tape-cutting-motor driving circuit 69 is a circuit that serves to supply a driving signal to the tape cutting motor 72 in response to a control signal from the CPU for controlling operation of the tape cutting motor 72. Further, the tape-conveying motor driving circuit 70 is a control circuit that serves to supply a driving signal to a tape conveying motor 2 based on the control signal from the CPU 61 for controlling operation of the tape conveying motor 2.

[1-4-1. First Operation of the Disclosure]

Next, first drive control of the thermal head 41 in the tape printing apparatus 1 will be described. The control program shown in the flow chart of FIG. 1 is stored in the ROM 64 or the like and is executed by the CPU 61.

Figure 1:
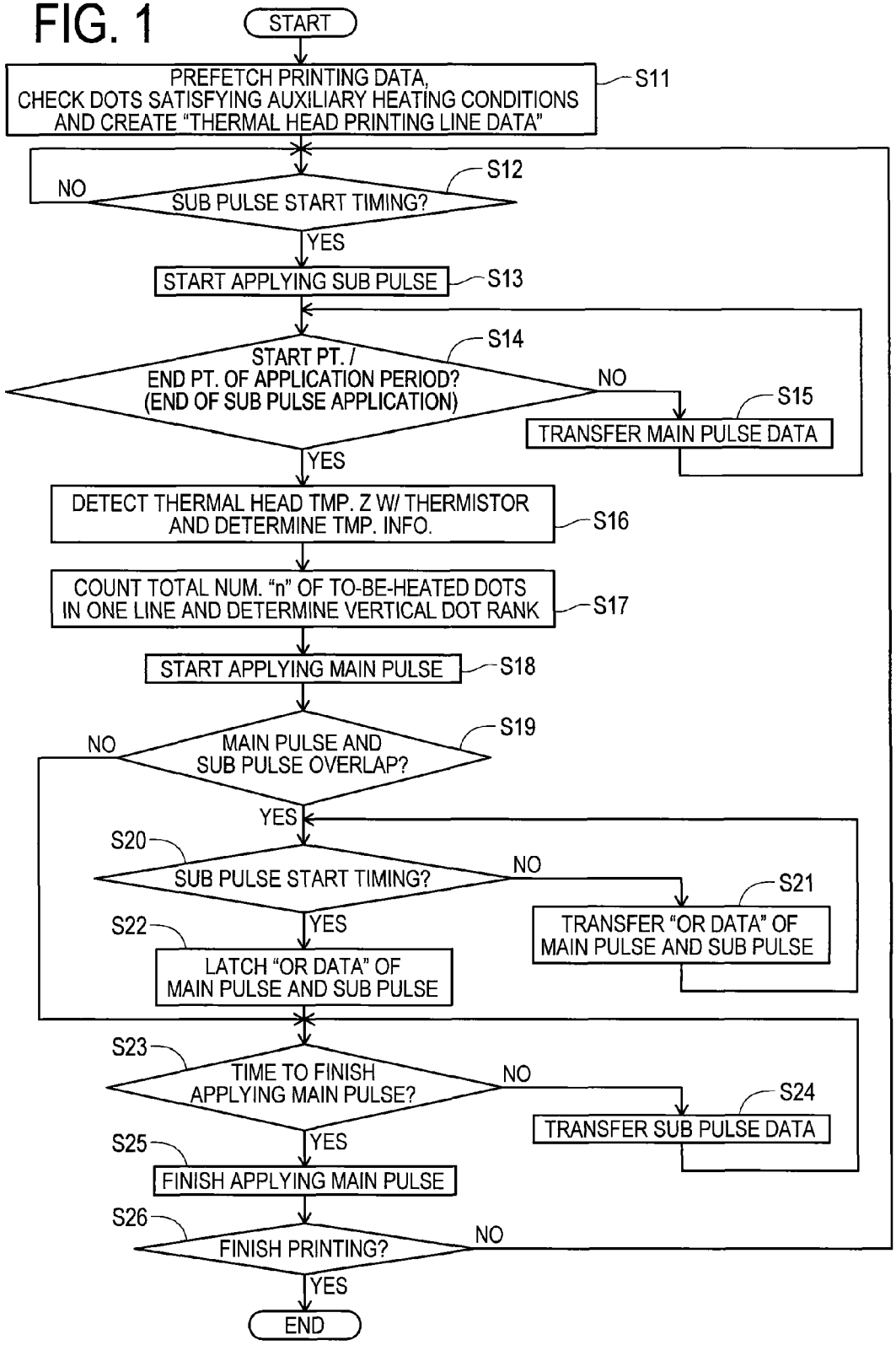
FIG. 1 is a flowchart of a control program for controlling a thermal head of a tape printing apparatus directed to the disclosure in accordance with first drive control.

As shown in FIG. 1, in first drive control of the thermal head 41, the CPU 61 first prefetches printing data from the RAM 66 and creates [thermal head printing line data] at S11. At this time, the CPU 61 creates [thermal head printing line data] wherein sub-pulse data and main pulse data corresponding to I line have been organized for each application period F based on the above-described steps (A) through (G) (auxiliary heating conditions). The sub-pulse data and the main pulse data corresponding to that I line are determined for each of the heater elements 41A constituting the line head 41B of the thermal head 41.

With respect to the [thermal head printing line data] for one line in the initial application period F, [temperature information] which was determined based on detection temperature Z of the thermal head 41 as detected by the thermistor 73 is reflected in the determination of the applied pulse width WS of the sub-pulse SP. The CPU 61 transfers the sub-pulse data which takes into consideration the above temperature information to the head driving circuit 68. Thereafter, the CPU 61 proceeds to S12.

At S12, the CPU 61 judges whether the sub-pulse SP application start timing has been reached. The timing is judged employing a timer 67 or the like. Specifically, the CPU 61 judges whether the [auxiliary heating start point ss] showing when application of the sub-pulse SP starts has been reached. Here, in the event the sub-pulse SP application start timing has not been reached (S12: NO), the CPU 61 returns to S12 and enters stand-by until the sub-pulse SP application start timing is reached. Alternatively, in the event the sub-pulse SP application start timing has been reached (S12: YES), the CPU 61 proceeds to S13.

At S13, the CPU 61 starts application of the sub-pulse SP. Specifically, the CPU 61 latches sub-pulse data to be transferred to the head driving circuit 68 at this time, and applies the sub-pulse SP to the heater elements 41A which are the target of auxiliary heating, placing these heater elements 41A in the drive state of the second heater element 41D. Thereafter, the CPU 61 proceeds to S14.

At S14, the CPU 61 judges whether the start point or otherwise end point of the application period F has been reached. The timing is judged employing a timer 67 or the like. Specifically, the CPU 61 judges whether the [auxiliary heating end point se] showing when application of the sub-pulse SP ends or alternatively, the [main heating start point ms] showing when application of the main pulse MP starts has been reached. Here, in the event the start point and the end point of the application period F have not been reached (S14: NO), the CPU 61 proceeds to S15

At S15, the CPU 61 transfers main pulse data which is the target of transfer at this point to the head driving circuit 68 in one transfer only. Thereafter, the CPU 61 returns to S14. Alternatively, in the event the start point or alternatively the end point of the print period F has been reached at S14 (S14: YES), the CPU 61 proceeds to S16.

At S16, the CPU 61 detects the temperature of the thermal head 41 using the thermistor 73 and determines the [temperature information] based on the detected temperature Z. Thereafter, the CPU 61 proceeds to S17.

At S17, the CPU 61 counts the number of to-be-heated-dots in one line to determine the [vertical dot rank]. The number of to-be-heated-dots refers to the total number n of heater elements 41A which are the target of main heating in the line head 41B of the thermal head 41 in this application period F. Thereafter, the CPU 61 proceeds to S18.

At S18, the CPU 61 starts applying the main pulse MP. Specifically, the CPU 61 latches the main pulse data which was transferred to the head driving circuit 68 at S15, and applies the main pulse MP to the heater elements 41A which are the target of main heating, placing these heater elements 41A in the drive state of the first heater element 41C. With respect to the drive state at this time, the CPU 61 reflects the applied pulse width WM of the main pulse MP as determined from the [temperature information] detected at S16 and the [vertical dot rank] at the above-described S17 towards the head driving circuit 68. Thereafter, the CPU 61 proceeds to S19.

At S19, the CPU 61 judges whether the main pulse MP and the sub pulse SP overlap. This judging process is carried out by comparing the [main heating end point me] showing when application of the main pulse MP ends with the [auxiliary heating start point ss] showing when application of the sub pulse SP starts. Here, in the event the main pulse MP and the sub pulse SP do not overlap (S19: NO), the flow proceeds to S23 to be described later. Alternatively, in case the main pulse MP and the sub pulse SP overlap (S19: YES), the CPU 61 proceeds to S20.

At S20, the CPU 61 judges whether the sub pulse SP application start timing has been reached. This judging process is carried out using timer 67 or the like. Specifically, the CPU 61 determines whether the [auxiliary application start point ss] showing when application of the sub pulse SP starts has been reached. Here, in the event the sub pulse SP application start timing has not been reached (S20: NO), the CPU 61 proceeds to S21.

At S21, the CPU 61 transfers the [OR data] (which is the target of transfer at this point) of the main pulse MP and the sub pulse SP to the head driving circuit 68 in one transfer only. Thereafter, the CPU 61 returns to S20. On the one hand, in the event the sub pulse SP application start timing has been reached at S20 (S20: YES), the CPU 61 proceeds to S22.

At S22, the CPU 61 latches the [OR data] of the main pulse MP and the sub pulse SP with respect to the head driving circuit 68. Thereafter, the CPU 61 proceeds to S23.

At S23, the CPU 61 judges whether the main pulse MP application end timing has been reached. This process is carried out using timer 67 or the like. Specifically, it is judged whether the [main heating end point me] showing when application of the main pulse MP ends has been reached. Here, in the event the main pulse MP application end timing has not been reached (S23: NO), the CPU 61 proceeds to S24.

At S24, the CPU 61 transfers sub pulse data which is the target of transfer at this point to the head driving circuit 68 in one transfer only. Thereafter, the CPU 61 returns to S23. On the other hand, in the event the main pulse MP application end timing has been reached at S23 (S23: YES), the CPU 61 proceeds to S25.

At S25, the CPU 61 ends application of the main pulse MP. Specifically, the CPU 61 causes the head driving circuit 68 to end application of the main pulse MP with respect to the heater element 41A which is the target of main heating. Thereafter, the CPU 61 proceeds to S26.

At S26, the CPU 61 judges whether printing has finished. Here, in the event printing has not finished (S26: NO), the CPU 61 returns to S12 and repeats the processes subsequent to S12. On the other hand, in the event printing has finished (S26: YES), the CPU 61 ends this program.

[1-4-2. Second Operation of the Disclosure]

Next, second drive control of the thermal head 41 in the tape printing apparatus 1 will be described. The control program shown in the flow chart of FIG. 2 is stored in the ROM 64 or the like and is executed by the CPU 61.

Figure 2:
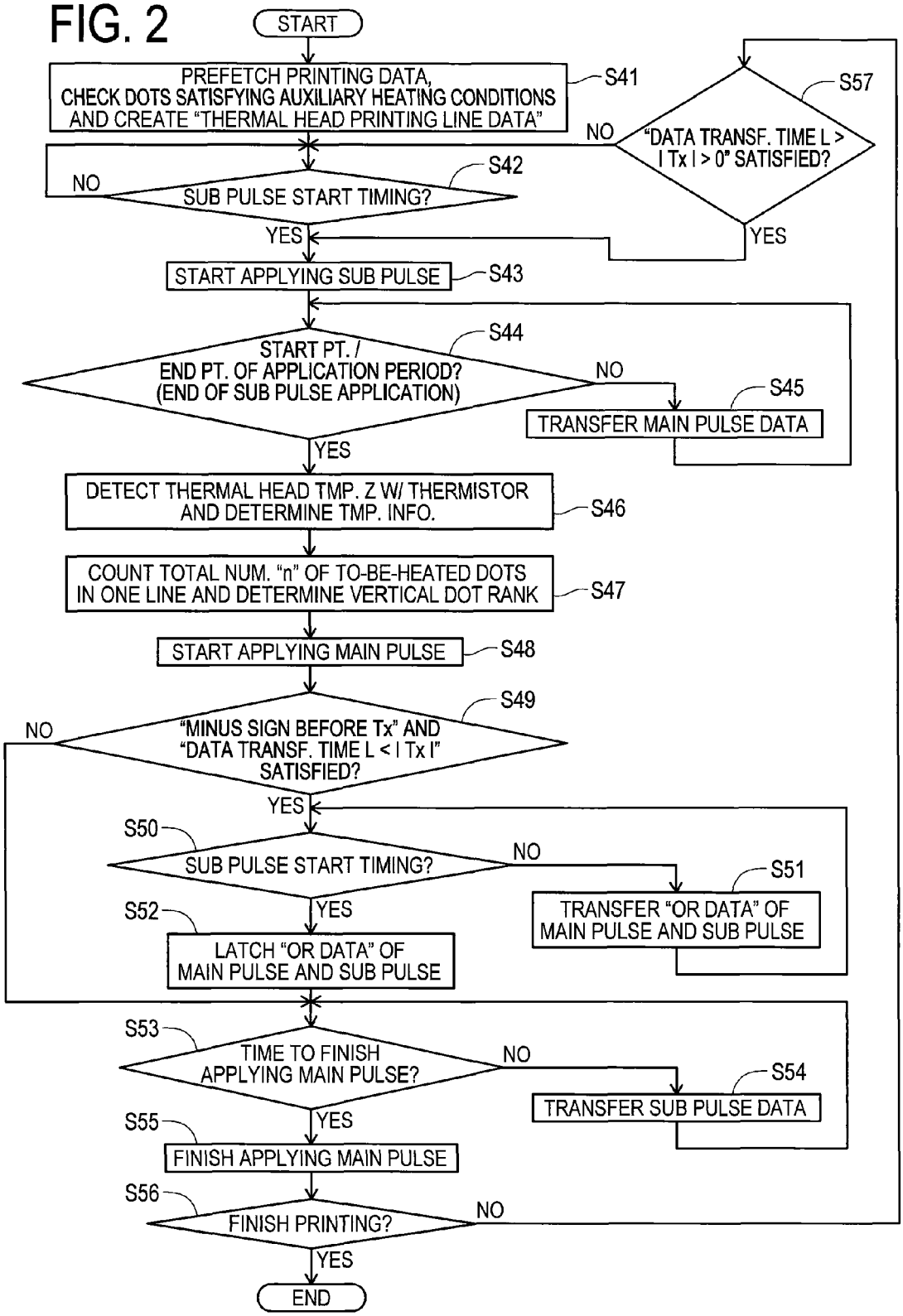
FIG. 2 is a flowchart of a control program for controlling the thermal head of the tape printing apparatus in accordance with second drive control.

As shown in FIG. 2, in second drive control of the thermal head 41, the CPU 61 first prefetches printing data from the RAM 66 and creates [thermal head printing line data] at S41. At this time, the CPU 61 creates [thermal head printing line data] wherein sub-pulse data and main pulse data corresponding to I line have been organized for each application period F based on the above-described steps (A) through (G) (auxiliary heating conditions). The sub-pulse data and the main pulse data corresponding to that I line are determined for each of the heater elements 41A constituting the line head 41B of the thermal head 41.

With respect to the [thermal head printing line data] for one line in the initial application period F, [temperature information] which was determined based on detection temperature Z of the thermal head 41 as detected by the thermistor 73 is reflected in the determination of the applied pulse width WS of the sub-pulse SP. The CPU 61 transfers the sub-pulse data which takes into consideration the above temperature information to the head driving circuit 68. Thereafter, the CPU 61 proceeds to S42.

At S42, the CPU 61 judges whether the sub-pulse SP application start timing has been reached. The timing is judged employing a timer 67 or the like. Specifically, the CPU 61 judges whether the [auxiliary heating start point ss] showing when application of the sub-pulse SP starts has been reached. Here, in the event the sub-pulse SP application start timing has not been reached (S42: NO), the CPU 61 returns to S12 and enters stand-by until the sub-pulse SP application start timing is reached. Alternatively, in the event the sub-pulse SP application start timing has been reached (S42: YES), the CPU 61 proceeds to S13.

At S43, the CPU 61 starts application of the sub-pulse SP. Specifically, the CPU 61 latches sub-pulse data to be transferred to the head driving circuit 68 at this time, and applies the sub-pulse SP to the heater elements 41A which are the target of auxiliary heating, placing these heater elements 41A in the drive state of the second heater element 41D. Thereafter, the CPU 61 proceeds to S44.

At S44, the CPU 61 judges whether the start point or otherwise end point of the application period F has been reached. The timing is judged employing a timer 67 or the like. Specifically, the CPU 61 judges whether the [auxiliary heating end point se] showing when application of the sub-pulse SP ends or alternatively, the [main heating start point ms] showing when application of the main pulse MP starts has been reached. Here, in the event the start point and the end point of the application period F have not been reached (S44: NO), the CPU 61 proceeds to S45.

At S45, the CPU 61 transfers main pulse data which is the target of transfer at this point to the head driving circuit 68 in one transfer only. Thereafter, the CPU 61 returns to S44. Alternatively, in the event the start point or alternatively the end point of the print period F has been reached at S44 (S44: YES), the CPU 61 proceeds to S46.

At S46, the CPU 61 detects the temperature of the thermal head 41 using the thermistor 73 and determines the [temperature information] based on the detected temperature Z. Thereafter, the CPU 61 proceeds to S47.

At S47, the CPU 61 counts the number of to-be-heated-dots in one line to determine the [vertical dot rank]. The number of to-be-heated-dots refers to the total number n of heater elements 41A which are the target of main heating in the line head 41B of the thermal head 41 in this application period F. Thereafter, the CPU 61 proceeds to S48.

At S48, the CPU 61 starts applying the main pulse MP. Specifically, the CPU 61 latches the main pulse data which was transferred to the head driving circuit 68 at S45, and applies the main pulse MP to the heater elements 41A which are the target of main heating, placing these heater elements 41A in the drive state of the first heater element 41C. With respect to the drive state at this time, the CPU 61 reflects the applied pulse width WM of the main pulse MP as determined from the [temperature information] detected at S46 and the [vertical dot rank] at the above-described S47 towards the head driving circuit 68. Thereafter, the CPU 61 proceeds to S49.

At S49, the CPU 61 first calculates a variable Tx by subtracting the total value of the applied pulse width WM of the main pulse MP and the applied pulse width SM of the sub pulse SP from the application period F. Further, the CPU 61 judges whether the variable Tx has a minus (−) sign before it and the absolute value of the variable Tx is larger than the data transfer time L. Here, the data transfer time L represents the data transfer time at S45 as described above and S51 and S54 as will be described later.

Here, in the event the sign before the variable Tx is not minus (−) or otherwise, the absolute value of the variable Tx is not larger than the data transfer time L (S49: NO), the CPU 61 proceeds to S53 to be described later. Alternatively, in the event the sign before the variable Tx is minus (−) and the absolute value of the variable Tx is larger than the data transfer time L (S49: YES), the CPU 61 proceeds to S50.

At S50, the CPU 61 judges whether the sub pulse SP application start timing has been reached. This judging process is carried out using timer 67 or the like. Specifically, the CPU 61 determines whether the [auxiliary application start point ss] showing when application of the sub pulse SP starts has been reached. Here, in the event the sub pulse SP application start timing has not been reached (S50: NO), the CPU 61 proceeds to S51

At S51, the CPU 61 transfers the [OR data] (which is the target of transfer at this point) of the main pulse MP and the sub pulse SP to the head driving circuit 68 in one transfer only. Thereafter, the CPU 61 returns to S50. On the one hand, in the event the sub pulse SP application start timing has been reached at S20 (S50: YES), the CPU 61 proceeds to S52.

At S52, the CPU 61 latches the [OR data] of the main pulse MP and the sub pulse SP with respect to the head driving circuit 68. Thereafter, the CPU 61 proceeds to S53.

At S53, the CPU 61 judges whether the main pulse MP application end timing has been reached. This process is carried out using timer 67 or the like. Specifically, it is judged whether the [main heating end point me] showing when application of the main pulse MP ends has been reached. Here, in the event the main pulse MP application end timing has not been reached (S53: NO), the CPU 61 proceeds to S54.

At S54, the CPU 61 transfers sub pulse data which is the target of transfer at this point to the head driving circuit 68 in one transfer only. Thereafter, the CPU 61 returns to S53. On the other hand, in the event the main pulse MP application end timing has been reached at S53 (S53: YES), the CPU 61 proceeds to S55.

At S55, the CPU 61 ends application of the main pulse MP. Specifically, the CPU 61 causes the head driving circuit 68 to end application of the main pulse MP with respect to the heater element 41A which is the target of main heating. Thereafter, the CPU 61 proceeds to S56.

At S56, the CPU 61 judges whether printing has finished. Here, in the event printing has finished (S56: YES), the CPU 61 ends this program. On the other hand, in the event printing has not finished (S56: NO), the CPU 61 proceeds to S57.

At S57, the CPU 61 judges whether the variable Tx is larger than [0] and the absolute value of the variable Tx is smaller than the data transfer time L. Here, in the event the variable Tx is not larger than [0] or otherwise the absolute value of the variable Tx is not smaller than the data transfer time L (S57: NO), the CPU 61 returns to S42 and repeats the processes subsequent to S42. Alternatively, in the event the variable Tx is larger than [0] and the absolute value of the variable Tx is smaller than the data transfer time L (S57: YES), the CPU 61 returns to S43 and repeats the processes subsequent to S43.

Accordingly, if the time difference between the [main heating end point me] showing when application of the main pulse ends and the [auxiliary heating start point ss] showing when application of the sub pulse SP starts is smaller than the data transfer time L at the above-described S45, S51 and S54, the [auxiliary heating start time ss] showing when application of the sub pulse SP starts is made to coincide with the [main heating end point me] showing when application of the main pulse MP ends.

[1-4-3. Third Operation of the Disclosure]

Figure 3:
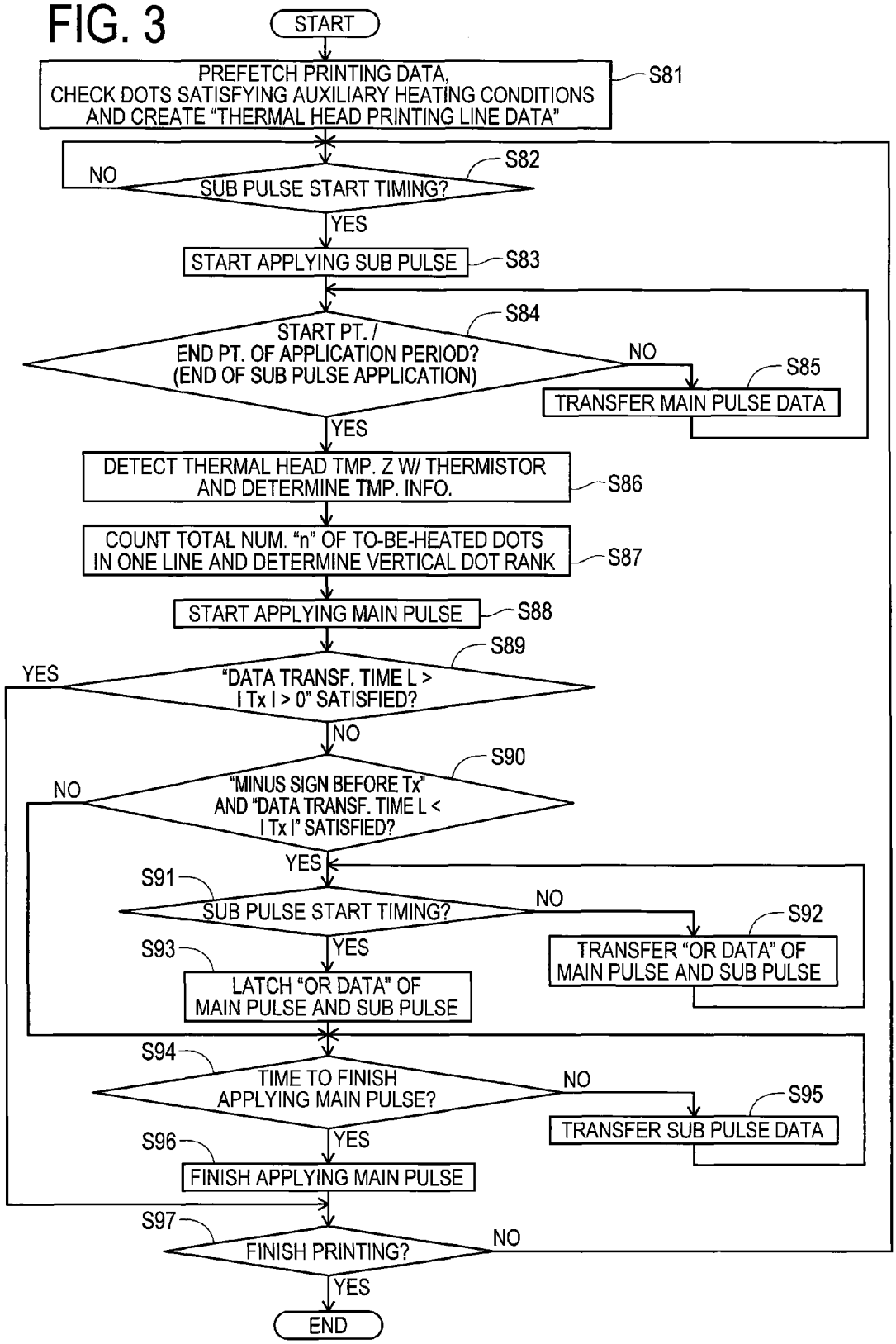
FIG. 3 is a flowchart of a control program for controlling the thermal head of the tape printing apparatus in accordance with third drive control.

Next, third drive control of the thermal head 41 in the tape printing apparatus 1 will be described. The control program shown in the flow chart of FIG. 3 is stored in the ROM 64 or the like and is executed by the CPU 61.

As shown in FIG. 1, in first drive control of the thermal head 41, the CPU 61 first prefetches printing data from the RAM 66 and creates [thermal head printing line data] at S11. At this time, the CPU 61 creates [thermal head printing line data] wherein sub-pulse data and main pulse data corresponding to I line have been organized for each application period F based on the above-described steps (A) through (G) (auxiliary heating conditions). The sub-pulse data and the main pulse data corresponding to that I line are determined for each of the heater elements 41A constituting the line head 41B of the thermal head 41.

With respect to the [thermal head printing line data] for one line in the initial application period F, [temperature information] which was determined based on detection temperature Z of the thermal head 41 as detected by the thermistor 73 is reflected in the determination of the applied pulse width WS of the sub-pulse SP. The CPU 61 transfers the sub-pulse data which takes into consideration the above temperature information to the head driving circuit 68. Thereafter, the CPU 61 proceeds to S82.

At S82, the CPU 61 judges whether the sub-pulse SP application start timing has been reached. The timing is judged employing a timer 67 or the like. Specifically, the CPU 61 judges whether the [auxiliary heating start point ss] showing when application of the sub-pulse SP starts has been reached. Here, in the event the sub-pulse SP application start timing has not been reached (S82: NO), the CPU 61 returns to S82 and enters stand-by until the sub-pulse SP application start timing is reached. Alternatively, in the event the sub-pulse SP application start timing has been reached (S82: YES), the CPU 61 proceeds to S83.

At S83, the CPU 61 starts application of the sub-pulse SP. Specifically, the CPU 61 latches sub-pulse data to be transferred to the head driving circuit 68 at this time, and applies the sub-pulse SP to the heater elements 41A which are the target of auxiliary heating, placing these heater elements 41A in the drive state of the second heater element 41D. Thereafter, the CPU 61 proceeds to S84.

At S84, the CPU 61 judges whether the start point or otherwise end point of the application period F has been reached. The timing is judged employing a timer 67 or the like. Specifically, the CPU 61 judges whether the [auxiliary heating end point se] showing when application of the sub-pulse SP ends or alternatively, the [main heating start point ms] showing when application of the main pulse MP starts has been reached. Here, in the event the start point and the end point of the application period F have not been reached (S18: NO), the CPU 61 proceeds to S85.

At S85, the CPU 61 transfers main pulse data which is the target of transfer at this point to the head driving circuit 68 in one transfer only. Thereafter, the CPU 61 returns to S84. Alternatively, in the event the start point or alternatively the end point of the print period F has been reached at S84 (S84: YES), the CPU 61 proceeds to S16.

At S86, the CPU 61 detects the temperature of the thermal head 41 using the thermistor 73 and determines the [temperature information] based on the detected temperature Z. Thereafter, the CPU 61 proceeds to S87.

At S87, the CPU 61 counts the number of to-be-heated-dots in one line to determine the [vertical dot rank]. The number of to-be-heated-dots refers to the total number n of heater elements 41A which are the target of main heating in the line head 41B of the thermal head 41 in this application period F. Thereafter, the CPU 61 proceeds to S88.

At S88, the CPU 61 starts applying the main pulse MP. Specifically, the CPU 61 latches the main pulse data which was transferred to the head driving circuit 68 at S15, and applies the main pulse MP to the heater elements 41A which are the target of main heating, placing these heater elements 41A in the drive state of the first heater element 41C. With respect to the drive state at this time, the CPU 61 reflects the applied pulse width WM of the main pulse MP as determined from the [temperature information] detected at S86 and the [vertical dot rank] at the above-described S87 towards the head driving circuit 68. Thereafter, the CPU 61 proceeds to S89.

At S89, the CPU 61 first calculates a variable Tx by subtracting the total value of the applied pulse width WM of the main pulse MP and the applied pulse width SM of the sub pulse SP from the application period F. Further, the CPU 61 judges whether the variable Tx is larger than [0] and the absolute value of the variable Tx is smaller than the data transfer time L. Here, the data transfer time L represents the data transfer time at S85 as described above and S92 and S95 as will be described later. In the event the variable Tx is larger than [0] and the absolute value of the variable Tx is smaller than the data transfer time L (S80: YES), the CPU 61 proceeds to S97 to be described later.

On the other hand, in the event the variable Tx is not larger than [0] or otherwise the absolute value of the variable Tx is not smaller than the data transfer time L (S98: NO), the CPU 61 proceeds to S90.

At S90, the CPU 61 judges whether the variable Tx has a minus (−) sign before it and the absolute value of the variable Tx is larger than the data transfer time L. Here, in the event the sign before the variable Tx is not minus (−) or otherwise, the absolute value of the variable Tx is not larger than the data transfer time L (S90: NO), the CPU 61 proceeds to S94 to be described later. Alternatively, in the event the sign before the variable Tx is minus (−) and the absolute value of the variable Tx is larger than the data transfer time L (S90: YES), the CPU 61 proceeds to S91.

At S91, the CPU 61 judges whether the sub pulse SP application start timing has been reached. This judging process is carried out using timer 67 or the like. Specifically, the CPU 61 determines whether the [auxiliary application start point ss] showing when application of the sub pulse SP starts has been reached. Here, in the event the sub pulse SP application start timing has not been reached (S91: NO), the CPU 61 proceeds to S92.

At S92, the CPU 61 transfers the [OR data] (which is the target of transfer at this point) of the main pulse MP and the sub pulse SP to the head driving circuit 68 in one transfer only. Thereafter, the CPU 61 returns to S91. On the one hand, in the event the sub pulse SP application start timing has been reached at S91 (S91: YES), the CPU 61 proceeds to S93.

At S93, the CPU 61 latches the [OR data] of the main pulse MP and the sub pulse SP with respect to the head driving circuit 68. Thereafter, the CPU 61 proceeds to S94.

At S94, the CPU 61 judges whether the main pulse MP application end timing has been reached. This process is carried out using timer 67 or the like. Specifically, it is judged whether the [main heating end point me] showing when application of the main pulse MP ends has been reached. Here, in the event the main pulse MP application end timing has not been reached (S94: NO), the CPU 61 proceeds to S95.

At S95, the CPU 61 transfers sub pulse data which is the target of transfer at this point to the head driving circuit 68 in one transfer only. Thereafter, the CPU 61 returns to S94. On the other hand, in the event the main pulse MP application end timing has been reached at S94 (S94: YES), the CPU 61 proceeds to S96.

At S96, the CPU 61 ends application of the main pulse MP. Specifically, the CPU 61 causes the head driving circuit 68 to end application of the main pulse MP with respect to the heater element 41A which is the target of main heating. Thereafter, the CPU 61 proceeds to S97.

At S97, the CPU 61 judges whether printing has finished. Here, in the event printing has not finished (S97: NO), the CPU 61 returns to S82 and repeats the processes subsequent to S82. On the other hand, in the event printing has finished (S97: YES), the CPU 61 ends this program.

Accordingly, if the time difference between the [main heating end point me] showing when application of the main pulse ends and the [auxiliary heating start point ss] showing when application of the sub pulse SP starts is smaller than the data transfer time L at the above-described S85, S92 and S95, the [auxiliary heating start time ss] showing when application of the sub pulse SP starts is made to coincide with the [main heating end point me] showing when application of the main pulse MP ends.

[1-4-4. Fourth Operation of the Disclosure]

Next, fourth drive control of the thermal head 41 in the tape printing apparatus 1 will be described. The control program shown in the flow chart of FIG. 4 is stored in the ROM 64 or the like and is executed by the CPU 61.

Figure 4:
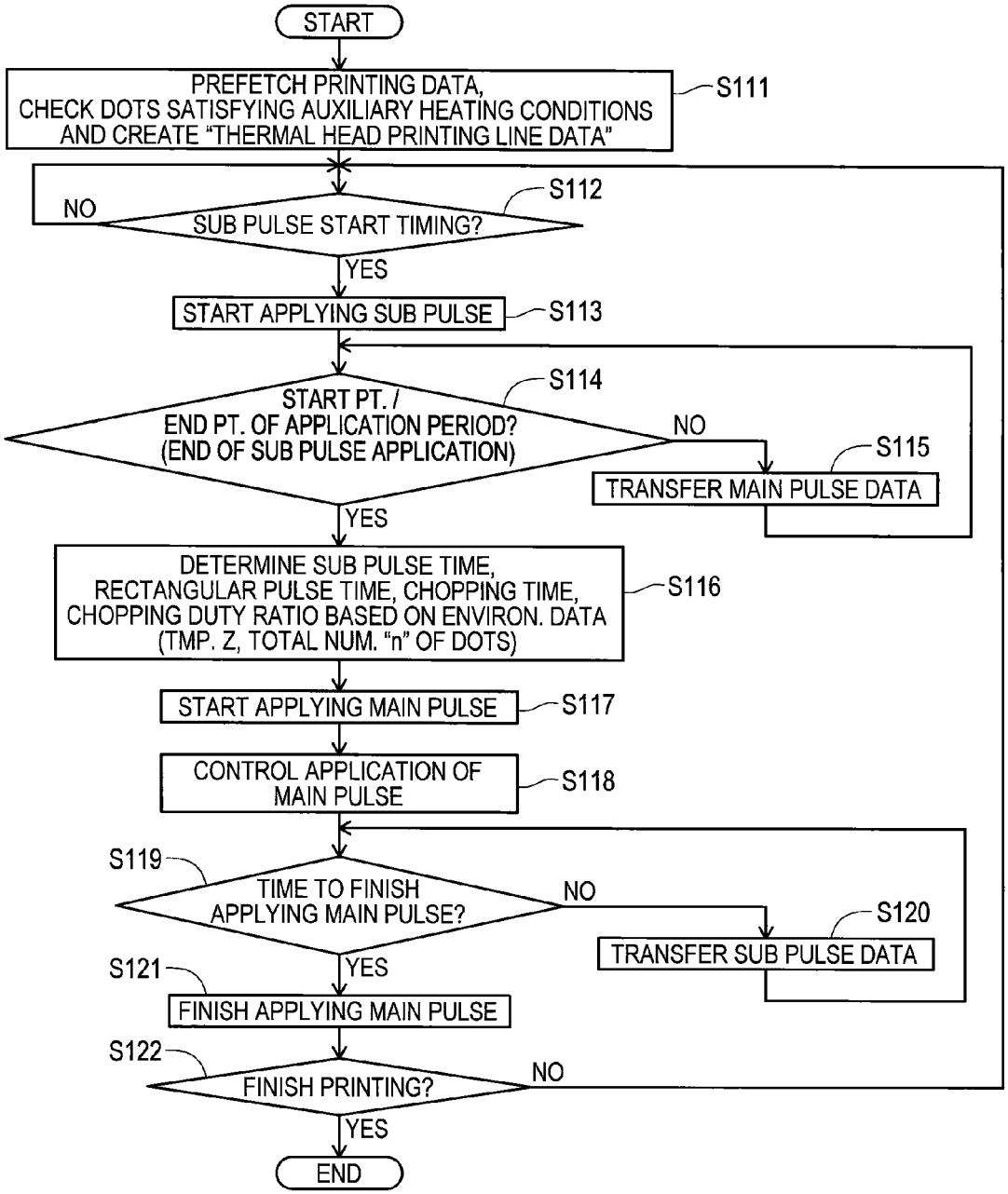
FIG. 4 is a flowchart of a control program for controlling the thermal head of the tape printing apparatus in accordance with fourth drive control.

As shown in FIG. 4, in fourth drive control of the thermal head 41, the CPU 61 first prefetches printing data from the RAM 66 and creates [thermal head printing line data] at S111. At this time, the CPU 61 creates [thermal head printing line data] wherein sub-pulse data and main pulse data corresponding to I line have been organized for each application period F based on the above-described steps (A) through (G) (auxiliary heating conditions). The sub-pulse data and the main pulse data corresponding to that I line are determined for each of the heater elements 41A constituting the line head 41B of the thermal head 41.

With respect to the [thermal head printing line data] for one line in the initial application period F, [temperature information] which was determined based on detection temperature Z of the thermal head 41 as detected by the thermistor 73 is reflected in the determination of the applied pulse width WS of the sub-pulse SP. The CPU 61 transfers the sub-pulse data which takes into consideration the above temperature information to the head driving circuit 68. Thereafter, the CPU 61 proceeds to S112.

At S112, the CPU 61 judges whether the sub-pulse SP application start timing has been reached. The timing is judged employing a timer 67 or the like. Specifically, the CPU 61 judges whether the [auxiliary heating start point ss] showing when application of the sub-pulse SP starts has been reached. Here, in the event the sub-pulse SP application start timing has not been reached (S112: NO), the CPU 61 returns to S112 and enters stand-by until the sub-pulse SP application start timing is reached. Alternatively, in the event the sub-pulse SP application start timing has been reached (S112: YES), the CPU 61 proceeds to S113.

At S113, the CPU 61 starts application of the sub-pulse SP. Specifically, the CPU 61 latches sub-pulse data to be transferred to the head driving circuit 68 at this time, and applies the sub-pulse SP to the heater elements 41A which are the target of auxiliary heating, placing these heater elements 41A in the drive state of the second heater element 41D. Thereafter, the CPU 61 proceeds to S114.

At S114, the CPU 61 judges whether the start point or otherwise end point of the application period F has been reached. The timing is judged employing a timer 67 or the like. Specifically, the CPU 61 judges whether the [auxiliary heating end point se] showing when application of the sub-pulse SP ends or alternatively, the [main heating start point ms] showing when application of the main pulse MP starts has been reached. Here, in the event the start point and the end point of the application period F have not been reached (S114: NO), the CPU 61 proceeds to S115.

At S15, the CPU 61 transfers main pulse data which is the target of transfer at this point to the head driving circuit 68 in one transfer only. Thereafter, the CPU 61 returns to S14. Alternatively, in the event the start point or alternatively the end point of the print period F has been reached at S114 (S114: YES), the CPU 61 proceeds to S116.

At S116, the CPU 61 detects the temperature of the thermal head 41 using the thermistor 73. The CPU 61 counts the number of to-be-heated-dots in one line. The number of to-be-heated-dots refers to the total number n of heater elements 41A which are the target of main heating in the line head 41B of the thermal head 41 in this application period F. Further, the CPU 61 determines the sub pulse time (applied pulse width WS for the sub pulse SP), rectangular pulse time (applied pulse width WR for the rectangular pulse RP), chopping time (applied pulse width WC of the chopping pulse CP) and chopping duty ratio and the like based on the detection temperature Z of the thermal head 41 as described above and the number n of to-be-heated-dots in one line as described above.

The table data 201 as shown in FIG. 5 for instance is used in the above determination process. As is shown in the table data 201 in FIG. 5, the application period F is 875 μsec (printing speed is 80 mm/sec). The table data 201 in FIG. 5 has a temperature range column 211, heated dots column 212, sub pulse column 213 and several main pulse columns 214, 215, 216 and 217.

The temperature range column 211 shows the temperature range of the thermal head 41 in units of degrees Celsius (° C.). The number of heated dots column 212 shows the amount of heated dots in one line in units of numbers. The sub pulse column 213 shows the applied pulse width WS of the sub pulse SP in units of [μsec] (refer to FIG. 15). The main pulse column 214 shows the applied pulse width WR of the rectangular RP constituting the main pulse MP in units of [μsec] (refer to FIG. 15). The main pulse column 215 shows the applied pulse width WC of the chopping pulse CP constituting the main pulse MP in units of [μsec] (refer to FIG. 15). The main pulse column 216 shows the number of chopping pulses CP constituting the main pulse MP. The main pulse column 217 shows the duty ratio of the chopping pulse CP constituting the main pulse MP. The table data 201 shown in FIG. 5 is created for each of a plurality of application periods F and is stored in ROM 64.

The judgment made at S116 is carried out using the procedure as described hereinafter from (1) through (5).

(1) Determine the applied pulse width WS of the sub pulse SP from the temperature of the thermal head 41 as described above and the number of heated dots in one line as described above.

(2) Determine the applied pulse width WR of the rectangular pulse RP constituting the main pulse MP by multiplying the applied pulse width WS of the sub pulse SP with a fixed coefficient.

(3) Determine a value calculated by subtracting a total value including the applied pulse width WS of the sub pulse SP and the applied pulse width WR of the rectangular pulse RP from the application period F and set is as the applied pulse width WC of the chopping pulse CP.

(4) Determine the number of chopping pulses CP by dividing the applied pulse width WC of the chopping pulse CP by the fixed chopping period time.

(5) Determine the duty ratio of the chopping pulse CP by multiplying the total value of the applied pulse width WS of the sub pulse SP and the applied pulse width WC of the chopping pulse CP by the coefficient of an experimental value.

In case the application period F is 875 μsec, the CPU 61 reads out the numerical value determined using the above described flow (1) through (5) from the table data 201 shown in FIG. 5. As shown above, the ROM 64 stores a plurality of table data 201 as created for each application period, in addition to the table data 201 shown in FIG. 5. Accordingly, the CPU 61 carries out the decision process at S116 based on the data table corresponding to the value of the application period F. Thereafter, the CPU 61 proceeds to S117.

At S117, the CPU 61 starts applying the main pulse MP. Specifically, the CPU 61 latches the main pulse data which was transferred to the head driving circuit 68 at S115, and applies the main pulse MP to the heater elements 41A which are the target of main heating, placing these heater elements 41A in the drive state of the first heater element 41C. Thereafter, the CPU 61 proceeds to S118.

At S118, the CPU 61 applies the main pulse MP based on what was decided at S116. Specifically, the rectangular pulse RP and the chopping pulse CP constituting the main pulse MP are controlled as described at S116. Thereafter, the CPU 61 proceeds to S119.

At S119, the CPU 61 judges whether the main pulse MP application end timing has been reached. This process is carried out using timer 67 or the like. Specifically, it is judged whether the [main heating end point me] showing when application of the main pulse MP ends has been reached. Here, in the event the main pulse MP application end timing has not been reached (S119: NO), the CPU 61 proceeds to S120.

At S120, the CPU 61 transfers the sub pulse data which is the target of transfer at this point to the head driving circuit 68 in one transfer only. At this time, the CPU 61 adjusts the applied pulse width WS of the sub pulse SP based on what was decided at S116 as described above. Thereafter, the CPU 61 returns to S119. Alternatively, in the event the main pulse MP application end timing has been reached (S119: YES), the CPU 61 proceeds to S121.

At S121, the CPU 61 ends application of the main pulse MP. Specifically, the CPU 61 causes the head driving circuit 68 to end application of the main pulse MP with respect to the heater element 41A which is the target of main heating. Thereafter, the CPU 61 proceeds to S122.

At S122, the CPU 61 judges whether printing has finished. Here, in the event printing has not finished (S122: NO), the CPU 61 returns to S112 and repeats the processes subsequent to S112. On the other hand, in the event printing has finished (S122: YES), the CPU 61 ends this program.

[1-5-1. Summary]

Specifically, in the tape printing apparatus 1 directed to the first embodiment, the sub pulse SP which supplements the main pulse MP to be applied in the next application period F is applied in the current application period F only in the event the next application period F, wherein the main pulse MP, which carries out main heating for melting or subliming the ink on the ink ribbon 33 is applied, starts immediately after the current application period F wherein the ink is not melted or sublimed on the ink ribbon 33, for each of the heater elements 41A constituting the line head 41B of the thermal head 41, based on the flow (A) through (G) as described above (auxiliary heating conditions) (refer to the lower level in FIG. 11 and FIG. 12 as described later). Accordingly, since the main pulse MP and the sub pulse SP to be applied with respect to one heater element 41A will never exist together in one application period F (refer to action (D) as described above), the application period F which is a fixed period can be shortened.

Further, a non-heating time G which shows a period of time when the main pulse MP and the sub pulse SP are not applied can be reliably secured even in the case the application period F which is a fixed period is shortened and the main pulse MP or the sub pulse SP is applied (refer to FIG. 12 through FIG. 15), so that heat accumulation which may have an adverse effect on printing quality can be prevented even in case of continuous printing. Thus, high speed printing is enabled by heat history control showing that energization correction has been newly performed with respect to the thermal head 41. Further, heat history control showing that energization correction has been newly performed with respect to the thermal head 41 is carried out simply by changing the application timing for each pulse in the respective application period F. This does not require upgrading the thermal head 41, which prevents cost increases.

Also, in the tape printing apparatus 1 according to the first embodiment, the sub pulse SP is applied in the current application period F, and immediately after that, the main pulse MP corresponding to this sub pulse SP is applied in the next application period F based on the actions (A) through (G) as described above (auxiliary heating conditions) (refer to the lower level in FIG. 12 through FIG. 15, and FIG. 1 through FIG. 4). This makes it possible to further shorten application period F which is a fixed period and further increase printing speed. Furthermore, auxiliary heating through the sub pulse SP can effectively compensate main heating through the main pulse MP.

In the tape printing apparatus 1 according to the first embodiment, when [thermal head printing line data] is created by the CPU 61 (S11, S41, S81, S111), the sub pulse SP application start point (ss) can be set independently from the main pulse MP application start point (ms). As a result, this decreases the number of constraints with respect to new energization correction relative to heat history control in the thermal head 41A and increases the degree of freedom in applying the disclosure.

In the tape printing apparatus 1 according to the first embodiment, of the plurality of heater elements 41A constituting the line head 41B of the thermal head 41, the first heater elements C to which the main pulse MP is applied and the second heater elements 41D to which the sub pulse SP is applied appear in a single application period F (refer to FIG. 12 through FIG. 15), specifically, they appear in the printing processes Q(N), Q(N+1), etc. of each one line as shown in FIG. 11. Shortening the applied pulse width WS of the sub pulse SP to be applied to the second heater elements 41E as compared to the applied pulse width WM of the main pulse SP to be applied to the first heater elements 41C makes it possible to secure an even larger amount of energy supplied by the main pulse MP within a single application period F (refer to FIG. 12 trough FIG. 15). In turn, this makes it possible to further shorten the application period F which is a fixed period without any adverse effect on the printing quality, further increasing printing speed.

In the tape printing apparatus 1 according to the first embodiment, of the plurality of heater elements 41A constituting the line head 41B of the thermal head 41, the first heater elements 41C to which the main pulse MP is applied and the second heater elements 41D to which the sub pulse SP is applied appear in a single application period F (refer to FIG. 12 through FIG. 15), specifically, in the printing processes Q(N), Q(N+1), etc. of each one line as shown in FIG. 11. However, as shown in FIG. 13, one portion of the main pulse MP which is applied to the first heater elements 41C (upper level in FIG. 13) and one portion of the sub pulse SP which is applied to the second heater elements 41E (lower level in FIG. 13) can overlap in one application period F, which means that an overlap time zone MS wherein the applied pulse width WM of the main pulse MP and the applied pulse width of the sub pulse SP overlap can exist. This makes it possible to further shorten the application period F which is a fixed period and as a result leads to further increase in printing speed.

In the tape printing apparatus 1 according to the first embodiment, with respect to the plurality of heater elements 41A constituting the line head 41B of the thermal head 41, the applied pulse width WM of the main pulse MP which is applied to the first heater element 41C or the applied pulse width WS of the sub pulse SP which is applied to the second heater elements 41D is changed based on the [temperature information] determined based on the detection temperature Z of the thermal head 41 detected by the thermistor 73 (S16, S18, S46, S48, S86, S88, S116 and S117). This makes it possible to adjust feedback control based on the detection temperature with respect to the new energization correction performed in heat history control of the thermal head 41, which leads to an improvement in printing quality.

In the tape printing device 1 according to the first embodiment, with respect to the plurality of heater elements 41A constituting the line head 41B of the thermal head 41, the applied pulse width WM of the main pulse MP which is applied to the first heater elements 41C or the applied pulse width WS of the sub pulse SP which is applied to the second heater elements 41D is changed in accordance with the total number n of first heater elements 41C to which the main pulse MP is applied (S17, S18, S47, S48, S87, S88, S116 and S117). However, as the total number n of first heater elements 41C to which the main pulse MP is applied becomes the source for the temperature information, it becomes possible to adjust feed back control based on the temperature information source with respect to the new energization correction performed in the heat history control of the thermal head 41, which leads to an improvement in printing quality.

In the tape printing apparatus 1 according to the first embodiment, with respect to the plurality of heater elements 41A constituting the line head 41B of the thermal head 41, the first heater elements 41C to which the main pulse MP is applied and the second heater elements 41D to which the sub pulse SP is applied appear in a single application period F (refer to FIG. 12 through FIG. 15), specifically, they appear in the printing processes Q(N), Q(N+1), etc. of each one line as shown in FIG. 11. However, when the time difference between the application end point (me) of the main pulse MP which is applied to the first heater elements 41C and the application start point (ss) of the sub pulse SP which is applied to the second heater elements 41D is shorter as compared to the transfer time Z of the print pattern data required for selectively causing each of the heater elements 41A constituting the line head 41B of the thermal head 41 to generate heat, the second drive control of the thermal head 41 as shown in FIG. 2 is used to make the application start point (ss) for the sub pulse SP which is applied to the second heater elements 41D coincide with the application end point (me) for the main pulse MP which is applied to the first heater elements 41C. This makes it possible to eliminate one transfer of print pattern data ([OR data] of the main pulse data and sub pulse data) in one application period F, which makes it possible to further shorten the application period F which is a fixed period, leading to a further increase in printing speed.

In the tape printing apparatus 1 according to the first embodiment, with respect to the plurality of heater elements 41A constituting the line head 41B of the thermal head 41, the first heater elements 41C to which the main pulse MP is applied and the second heater elements 41D to which the sub pulse SP is applied appear in a single application period F (refer to FIG. 12 through FIG. 15), specifically, they appear in the printing processes Q(N), Q(N+1), etc. of each one line as shown in FIG. 11. However, when the time difference between the application end point (me) of the main pulse MP to be applied to the first heater elements 41C and the application start point (ss) of the sub pulse SP to be applied to the second heater elements 41D is shorter than the transfer time Z of the applied pattern data required for selectively heating the respective heater elements 41A constituting the line head 41B of the thermal head 41, the third drive control of the thermal head 41 as shown in FIG. 3 is used to make the application end point (me) of the main pulse MP which is applied to the first heater element 41C coincide with the application start point (ss) of the sub pulse SP which is applied to the second heater element 41D. This makes it possible to eliminate one transfer of print pattern data ([OR data] of the main pulse data and sub pulse data) in one application period F, which makes it possible to further shorten the application period F which is a fixed period, leading to further increase in printing speed.

[1-5-2. Summary]

In the tape printing apparatus 1 according to the first embodiment, with respect to the plurality of heater elements 41A constituting the line head 41B of the thermal head 41, the applied pulse width WS of the sub pulse SP which is applied to the second heater elements 41D is changed in accordance with the fourth drive control of the thermal head 41 as shown in FIG. 4, based on environmental data such as the detection temperature Z of the thermal head 41 and the total number n of heated dots in one line, and the like. This makes it possible to adjust feedback control based on the detected environmental data with respect to new energization correction performed in heat history control of the thermal head 41, which leads to an improvement in printing quality.

Environmental data may include applied voltage with respect to the thermal head 41.

Further, in the tape printing apparatus 1 according to the first embodiment, the applied pulse width WS of the sub pulse SP which is applied to the second heater elements 41D is changed in accordance with the fourth drive control of the thermal head 41 as shown in FIG. 4 based on environmental data such as the detection temperature Z of the thermal head 41 and the total number n of heated dots in one line, and the like. Further, the ratio of the respective applied pulse widths WR and WC of the rectangular pulse RP and the chopping pulse CP constituting the main pulse MP to be applied to the first heater elements 41C is changed (refer to S116 and FIG. 5 and FIG. 15) in accordance with the above change in the applied pulse width WS. This makes it possible to adjust chopper drive control with respect to new energization correction performed in heat history control of the thermal head 41, which leads to an improvement in printing quality.

[1-6-1. Other]

The disclosure is not limited to the above-described first embodiment, and various modifications can be made thereto without departing from the scope of the present disclosure.

For instance, in the tape printing apparatus 1 according to the first embodiment, with respect to the plurality of heater elements 41A constituting the line head 41B of the thermal head 41, the first heater elements 41C to which the main pulse MP is applied and the second heater elements 41D to which the sub pulse SP is applied appear in a single application period F (refer to FIG. 12 through FIG. 15), specifically, they appear in the printing processes Q(N), Q(N+1), etc. of each one line as shown in FIG. 11. However, irrespective of whether the time difference between the application end point (me) of the main pulse MP to be applied to the first heater elements 41C and the application start point (ss) of the sub pulse SP to be applied to the second heater elements 41D is shorter than the transfer time Z of the applied pattern data required for selectively heating the respective heater elements 41A constituting the line head 41B of the thermal head 41, if the application start point (ss) of the sub pulse SP which is applied to the second heater elements 41D is made to coincide with application end point (me) of the main pulse MP which is applied to the first heater elements 41C, or on the contrary, if the application end point (me) of the main pulse MP which is applied to the first heater elements 41C is made to coincide with the application start point (ss) of the sub pulse SP which is applied to the second heater elements 41D, this makes it possible to eliminate one transfer of print pattern data ([OR data] of the main pulse data and sub pulse data) in one application period F (refer to FIG. 2 and FIG. 3). This in turn makes it possible to further shorten the application period F which is a fixed period, leading to further increase in printing speed.

[1-6-2. Other]

In the tape printing apparatus 1 according to the first embodiment, the application period F which is a fixed period can be further shortened even if, unlike the lower level in FIG. 12, the sub pulse SP is applied in the current application period F and the main pulse MP corresponding to this sub pulse SP is applied in the next application period F which does not immediately follow the current application period F. This helps further increase printing speed.

[1-6-3. Other]

In the first embodiment, the tape printing apparatus 1 was described as a [printing apparatus], however, the disclosure can also be applied to various types of thermal printers that are provided with a thermal head 41. In case of a thermal printer using thermal paper as a printing medium, main heating refers to supplying energy capable of causing the thermal paper which is used as printing medium to develop color, whereas auxiliary heating refers to supplying energy which independently, cannot cause the thermal paper used as printing medium to develop color, but, together with main heating, can cause the thermal paper which is used as printing medium to develop color.

[2-1. Summary of the Disclosure]

Hereinafter, a second embodiment of the present disclosure will be described while referring to the drawings. This is exactly the same as the tape printing apparatus 1. The respective heater elements 41A as shown in FIG. 19 differ from the ones shown in FIG. 8 (in the case of the first embodiment) and are shown as ○.

Figure 19:
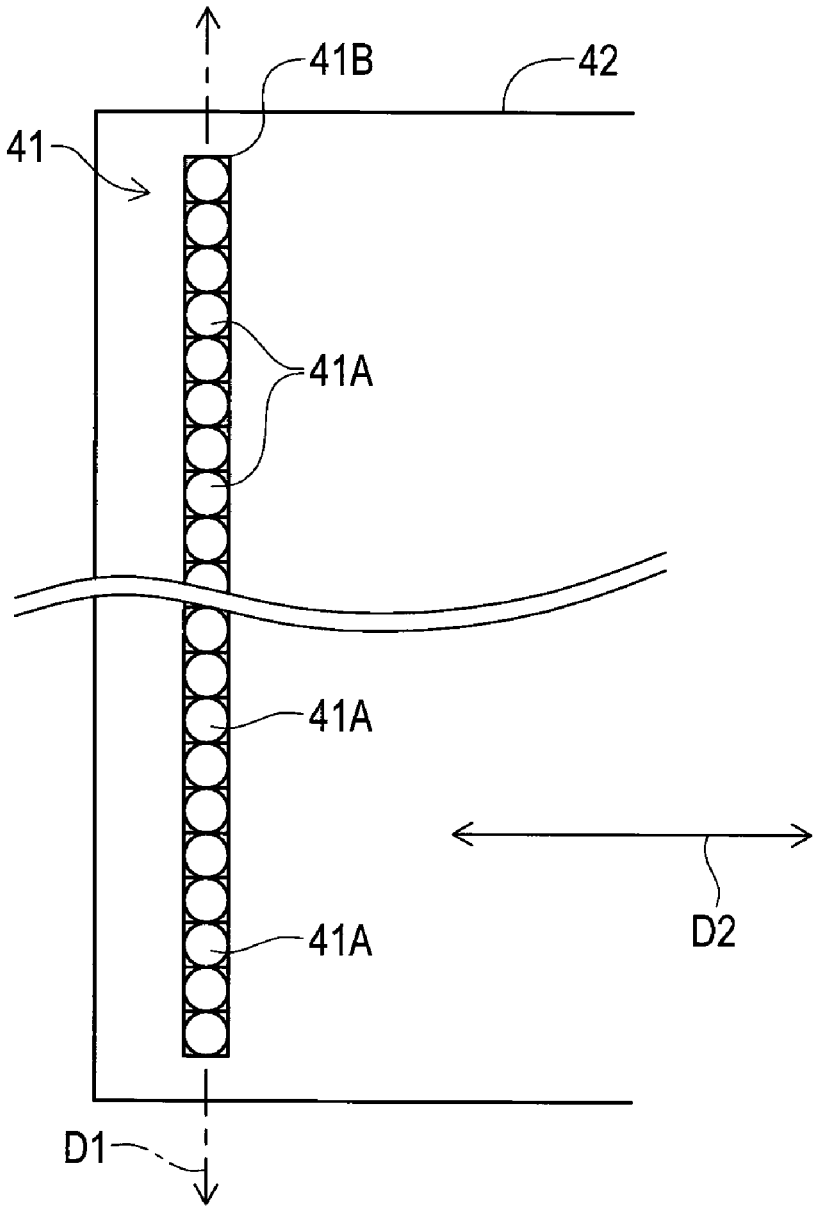
FIG. 19 is an enlarged diagram of the thermal head of the tape printing apparatus.

As shown in FIG. 19, a thermal head 41 is comprised of a line head 41B and the like which includes a plurality (for instance, 1024 or 2048 elements) of heater elements 41A which are arranged in one row. The direction in which the heater elements 41A are arranged in one row is the "main scanning direction D1 of the thermal head 41". With respect to this, a direction which is perpendicular to the "main scanning direction D1 of the thermal head 41" is a "sub-scanning direction D2 of the thermal head 41". Symbol 42 represents a plate on which the thermal head 41 is arranged.

Figure 24:
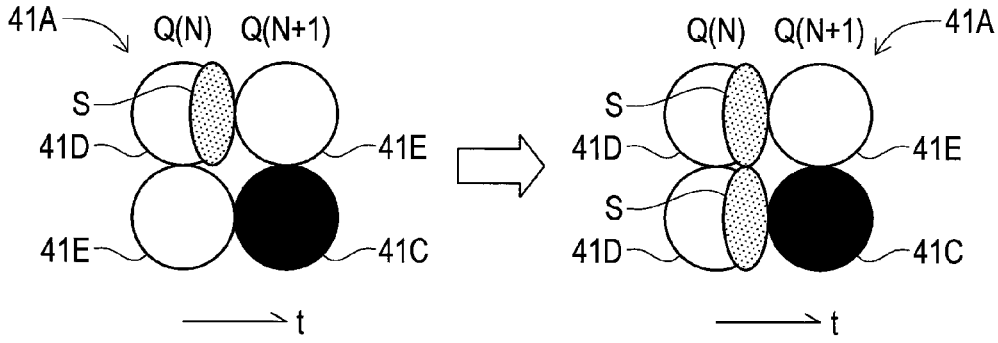
FIG. 24 is a diagram for illustrating condition to carry out auxiliary heating for the thermal head of the tape printing apparatus.
Figure 25:
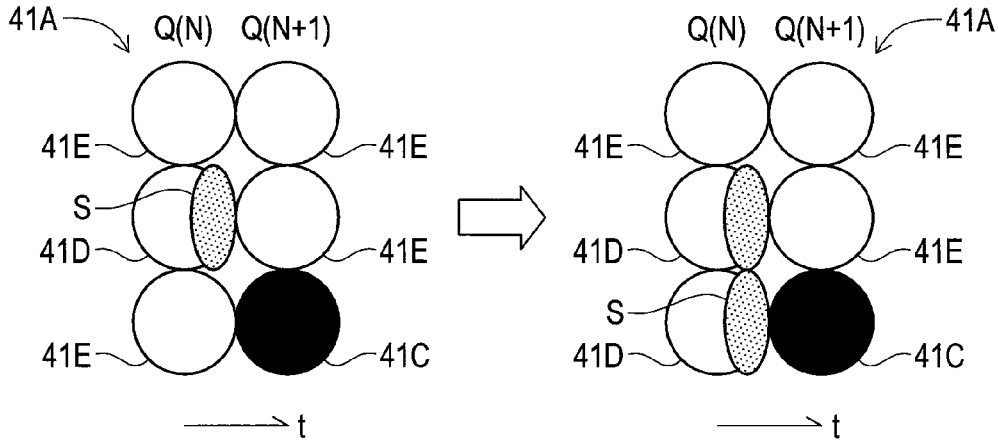
FIG. 25 is a diagram for illustrating condition to carry out auxiliary heating for the thermal head of the tape printing apparatus.
Figure 26:
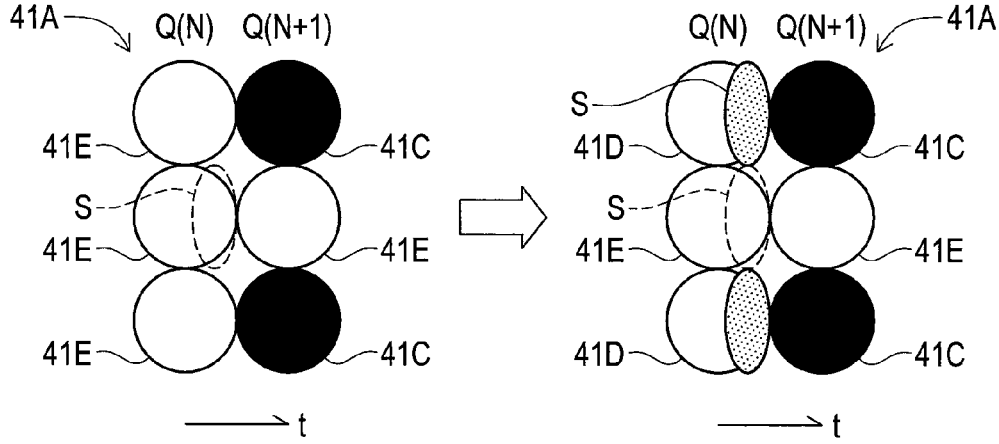
FIG. 26 is a diagram for illustrating condition to carry out auxiliary heating for the thermal head of the tape printing apparatus.

In the second embodiment, once the thermal head 41 is driven and the line head 41B executes a printing process for each one line, the plurality of heater elements 41A constituting the line head 41B enter one of the following drive states (1) through (3), as shown in FIG. 24 through FIG. 26.

(1) a first heater element 41C which has undergone main heating;

(2) a second heater element 41D which has undergone auxiliary heating;

(3) a third heater element 41E which is not driven (has not undergone main heating or auxiliary heating).

In FIG. 24 through FIG. 26, the horizontal axis shows time, while the vertical axis shows the [main scanning direction D1 of the thermal head 41]. Accordingly, the passage of time is shown in the direction from left to right, and a portion of one line which is undergoing printing is shown as one row in the vertical direction. The elliptical shape S on the second heater element 41D shows an image of auxiliary heating. When the image S of the auxiliary heating is adjacent to the one line on the right side, this means that auxiliary heating is performed immediately prior to the printing process for the next line. These points are the same in FIG. 20 through FIG. 23 as will be described later.

Main heating refers to supplying energy which enables the printing medium to develop color. As will be described later, the tape printing apparatus according to the second embodiment uses an ink ribbon, and energy is supplied to the heater elements 41A which are subject to main heating and enter the drive state of the first heater element 41C to allow the ink on the ink ribbon to melt or sublimate.

Auxiliary heating refers to supplying energy which independently cannot cause the printing medium to develop color, but which, together with main heating, can cause the printing medium to develop color. As will be described later, the tape printing apparatus according to the second embodiment uses an ink ribbon, and enough energy is not supplied to the heater elements 41A which undergo auxiliary heating and enter the drive state of the second heater element 41D to allow the ink on the ink ribbon to melt or sublimate.

Here, auxiliary heating is limited to satisfying conditions (α)+(β) as shown in FIG. 24 and FIG. 25. Specifically, with respect to the heater elements which are targets of auxiliary heating in the printing process Q(N) of a current one line, the respective heater elements 41A constituting the line head 41B of the thermal head 41 include:

(α) heater elements which are adjacent to elements which are subject to main heating in the printing process Q(N) of the next one line and enter the drive state of the first heater element 41C and are not subject to main heating in the printing process Q(N+1) of the next one line or in the printing process Q(N) of the current one line.

(β) elements which are subject to main heating in the printing process Q(N+1) of the next one line and enter the drive state of the first heater element 41C, but are not subject to main heating in the printing process Q(N) of the current one line.

The left side in FIG. 24 and the left side in FIG. 25 show one example of condition (α). The right side in FIG. 24 and the right side in FIG. 25 show one example of conditions (α)+(β).

Auxiliary heating is subject to condition (γ) as shown in FIG. 26. Specifically, elements which are subject to auxiliary heating in the printing process Q(N) of the current one line are subject to the following condition (γ) even if they satisfy condition (α).

(γ) Heater elements which are adjacent, on both sides, to heater elements that are subject to main heating in the printing process Q(N+1) of the next one line and enter the drive state of the first heater elements 41C are not subject to auxiliary heating unless they are subject to main heating in the printing process Q(N+1) of the next one line and in the printing process (Q)N of the current one line alike.

The left side in FIG. 26 shows one example of condition (γ). The right side in FIG. 26 shows one example of condition (β)+(γ). Images S for auxiliary heating which are shown by a dotted line on both sides in FIG. 26 are elements which are subject to auxiliary heating in accordance with condition (α), but are not subject to auxiliary heating in accordance with condition (γ).

Figure 20:
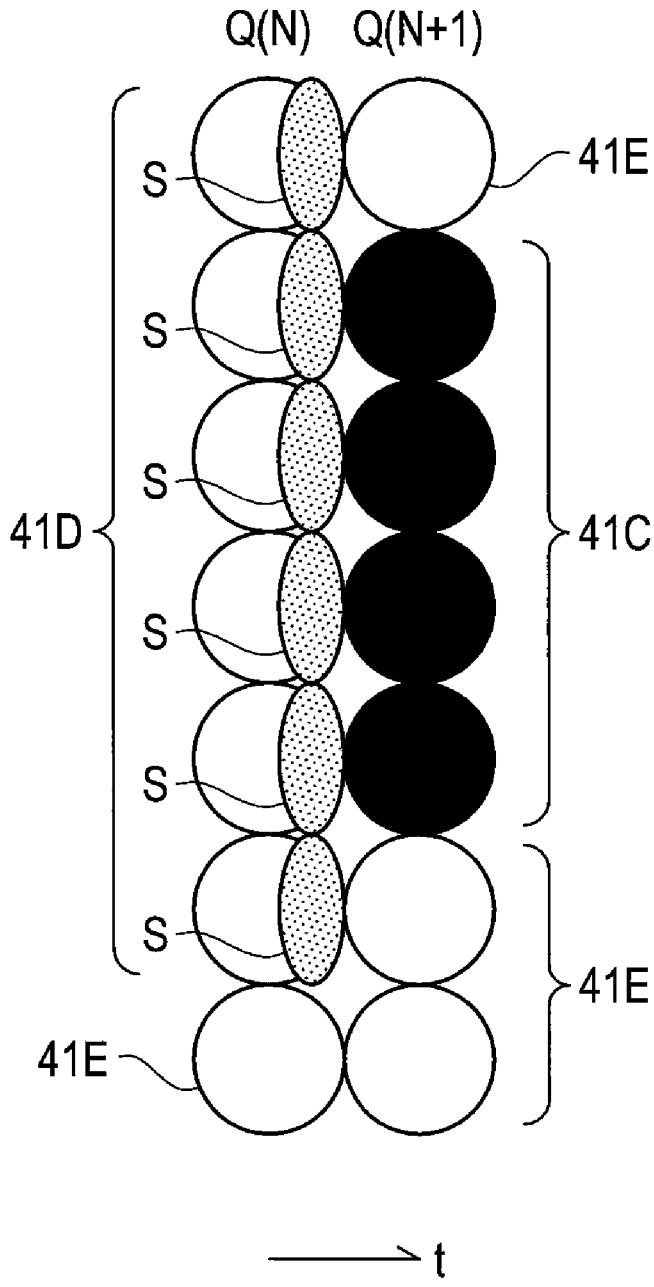
FIG. 20 shows an example showing two lines of printing that reflects condition of $(\alpha)+(\beta)$.

In the case shown in FIG. 20 (example of printing 2 lines satisfying conditions (α)+(β)), elements which are subject to main heating in the printing process Q(N+1) of the next one line and enter the drive state of the first heater elements 41C are successively arranged in a group of 4 in the main scanning direction, forming a vertical printing line which includes 4 printing dots arranged in a vertical direction on the printing medium, without the so-called print fading effect. With respect to the elements which are subject to auxiliary heating in the printing process Q(N) of the current one line and enter the drive state of the second heater element 41D, auxiliary heating of the elements at the upper end and lower end which are in the drive state of the second heater element 41D may be said to act so as to prevent loss of applied energy from both sides of the 4 elements which have been subject to heating in the printing process Q(N+1) of the next line and therefore are in the drive state of the first heater element 41C.

Figure 21:
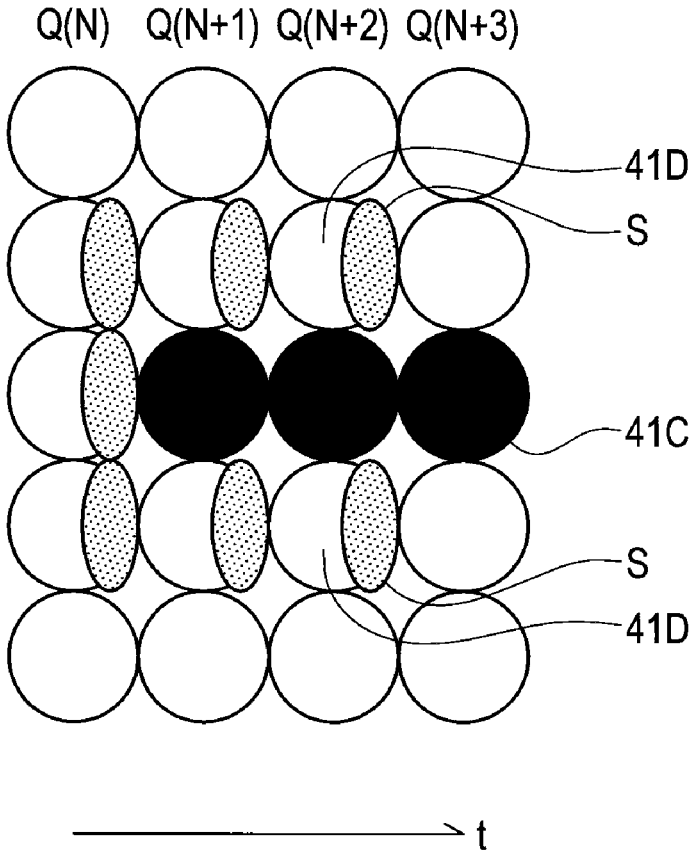
FIG. 21 shows an example showing four lines of printing that reflects the condition of $(\alpha)+(\beta)$.

In the case shown in FIG. 21 (an example of a 4-line printing process satisfying the (α)+(β) conditions), in the three one-line printing processes Q(N+1) (N+2) (N+3), respectively, heater elements which are subject to main heating and enter the drive state of the first heater element 41C are successively arranged in a group of three in the sub-scanning direction of the thermal head, thus forming a horizontal printing line which includes three printing dots arranged transversely on the printing medium, without the so-called print fading effect. Here, auxiliary heating for the elements which enter the drive state of the second heater element 41D in the printing process Q(N+2) of one line may be said to act so as to prevent loss of applied energy from both sides of the heater elements which are in the drive state of the first heater element 41C in the printing process Q(N+3) of the next one line. The same can be said with respect to the 3 one-line printing processes Q(N) (N+1) (N+2).

Figure 22:
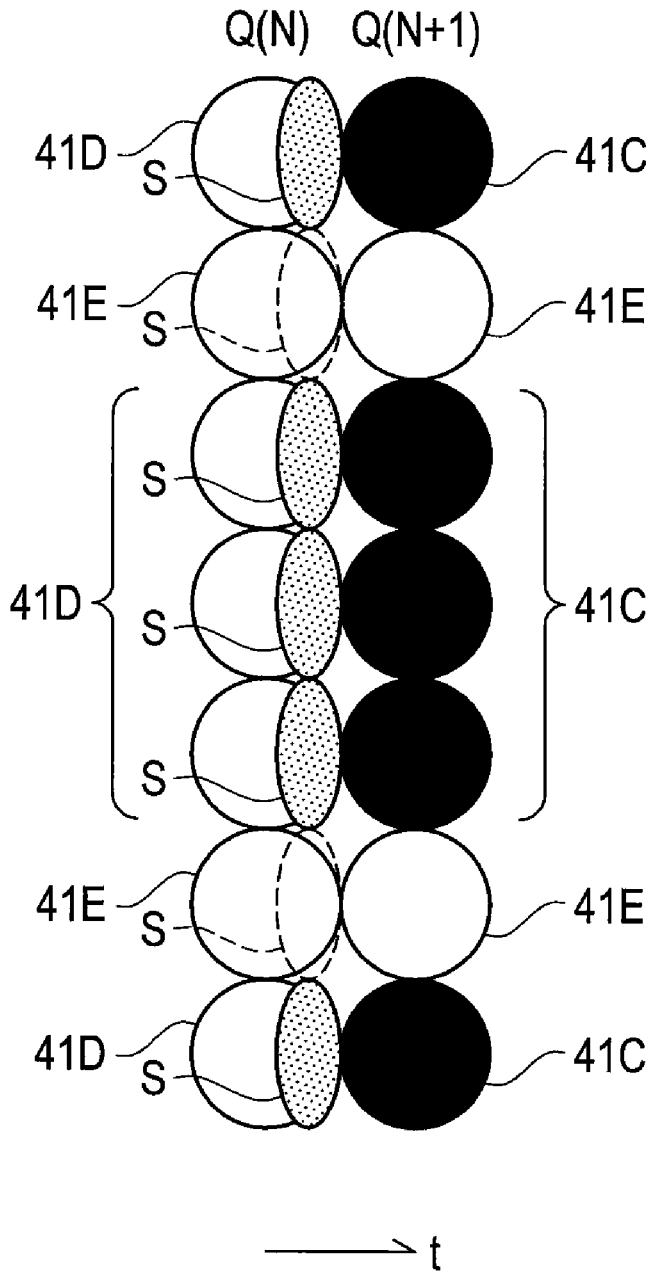
FIG. 22 shows an example showing two lines of printing that reflects condition of $(\gamma)+(\beta)$.

In the case shown in FIG. 22 (an example of a 2-line printing process satisfying the (γ)+(β) conditions), in the printing process Q(N+1) of the next one line, heater elements which are subject to main heating and enter the drive state of the first heater elements 41C are successively arranged in groups of three in the main scanning direction of the thermal head, and furthermore, heater elements which are subject to main heating and enter the drive state of the first heater element 41C are isolated at both ends in the main scanning direction of the thermal head, thus forming, on the printing medium, a vertical printing line which includes three printing dots arranged vertically and one printing dot arranged in an isolated fashion at both ends of that printing line, without triggering the so-called print fading effect. In the printing process Q(N) of the current one line, the third heater elements 41E, which have heater elements that are subject to main heating and enter the drive state of the first heater element 41C in the printing process Q(N+1) of the next one line arranged at both sides thereof, are subject to auxiliary heating and enter the drive state of the second heater element 41D in accordance with condition (α), however, are not driven (are not subject to either auxiliary heating or main heating) in accordance with condition (γ) and therefore remain in the state of the third heater element 41E. One portion of the applied energy of the main pulse MP, which energy flows from two first heater elements 41C which are arranged at both sides of heater elements which are subject to main heating in the printing process Q(N+1) of the next one line and enter the drive state of the first heater element 41C, is supplied to these third heater elements 41E, respectively. This action has the role of slowing down the flow of applied energy of the main pulse MP which flows from the above-mentioned two first heater elements 41C. As a result, it can be said that application of the sub pulse SP for auxiliary heating could be eliminated in the printing process Q(N) of the current one line.

Figure 23:
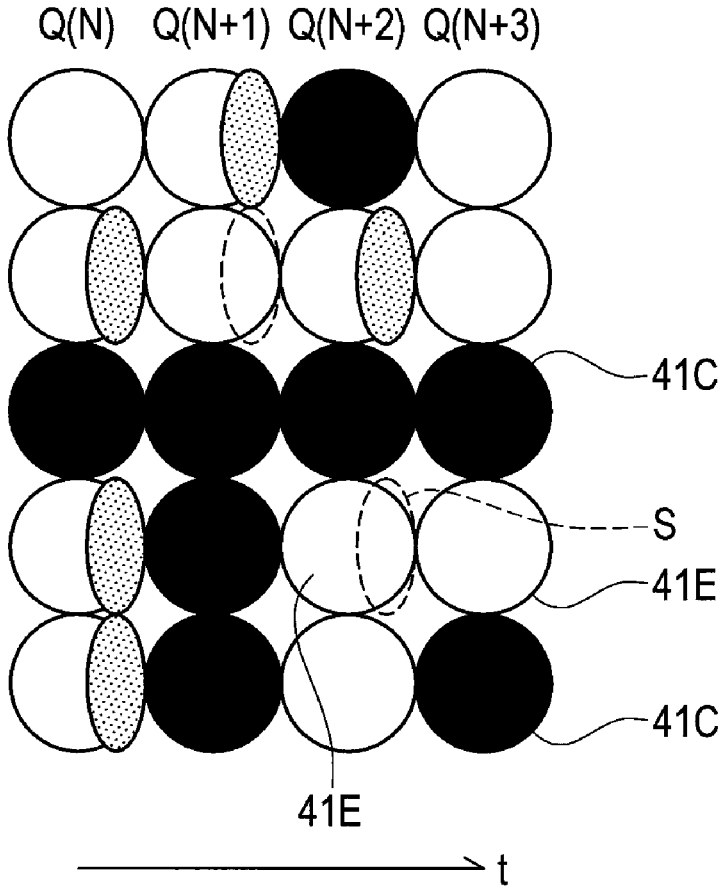
FIG. 23 shows an example showing four lines of printing that reflects the condition of $(\gamma)+(\beta)$.

In the case shown in FIG. 23 (an example of a 4-line printing process satisfying the (γ)+(β) conditions), in the four one-line printing processes Q(N) (N+1) (N+2) (N+3), heater elements which are subject to main heating and enter the drive state of the first heater element 41C are successively arranged in groups of four in the sub-scanning direction of the thermal head, thus forming, on the printing medium, a horizontal printing line including four printing dots arranged horizontally, without triggering the so-called [print fading effect]. Further, in the 2 one-line printing processes Q(N+2) (N+3), heater elements which are subject to main heating and enter the drive state of the first heater element 41C are isolated at the upper end or lower end in the main scanning direction of the thermal head, thus forming, on the printing medium, two isolated printing dots without triggering the so-called [print fading effect]. In the printing process Q(N+2) of the previous one line, the third heater elements 41E, which have heater elements that are subject to main heating and enter the drive state of the first heater element 41C in the printing process Q(N+3) of one line arranged at both sides thereof, are subject to auxiliary heating and enter the drive state of the second heater element 41D in accordance with condition (α), however, are not driven (are not subject to either auxiliary heating or main heating) in accordance with condition (γ) and therefore remain in the state of the third heater element 41E. One portion of the applied energy of the main pulse MP, which energy flows from two first heater elements 41C which are arranged at both sides of heater elements which are subject to main heating in the printing process Q(N+3) of the next one line and enter the drive state of the first heater element 41C, is respectively supplied to these third heater elements 41E. This action has the role of slowing down the flow of applied energy of the main pulse MP which flows from the above-mentioned two first heater elements 41C. As a result, it can be said that application of the sub pulse SP for auxiliary heating could be eliminated in the printing process Q(N+2) of the previous one line. The similar can be said about the two one-line printing processes Q(N+1) (N+2).

Figure 27:
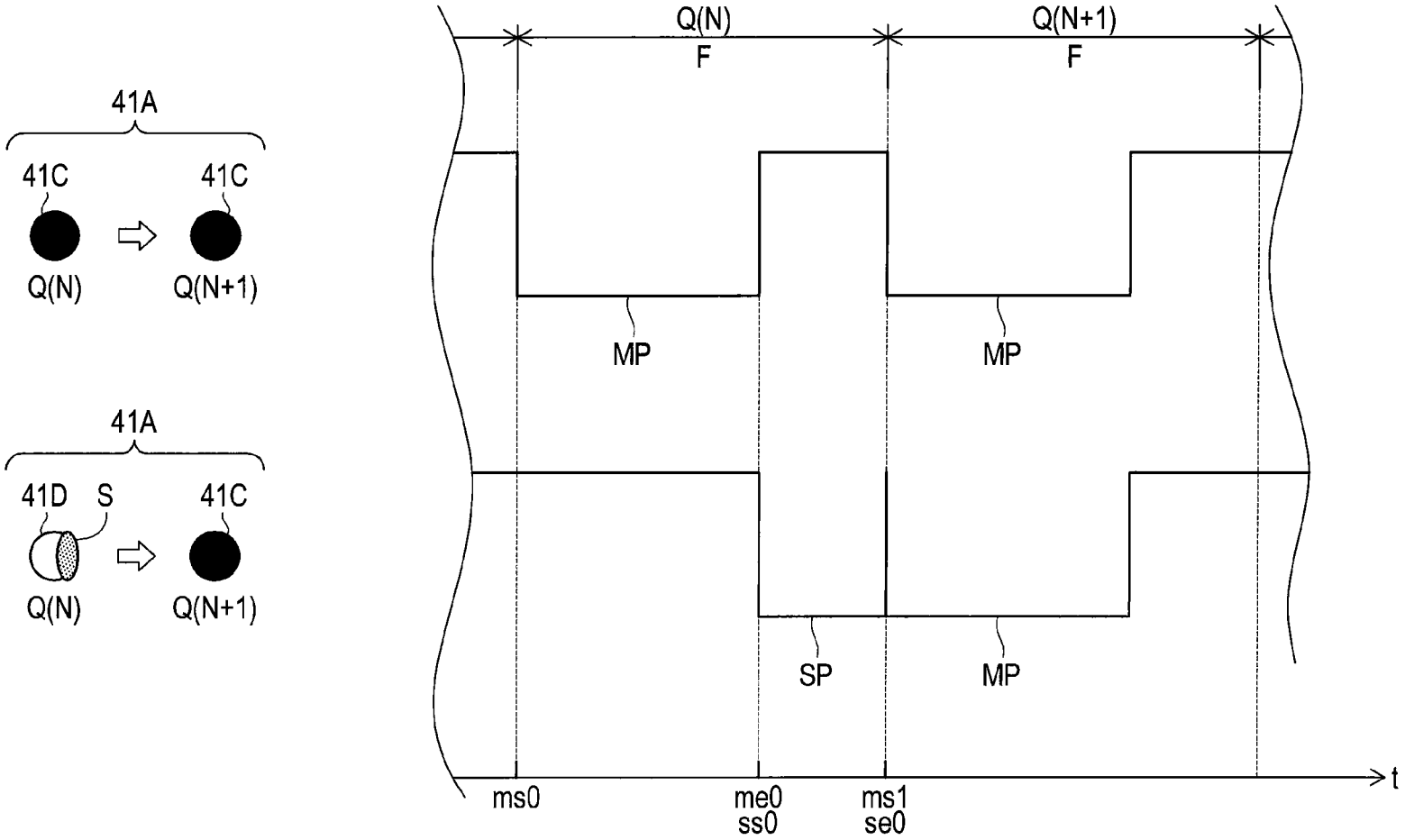
FIG. 27 is a diagram for illustrating heat history control of main heating and auxiliary heating for the thermal head of the tape printing apparatus from the viewpoint of pulse-application control to each heater element that constitutes the line head of the thermal head.
Figure 28:
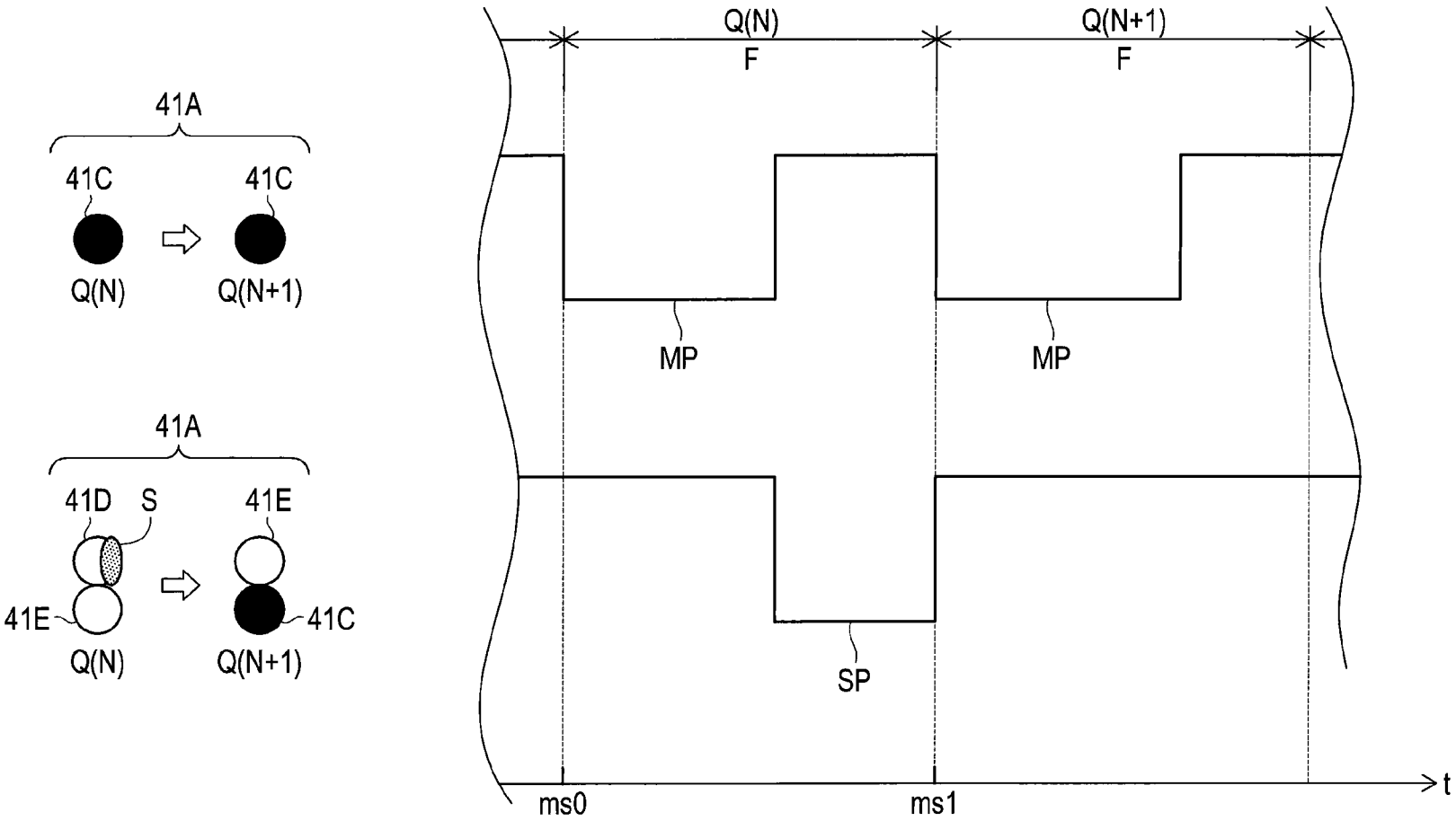
FIG. 28 is a diagram for illustrating heat history control of main heating and auxiliary heating for the thermal head of the tape printing apparatus from the viewpoint of pulse-application control to each heater element that constitutes the line head of the thermal head.

Next, heat history control for main heating and auxiliary heating (drive control of thermal head 41) will now be described from the point of view of controlling pulse application to each of the heater elements 41A constituting the line head 41B of the thermal head 41, using FIG. 27 and FIG. 28. In FIG. 27 and FIG. 28, the horizontal axis represents time, while the vertical axis represents the voltage value or the current value of the applied pulse. The passage of time is shown from left to right, while the applied pulse is shown as low/active.

As shown at the upper levels in FIG. 27 and FIG. 28, the heater elements 41A constituting the line head 41B in the thermal head 41 include heater elements 41A which undergo main heating both in the printing process Q(N) of the current one line and in the printing process Q(N+1) of the next one line, and enter the drive state of the first heater element 41C. With respect to such elements, the main pulse MP is applied in the printing process Q(N) of the current one line and another main pulse MP is applied in the printing process Q(N+1) of the next one line. More specifically, main heating is carried out by applying a main pulse MP to the heater elements 41A and energy is then supplied to enable the printing medium to develop color, causing these heater elements 41A to enter the drive state of the first heater element 41C.

Here, as shown at the upper levels in FIG. 27 and FIG. 28, application period F as used with respect to one heater element 41A defines the period of time ranging from the main heating start point ms0, which shows when application of the main pulse MP starts in the printing process Q(N) of the current one line, until the main heating start point ms1, which shows when application of the main pulse MP starts in the printing process Q(N+1) of the next one line. Application period F is a fixed period of time and coincides with the time required for the printing processes such as . . . Q(N), Q(N+1) . . . of each one line. This application period F is successively repeated in the printing operation.

On the one hand, as shown at the lower level in FIG. 27, the heater elements 41A constituting line head 41B in the thermal head 41 include heater elements 41A which undergo auxiliary heating in the printing process Q(N) of the current one line and enter the drive state of the second heater element 41D, and also undergo main heating in the printing process Q(N+1) of the next one line and enter the drive state of the first heater element 41C, namely, heater elements 41 satisfying the condition (β). With respect to these heater elements 41A, a sub-pulse SP is applied in the printing process Q(N) of the current one line and, furthermore, a main pulse MP is also applied in the printing process Q(N+1) of the next one line. The sub-pulse SP is applied with respect to the heater elements 41A to carry out auxiliary heating. The sub-pulse SP alone cannot cause the printing medium to develop color, however, when applied to the heater elements 41A together with the main pulse MP, which is applied in the printing process Q(N+1) of the next one line (more specifically, the next application period F) for main heating, causing the heater elements 41A to enter the drive state of the second heater element 41D. This energy which is supplied to the heater elements 41A can cause the printing medium to develop color.

Here, with respect to the sub-pulse SP, the auxiliary heating end point which shows when application of the sub-pulse ends coincides with the end of the current application period F (specifically, the start point of the next application period F). In the example shown at the lower level in FIG. 27, the auxiliary heating end point se0 showing when application of the sub-pulse SP ends in the printing process Q(N) of the current one line coincides with the end of the application period F corresponding to the printing process Q(N) of the current one line (more specifically, the start point of the next application period F). As per the definition of the application period F as described above, the auxiliary heating end point se0 showing when application of the sub-pulse SP ends in the printing process Q(N) of the current one line coincides with the main heating start point ms1 showing when application of the main pulse MP starts in the printing process Q(N+1) of the next one line.

For convenience of description, in the example shown at the lower level in FIG. 27, although application of the sub pulse SP and the main pulse MP happens in a successive fashion, a momentary non-drive state happens between the application of the sub pulse SP and the application of the main pulse MP. However, in the event the sub pulse SP and the main pulse MP are applied in a successive fashion, a transition is made from the drive state of the sub pulse SP to the drive state of the main pulse MP while the low/active state is maintained. This is the same for FIG. 29 and FIG. 30 to be described later.

As shown at the lower level in FIG. 28, of the respective heater elements 41A constituting the line head 41B of the thermal head 41, in the printing process Q(N) of the current one line, the sub pulse SP is applied with respect to heater elements which are adjacent to heater elements that are subject to main heating and enter the drive state of the first heater element 41C in the printing process Q(N+1) of the next one line and are not subject to main heating either in the printing process Q(N+1) of the next one line or the printing process Q(N) of the current one line (specifically, the heater elements 41A which satisfy the above-described condition (α)), while in the printing process Q(N+1) of the next one line, neither the main pulse MP or the sub pulse SP are applied. The sub pulse SP is applied to the heater elements 41A for auxiliary heating but cannot cause the printing medium to develop color by itself. However, when the sub pulse SP is applied together with the main pulse MP which is applied in the printing process Q(N+1) of the next one line (specifically, the next application period F) for main heating, the printing medium is caused to develop color. When energy capable of causing the printing medium to develop color is supplied to the heater elements 41A adjacent to the above-described heater elements 41A, the above-described heater elements 41*a* are caused to enter the drive state of the second heater elements 41D.

Determination of drive control of the thermal head 41 which is carried out in the first embodiment as seen from the point of view of pulse application control is as shown in the following steps (A) through (H).

(A) The application period F represents a fixed period of time with respect to one heater element 41A and ranges from the main heating start point ms0 showing when application of the main pulse MP starts in the printing process Q(N) of the current one line up to the main heating start point ms1 showing when application of the main pulse MP starts in the printing process Q(N+1) of the next one line.

(B) The application period F is successively repeated during printing.

(C) The main heating start point showing when application of the main pulse MP starts always coincides with the start point of the application period F.

(D) The auxiliary heating end point showing when application of the sub-pulse SP ends coincides with the end point of the application period F.

(E) The sub-pulse SP which is applied in the current application period F and the main pulse MP which is applied in the next application period F are applied successively.

(F) The main pulse MP and the sub-pulse SP cannot be applied together with respect to one and the same heater element 41A within the same application period F.

(G) When the main pulse MP is applied to certain heater elements 41A and the sub-pulse SP is applied to other heater elements 41A, these pulses may exist together in one application period F.

(H) Even if the main pulse MP is not applied to certain heater elements 41A, the sub-pulse SP may be applied in the current application period F with respect to one and the same heater element 41A.

Further, with respect to drive control of the thermal head 41 as carried out in the second embodiment, an applied pulse width WM of the main pulse MP and an applied pulse width WS of the sub-pulse SP can be changed for each heater element 41A constituting the line head 41B of the thermal head 41. The pulse width may be changed based on the total number n of heater elements 41A to which the main pulse MP is to be applied (more specifically, first heater element 41C) within the application period F wherein the change takes place, and environmental data with respect to the temperature and voltage of the thermal head 41 within the application period F wherein the change takes place. Alternatively, the process of changing the pulse width does not necessarily have to be based on the above parameters.

The time frame in each application period F when the main pulse MP with the applied pulse width WM and the sub-pulse SP with the applied pulse width WS do not exist is employed as the non-heated time G for cooling the heater elements 41A.

In FIG. 27, in the application period F corresponding to the printing process Q(N) of the current one line, the main heating end point me0 showing when application of the main pulse MP ends as shown at an upper level in FIG. 27 coincides with the auxiliary heating start point ss0 showing when application of the sub-pulse SP starts as shown at a lower level in FIG. 27. However the applied pulse width WM of the main pulse MP and the applied pulse width WS of the sub-pulse SP can be changed as described above in the drive control of the thermal head 41 as carried out in the second embodiment. More specifically, in the example shown in FIG. 29, the main heating end point me0 showing when application of the main pulse MP ends as shown at an upper level in FIG. 29 and the auxiliary heating start point ss0 showing when application of the sub-pulse SP starts as shown at a lower level in FIG. 29 can be changed.

Figure 29:
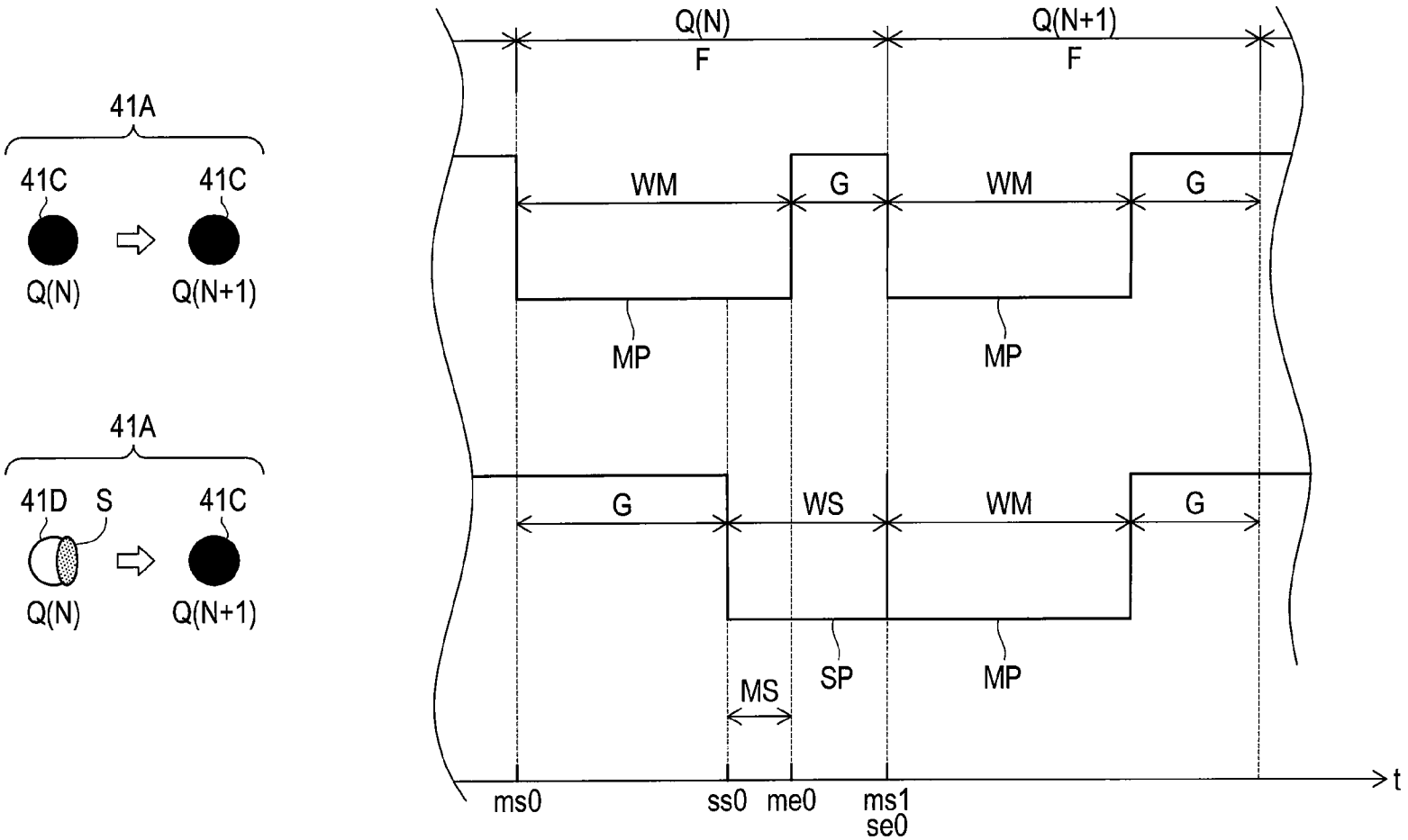
FIG. 29 is a diagram for illustrating heat history control of main heating and auxiliary heating for the thermal head of the tape printing apparatus from the viewpoint of pulse-application control to each heater element that constitutes the line head of the thermal head.

Accordingly, as shown in FIG. 29, the auxiliary heating start point ss0 showing when application of the sub-pulse SP starts as shown at a lower level in FIG. 29 occurs prior to the main heating end point me0 showing when application of the main pulse MP ends as shown at an upper level in FIG. 29, and this may result in an overlap time zone MS wherein the applied pulse width WM of the main pulse MP and the applied pulse width WS of the sub-pulse SP overlap.

Figure 30:
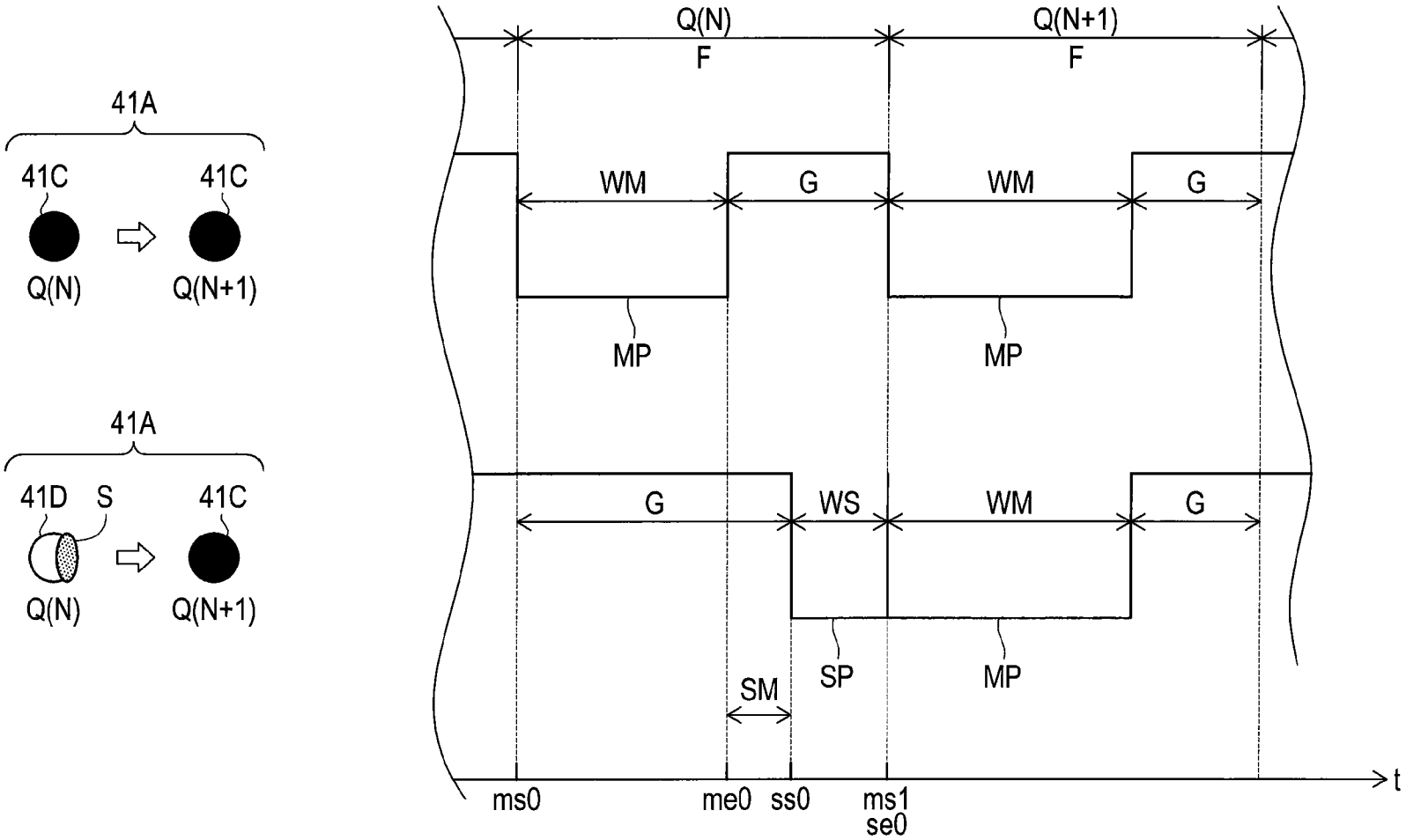
FIG. 30 is a diagram for illustrating heat history control of main heating and auxiliary heating for the thermal head of the tape printing apparatus from the viewpoint of pulse-application control to each heater element that constitutes the line head of the thermal head.

Conversely, as shown in FIG. 30, the auxiliary heating start point ss0 showing when application of the sub-pulse SP starts as shown at a lower level in FIG. 30 occurs subsequent to the main heating end point me0 showing when application of the main pulse MP ends as shown at an upper level in FIG. 30, and this may result in a separation time zone SM wherein the applied pulse width WM of the main pulse MP and the applied pulse width WS of the sub-pulse SP are separated.

[2-2. External Configuration of the Disclosure]

A schematic configuration of the tape printing apparatus 1 directed to the second embodiment is similar to that of the tape printing apparatus 1 directed to the first embodiment.

[2-3. Internal Configuration of the Disclosure]

Control configuration of the tape printing apparatus 1 directed to the second embodiment is similar to that of the tape printing apparatus 1 directed to the first embodiment.

[2-4-1. First Operation of the Disclosure]

Next, first drive control of the thermal head 41 in the tape printing apparatus 1 will be described. The control program shown in the flow chart of FIG. 16 is stored in the ROM 64 or the like and is executed by the CPU 61.

Figure 16:
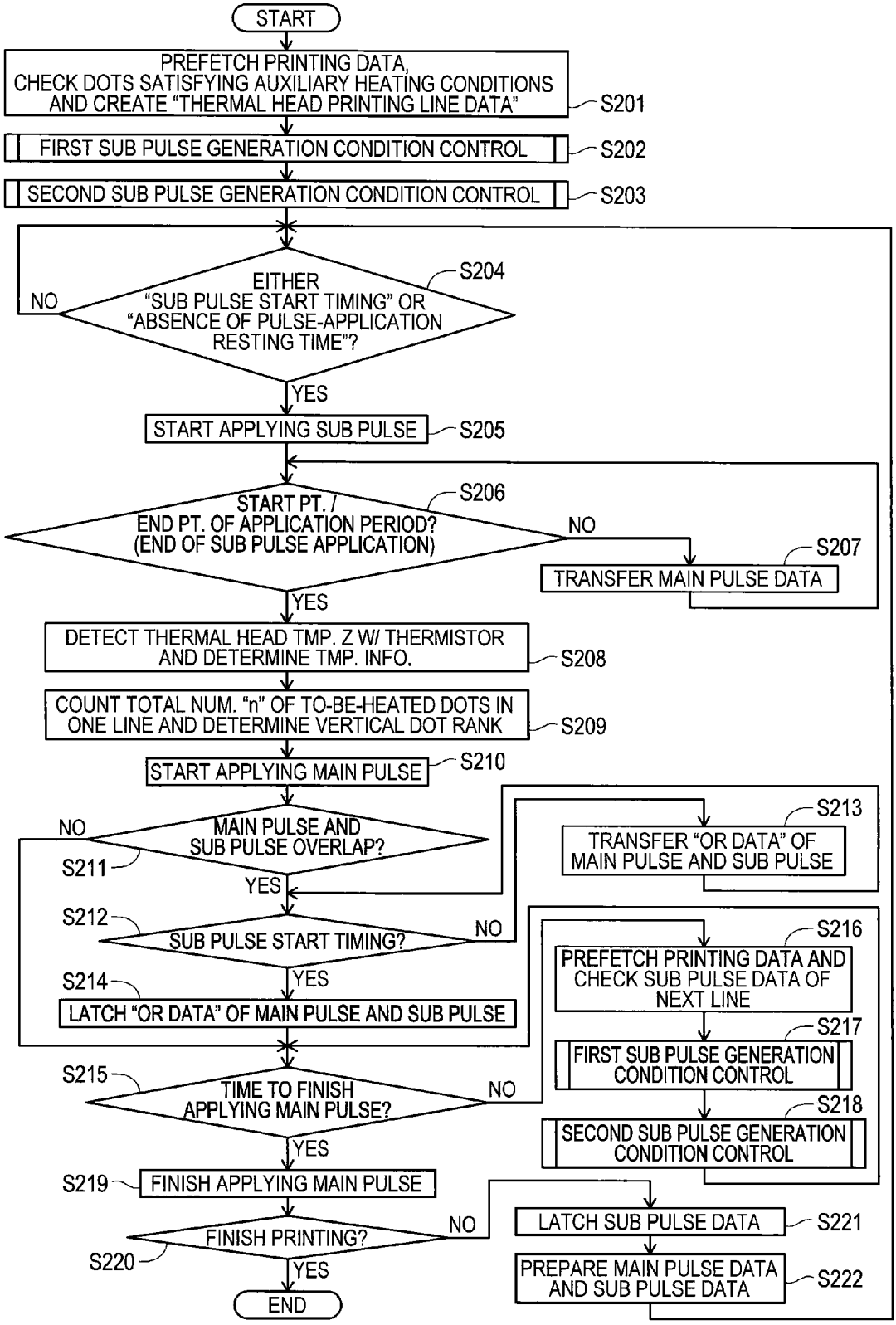
FIG. 16 is a flowchart of a control program for controlling a thermal head of a tape printing apparatus directed to the disclosure in accordance with drive control.

As shown in FIG. 16, in first drive control of the thermal head 41, the CPU 61 first prefetches printing data from the RAM 66 and creates [thermal head printing line data] at S201. At this time, the CPU 61 creates [thermal head printing line data] while checking dots satisfying auxiliary heating conditions. Thereafter, the CPU 61 proceeds to S202.

At S202, the CPU 61 carries out first sub pulse generation condition control. In this process, the CPU 61 generates 2-dimensional print data for specifying whether the sub pulse SP is to be applied in accordance with the above-described condition (β). The first sub pulse generation condition control will be described in detail later. Thereafter, the CPU 61 proceeds to S203.

At S203, the CPU 61 carries out second sub pulse generation condition control. In this process, the CPU 61 generates the 2-dimensional printing data for specifying whether the sub pulse SP is to be applied in accordance with the above-described condition (γ). The second sub pulse generation condition control will be described in detail later. Thereafter, the CPU 61 proceeds to S204.

At S204, the CPU 61 judges whether the sub pulse SP application start timing has been reached or pulse application resting time is absent. This judgment is carried out using the timer 67 or the like. Specifically, it is determined whether the [auxiliary heating start point ss] showing when application of the sub pulse SP starts has been reached. Here, in the event the sub pulse SP start timing has not been reached, and a pulse resting time exists (S204: NO), the CPU 61 returns to S204 and is in stand-by until the sub pulse SP application start timing is reached, or until the pulse resting time ends. Alternatively, in the event the sub pulse SP application start timing is reached, or the pulse resting time is absent (S204: YES), the CPU 61 proceeds to S205.

At S205, the CPU 61 starts application of the sub-pulse SP. Specifically, the CPU 61 latches sub-pulse data to be transferred to the head driving circuit 68 at this time, and applies the sub-pulse SP to the heater elements 41A which are the target of auxiliary heating, placing these heater elements 41A in the drive state of the second heater element 41D. Thereafter, the CPU 61 proceeds to S206.

At S206, the CPU 61 judges whether the start point or otherwise end point of the application period F has been reached. The timing is judged employing a timer 67 or the like. Specifically, the CPU 61 judges whether the [auxiliary heating end point se] showing when application of the sub-pulse SP ends or alternatively, the [main heating start point ms] showing when application of the main pulse MP starts has been reached. Here, in the event the start point and the end point of the application period F have not been reached (S206: NO), the CPU 61 proceeds to S207.

At S207, the CPU 61 transfers main pulse data which is the target of transfer at this point to the head driving circuit 68 in one transfer only. Thereafter, the CPU 61 returns to S206. Alternatively, in the event the start point or alternatively the end point of the print period F has been reached at S206 (S206: YES), the CPU 61 proceeds to S208.

At S208, the CPU 61 detects the temperature of the thermal head 41 using the thermistor 73 and determines the [temperature information] based on the detected temperature Z. Thereafter, the CPU 61 proceeds to S209.

At S209, the CPU 61 counts the number of to-be-heated-dots in one line to determine the [vertical dot rank]. The number of to-be-heated-dots refers to the total number n of heater elements 41A which are the target of main heating in the line head 41B of the thermal head 41 in this application period F. Thereafter, the CPU 61 proceeds to S210.

At S210, the CPU 61 starts applying the main pulse MP. Specifically, the CPU 61 latches the main pulse data which was transferred to the head driving circuit 68 at S207, and applies the main pulse MP to the heater elements 41A which are the target of main heating, placing these heater elements 41A in the drive state of the first heater element 41C. With respect to the drive state at this time, the CPU 61 reflects the applied pulse width WM of the main pulse MP as determined from the [temperature information] detected at S16 and the [vertical dot rank] at the above-described S17 towards the head driving circuit 68. Thereafter, the CPU 61 proceeds to S211.

At S211, the CPU 61 judges whether the main pulse MP and the sub pulse SP overlap. This judging process is carried out by comparing the [main heating end point me] showing when application of the main pulse MP ends with the [auxiliary heating start point ss] showing when application of the sub pulse SP starts. Here, in the event the main pulse MP and the sub pulse SP do not overlap (S211: NO), the flow proceeds to S23 to be described later. Alternatively, in case the main pulse MP and the sub pulse SP overlap (S211: YES), the CPU 61 proceeds to S20.

At S212, the CPU 61 judges whether the sub pulse SP application start timing has been reached. This judging process is carried out using timer 67 or the like. Specifically, the CPU 61 determines whether the [auxiliary application start point ss] showing when application of the sub pulse SP starts has been reached. Here, in the event the sub pulse SP application start timing has not been reached (S212: NO), the CPU 61 proceeds to S213.

At S213, the CPU 61 transfers the [OR data] (which is the target of transfer at this point) of the main pulse MP and the sub pulse SP to the head driving circuit 68 in one transfer only. Thereafter, the CPU 61 returns to S212. On the one hand, in the event the sub pulse SP application start timing has been reached at S20 (S212: YES), the CPU 61 proceeds to S214.

At S214, the CPU 61 latches the [OR data] of the main pulse MP and the sub pulse SP with respect to the head driving circuit 68. Thereafter, the CPU 61 proceeds to S215.

At S215, the CPU 61 judges whether or not the main pulse MP application end time has been reached. This judgment is carried out using the timer 67 or the like. Specifically, it is determined whether the [main heating end point me] showing when application of the main pulse MP ends has been reached. Here, in the event the main pulse MP application end timing has not been reached (S215: NO), the CPU 61 carries out the following steps S216 through S218 only one time up until the main pulse MP application end timing is reached.

At S216, the CPU 61 pre-fetches printing data from the RAM 66 and checks the sub pulse data. Thereafter, the CPU 61 proceeds to S217.

At S217, the CPU 61 carries out first sub pulse generation condition control. In this process, the CPU 61 generates print data for specifying whether the sub pulse SP is to be applied in accordance with the above-described condition (β). The first sub pulse generation condition control will be described in detail later. Thereafter, the CPU 61 proceeds to S218.

At S218, the CPU 61 carries out second sub pulse generation condition control. In this process, the CPU 61 generates printing data for specifying whether the sub pulse SP is to be applied in accordance with the above-described condition (γ). The second sub pulse generation condition control will be described in detail later. Thereafter, the CPU 61 proceeds to S215.

In the event the main pulse MP application end timing has been reached at S215 (S215: YES), the CPU 61 proceeds to S219. At S219, the CPU 61 ends application of the main pulse MP. Specifically, the CPU 61 causes the head driving circuit 68 to end application of the main pulse MP with respect to the heater elements 41A which are the target of main heating. Thereafter, the CPU 61 proceeds to S220.

At S220, the CPU 61 judges whether printing has finished. Here, in the event printing has not finished (S220: NO), the CPU 61 proceeds to S221. At S211, the CPU 61 causes the head driving circuit 68 to latch the sub pulse data which was checked as described above at S216. Thereafter, the CPU 61 proceeds to S222. At S222, the CPU 61 prepares the main pulse data and sub pulse data. Then, the CPU 61 returns to S204, and repeats the processes subsequent to S204.

On the one hand, in the event printing has finished as described at S220 (S220: YES), the CPU 61 ends the program.

[2-4-2. Second Operation of the Present Disclosure]

Figure 17:
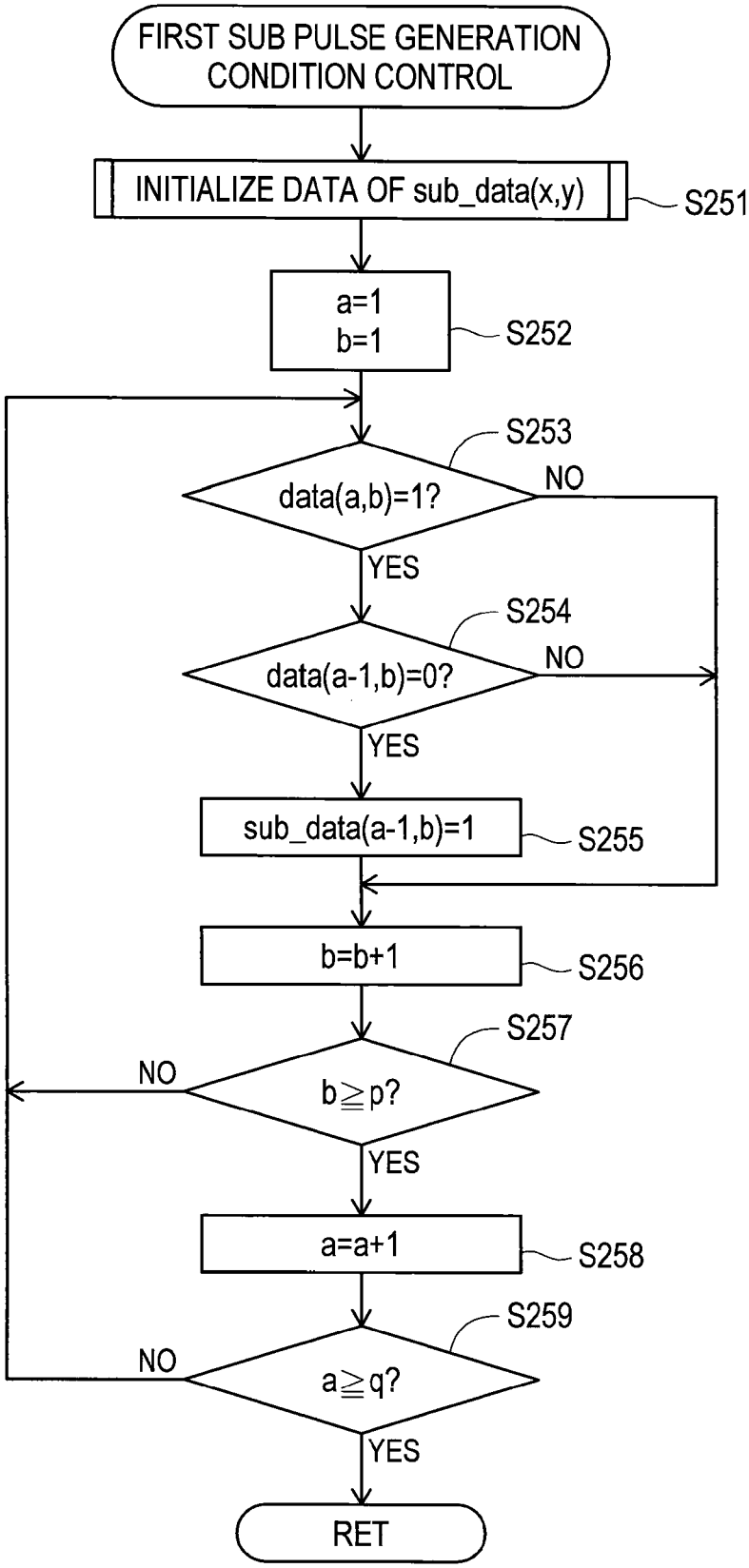
FIG. 17 is a flowchart of a program for first sub pulse generation condition control to be executed when carrying out drive control for the thermal head of the tape printing apparatus.

Next, first sub pulse generation condition control at the above-described S202 and S217 will be described. The control program shown in the flow chart at FIG. 17 is stored in the ROM 64 and is executed by CPU 61.

Here, the CPU 61 generates 2-dimensional application data for specifying whether the heater elements 41A constituting the line head 41B of the thermal head 41 are subject to auxiliary heating, more specifically, whether the sub pulse SP is to be applied. The 2-dimensional application data is comprised of q (line)×p (number of units) arrays. Specifically, the two-dimensional application data includes q lines of sub pulse application processes per one line, in the line head 41 comprised of a number of p heater elements 41A. Also, q×p 2-dimensional printing data is used to generate 2-dimensional application data.

Here, the 2-dimensional application data is shown as sub_data (x, y), while the 2-dimensional printing data is shown as data (x, y).

With respect to the 2-dimensional application data sub_data (x, y), [0] shows that the sub pulse SP is not applied, while [1] shows that the sub pulse SP is applied.

With respect to the two-dimensional printing data data (x, y), [0] shows that printing is not carried out, while [1] shows that printing is carried out. [1] shows that printing is carried out, which means that [1] shows that the main pulse MP is applied. When [0] is used for all the data (0, 1) through (0, p) showing the blank data prior to printing, this means that printing is not carried out.

In the first sub pulse generation condition control, the CPU 61 first resets the two-dimensional application data sub_data (x, y) to [0] at S251. Thereafter, the CPU 61 proceeds to S252. At S252, the CPU 61 resets variable a to [1] and variable [b] to [1]. Thereafter, the CPU 61 proceeds to S253.

At S253, the CPU 61 judges whether the two-dimensional printing data data (a, b) is [1]. Here, if the two-dimensional printing data data (a, b) is not [1] (S253: NO), the CPU 61 proceeds to S256 to be described later. Alternatively, if the two-dimensional printing data data (a, b) is [1] (S253: YES), the CPU 61 proceeds to S254.

At S254, the CPU 61 judges whether the two-dimensional print data data (a−1, b) is [0]. Here, if the two-dimensional print data data (a−1, b) is not [0] (S254: NO), the CPU 61 proceeds to S256 to be described later. Alternatively, if the two-dimensional printing data data (a−1, b) is [0] (S254: YES), the CPU 61 proceeds to S255.

At S255, the CPU 61 resets the two-dimensional application data sub_data (a−1, b) to [1]. Thereafter, the CPU 61 proceeds to S256. At S256, the CPU 61 increments the variable b. Thereafter, the CPU 61 proceeds to S257.

At S257, the CPU 61 judges whether variable b is equal to or above [p]. Here, if variable b is not equal to or above [p]

(S257: NO), the CPU 61 returns to S253 and repeats the processes subsequent to S253. Alternatively, if variable b is equal to or above [p] (S257: YES), the CPU 61 proceeds to S258.

At S258, the CPU 61 increments the variable a. Thereafter, the CPU 61 proceeds to S259. At S259, the CPU 61 judges whether variable a is equal to or above [q]. Here, if variable a is not equal to or above [q] (S259: NO), the CPU 61 returns to S253 and repeats the processes subsequent to S253. Alternatively, if variable a is equal to or above [q] (S259: YES), the CPU 61 returns to the control program shown in FIG. 16.

[2-4-3. Third Operation of the Present Disclosure]

Figure 18:
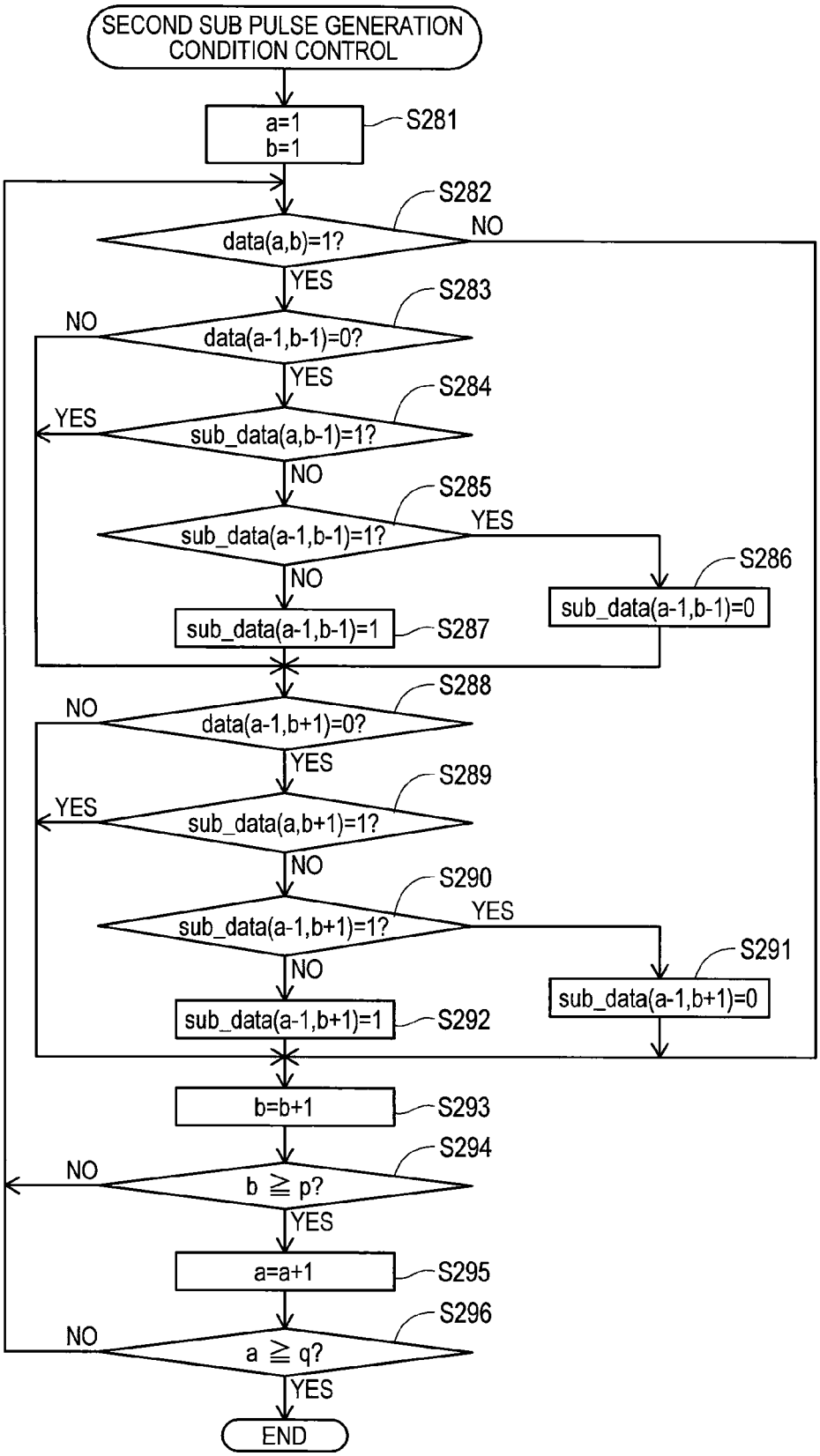
FIG. 18 is a flowchart of a program for second sub pulse generation condition control to be executed when carrying out drive control for the thermal head of the tape printing apparatus.

Next, second sub pulse generation condition control as shown at S203 and S218 will be described. The control program shown in the flow chart of FIG. 18 is stored in the ROM 64 and executed by the CPU 61.

In the second sub pulse generation condition control, the two-dimensional application data is used as sub_data (x, y), while the two-dimensional printing data is used as data (x, y). This is the same as the case of the first sub pulse generation condition control as described above, and therefore, further description thereof is hereby omitted.

In the second sub pulse generation condition control, the CPU 61 first resets variable a to [1] and variable [b] to [1] at S281. Thereafter, the CPU 61 proceeds to S282.

At S282, the CPU 61 judges whether the two-dimensional printing data data (a, b) is [1]. Here, if the two-dimensional printing data data (a, b) is not [1] (S282: NO), the CPU 61 proceeds to S293 to be described later. Alternatively, if the two-dimensional printing data data (a, b) is [1] (S282: YES), the CPU 61 proceeds to S283.

At S283, the CPU 61 judges whether the two-dimensional print data data (a−1, b−1) is [0]. Here, if the two-dimensional print data data (a−1, b−1) is not [0] (S283: NO), the CPU 61 proceeds to S288 to be described later. Alternatively, if the two-dimensional printing data data (a−1, b−1) is [0] (S283: YES), the CPU 61 proceeds to S284.

At S284, the CPU 61 judges whether the two-dimensional application data sub_data (a, b−1) is [1]. Here, if the two-dimensional application data sub_data (a, b−1) is [1] (S284: YES), the CPU 61 proceeds to S288 to be described later. Alternatively, if the two-dimensional application data sub_data (a, b−1) is not [1] (S284: NO), the CPU 61 proceeds to S285.

At S285, the CPU 61 judges whether the two-dimensional application data sub_data (a−1, b−1) is [1]. Here, if the two-dimensional application data sub_data (a−1, b−1) is [1] (S285: YES), the CPU 61 proceeds to S286. At S286, the CPU 61 resets the two-dimensional application data sub_data (a−1, b−1) [0]. Thereafter, the CPU 61 proceeds to S288.

Alternatively if the two-dimensional application data sub_data (a−1, b−1) is not [1] (S285: NO), the CPU 61 proceeds to S287. At S286, the CPU 61 resets the two-dimensional application data sub_data (a−1, b−1) to [1]. Thereafter, the CPU 61 proceeds to S288.

At S288, the CPU 61 judges whether the two-dimensional application data sub_data (a−1, b+1) is [0]. Here, if the two-dimensional application data sub_data (a−1, b+1) is not [0] (S288: NO), the CPU 61 proceeds to S293 to be described later. Alternatively, if the two-dimensional application data sub_data (a−1, b+1) is [0] (S288: YES), the CPU 61 proceeds to S289.

At S289, the CPU 61 judges whether the two-dimensional application data sub_data (a, b+1) is [1]. Here, if the two-dimensional application data sub_data (a, b+1) is [1] (S289: YES), the CPU 61 proceeds to S293 to be described later. Alternatively, if the two-dimensional application data sub_data (a, b+1) is not [1] (S289: NO), the CPU 61 proceeds to S290.

At S290, the CPU 61 judges whether the two-dimensional application data sub_data (a−1, b+1) is [1]. Here, if the two-dimensional application data sub_data (a−1, b+1) is [1] (S290: YES), the CPU 61 proceeds to S291. At S291, the CPU 61 resets the two-dimensional application data sub_data (a−1, b+1) to [0]. Thereafter, the CPU 61 proceeds to S293.

Alternatively if the two-dimensional application data sub_data (a−1, b+1) is not [1] (S290: NO), the CPU 61 proceeds to S292. At S292, the CPU 61 resets the two-dimensional application data sub_data (a−1, b+1) to [1]. Thereafter, the CPU 61 proceeds to S293. At S293, the CPU 61 increments the variable b. Thereafter, the CPU 61 proceeds to S294.

At S294, the CPU 61 judges whether variable b is equal to or above [p]. Here, if variable b is not equal to or above [p] (S294: NO), the CPU 61 returns to S282 and repeats the processes subsequent to S282. Alternatively, if variable b is equal to or above [p] (S294: YES), the CPU 61 proceeds to S295.

At S295, the CPU 61 increments the variable a. Thereafter, the CPU 61 proceeds to S296. At S296, the CPU 61 judges whether variable a is equal to or above [q]. Here, if variable a is not equal to or above [q] (S296: NO), the CPU 61 returns to S282 and repeats the processes subsequent to S282. Alternatively, if variable a is equal to or above [q] (S296: YES), the CPU 61 returns to the control program shown in FIG. 16.

[2-5. Summary]

Specifically, in the tape printing apparatus 1 according to the second embodiment, with respect to the heater elements 41A constituting the line head 41B of the thermal head 41, the next application period F wherein ink is not melted or sublimed on the ink ribbon 33 starts immediately after the current application period F wherein ink is not melted or sublimed on the ink ribbon 33, according to condition (α), for each of the second heater elements 41D adjacent to the first heater elements 41C to which the main pulse MP is applied for main heating to melt or sublime the ink on the ink ribbon 33 in the next application period F. In this case, the sub pulse SP for compensating the main pulse MP to be applied in the next application period F is applied in the current application period F (left side in FIG. 24 and FIG. 25, and lower level in FIG. 28).

Accordingly, auxiliary heating through the sub pulse SP as applied to the second heater elements 41D supplements main heating through the main pulse MP as applied to the first heater elements 41C adjacent to the second heater elements 41D in the next application period F. This prevents the occurrence of any defects in the printing quality, such as the so-called [fading effect] caused by an outflow of applied energy at the edge of the printed dots formed in an isolated fashion on the superficial tape 41 or at the edge of printed dots formed successively on the superficial tape 31 in the main scanning direction D1 of the thermal head 41 (refer to FIG. 20 and FIG. 21).

As the main pulse MP and the sub pulse SP to be applied to one heater element 41A will never exist together within one and the same application period F (refer to the above-described step (D)), this helps shorten the application period F which is a fixed period.

Furthermore, the non-heating period G wherein neither the main pulse MP nor the sub pulse SP are applied can be reliably secured even in the event the application period F which is a fixed period is shortened and the main pulse MP and the sub pulse SP are applied (refer to FIG. 29 and FIG. 30). As a result, this makes it possible to prevent heat accumulation which may cause an adverse effect on the print quality, even in the case of successive printing. This way, high speed printing is made possible by carrying out heat history control wherein new energization adjustment is performed with respect to the thermal head 41. Furthermore, since heat history control wherein new energization adjustment is performed with respect to the thermal head 41 is carried out by simply changing the timing for each pulse application in the respective application period F (refer to FIG. 16 through FIG. 18), no upgrades of the thermal head 41 are necessary, which in turn prevents any cost increases.

In the tape printing apparatus 1 according to the second embodiment, the next application period F wherein the main pulse MP for main heating is applied to melt or sublime the ink on the ink ribbon 33 starts immediately after the current application period F wherein ink is not melted or sublimed on the ink ribbon 33, for each of the heater elements 41A constituting the line head 41B of the thermal head 41, based on condition (β) In this case, the sub pulse SP for compensating the main pulse MP to be applied in the next application period F is applied in the current application period F (right side in FIG. 24 through FIG. 26, and lower level in FIG. 27). This helps obtain the above described [no cost increase] effect.

In the tape printing apparatus 1 according to the second embodiment, one portion of the applied energy of the main pulse MP which flows from the two first heater elements 41C is respectively supplied with respect to the two first heater elements 41C and the adjacent second heater elements 41D to which the main pulse MP for main heating is applied so as to melt or sublime the ink on the ink ribbon 33 in the next application period F. As a result, it is possible to slow down the flow of applied energy of the main pulse MP which flows from the two first heater elements 41C.

Accordingly, it is possible to eliminate application of the sub pulse SP for auxiliary heating which, based on condition (γ),cannot melt or sublime the ink on the ink ribbon 33 by itself, but, when applied to supplement main heating carried out by the main pulse MP which is applied in the next application period F, it causes the ink on the ink ribbon 33 to melt or sublime (right side in FIG. 26). Accordingly, with respect to the second heater elements 41D, it is possible to prevent any defects in the printing quality, such as the so-called [fading effect] caused by an outflow of applied energy at the respective printed dots formed intermittently on the superficial tape 31 in the main scanning direction of the thermal head 41, even in the event the next application period F wherein the ink is not melted or sublimed on the ink ribbon 33 starts immediately after the current application period F wherein the ink on the ink ribbon 33 is not melted or sublimed, and the sub pulse SP for compensating the main pulse MP which is applied in the next application period F is not applied in the current application period F (refer to FIG. 22 and FIG. 23).

[2-6-1. Other]

The present disclosure is not limited to the above-described second embodiment, and therefore, modifications can be made thereto without departing from the spirit of the disclosure.

For instance, in the control program in FIG. 16, once S202 and S217 are carried out, auxiliary heating can be carried out only with respect to the heater elements which satisfy only condition (γ) as shown at the right side in FIG. 24 through FIG. 26.

[2-6-2. Other]

In the control program in FIG. 16, once S203 and S218 are carried out, auxiliary heating can be carried out only with respect to the heater elements which satisfy condition (α) only as shown at the left side in FIG. 24 and FIG. 25.

[2-6-3. Other]

In the second embodiment, the tape printing apparatus 1 has been described as a [printing apparatus], however, the present disclosure can also be applied to various types of thermal printers which are provided with a thermal head 41. In the case the thermal printer uses thermal paper as a printing medium, main heating refers to supplying energy capable of causing the thermal paper which is used as printing medium to develop color, whereas auxiliary printing refers to supplying energy which independently, cannot cause the thermal paper used as printing medium to develop color, but, together with main heating, it can cause the thermal paper which is used as printing medium to develop color.

What is claimed is:

1. A printing apparatus comprising:

a thermal head provided with a line head including a plurality of heater elements arranged in a linear fashion;

conveying units that convey a printing medium in a sub-scanning direction which is in an orthogonal relation with the line head of the thermal head; and a control unit that controls the conveying units and the thermal head;

said control unit carrying out an application process for causing the respective heater elements constituting the line head of the thermal head to selectively generate heat in each one of application periods which are repeated successively, to form printed dots on the printing medium which is conveyed by the conveying unit in the sub-scanning direction of the thermal head and as a result carry out printing, wherein each application period is set as a fixed period of time ranging from a main heating start point which shows when application of a main pulse for main heating which causes the printing medium to develop color starts at the line head of the thermal head to a next main heating start point, to cause successive printed dots to be formed on the printing medium in the sub-scanning direction of the thermal head; and the control unit carries out application of a sub pulse for auxiliary heating which, when applied independently, cannot cause the printing medium to develop color, but, when applied so as to compensate main heating by the main pulse as applied in a next application period can cause the printing medium to develop color, with respect to each of the heater elements constituting the line head of the thermal head in accordance with a following constraint (A):

(A) the sub pulse is applied in a current application period wherein the printing medium is not caused to develop color, irrespective of whether the next application period wherein the main pulse for main heating is applied to cause the printing medium to develop color starts immediately after the current application period wherein the printing medium is not caused to develop color.

2. The printing apparatus according to claim 1, wherein the control unit carries out application of the sub pulse for auxiliary heating which, when applied independently, cannot cause the printing medium to develop color, but, when applied so as to compensate main heating by the main pulse as applied in the next application period can cause the printing medium to develop color, with respect to each of the heater elements constituting the line head of the thermal head, in accordance with a following constraint (1) which further limits said constraint (A):

(1) the sub pulse is applied in the current application period wherein the printing medium is not caused to develop color, only in the case the next application period wherein the main pulse for main heating is applied to cause the printing medium to develop color starts immediately after the current application period wherein the printing medium is not caused to develop color.

3. The printing apparatus according to claim 2, wherein the control unit carries out application of the sub pulse for auxiliary heating which, when applied independently, cannot cause the printing medium to develop color, but, when applied so as to compensate main heating by the main pulse as applied in the next application period can cause the printing medium to develop color, with respect to each of the heater elements constituting the line head of the thermal head, in accordance with said constraint (1) and an additional constraint (2) as follows:

(2) make an auxiliary heating end point showing when application of the sub pulse ends in the current application period coincident with the main heating start point showing when application of the main pulse starts in the next application period.

4. The printing apparatus according to claim 2, wherein the control unit independently controls in the respective application periods wherein an application operation is carried out to selectively heat respective heater elements constituting the line head of the thermal head:

a main heating start point showing when application of the main pulse for main heating starts with respect to first heater elements, which are the respective heater elements constituting the line head of the thermal head that are subject to main heating; and an auxiliary heating start point showing when application of the sub pulse for auxiliary heating starts with respect to second heater elements which are respective heater elements constituting the line head of the thermal head that are subject to auxiliary heating.

5. The printing apparatus according to claim 2, wherein the control unit carries out application of the sub pulse for auxiliary heating which, when applied independently, cannot cause the printing medium to develop color, but, when applied so as to compensate main heating by the main pulse as applied in the next application period can cause the printing medium to develop color, with respect to each of the heater elements constituting the line head of the thermal head, in accordance with said constraint (1) and an additional constraint (2') as follows:

(2') the sub pulse and the main pulse for forming identical printed dots on the printing medium do not exist in one and the same application period.

6. The printing apparatus according to claim 2, wherein, in an application period wherein an application process is carried out to selectively heat the respective heater elements constituting the line head of the thermal head, the control unit shortens an applied pulse width of the sub pulse as applied to second heater elements which are respective heater elements constituting the line head of the thermal head that are subject to auxiliary heating as compared to an applied pulse width of the main pulse which is applied with respect to first heater elements which are respective heater elements constituting the line head of the thermal head that are subject to main heating.

7. The printing apparatus according to claim 2, wherein in an application period wherein an application process is carried out to selectively heat the respective heater elements constituting the line head of the thermal head, the control unit provides a time frame wherein an applied pulse width of the sub pulse which is applied to second heater elements, which are respective heater elements constituting the line head of the thermal head that are subject to auxiliary heating, overlaps an applied pulse width of the main pulse which is applied to first heater elements, which are respective heater elements constituting the line head of the thermal head that are subject to main heating.

8. The printing apparatus according to claim 2, further comprising a detection unit that detects temperature of the thermal head or temperature inside the printing apparatus, wherein, based on a detection temperature of the detection unit, the control unit changes an applied pulse width of the main pulse which is applied with respect to first heater elements, which are respective heater elements constituting the line head of the thermal head that are subject to main heating; or otherwise an applied pulse width of the sub pulse which is applied with respect to second heater elements, which are respective heater elements constituting the line head of the thermal head that are subject to auxiliary heating, in an application period wherein an application process is carried out to selectively heat the respective heater elements constituting the line head of the thermal head.

9. The printing apparatus according to claim 2, wherein, depending on a total number of first heater elements, which are respective heater elements constituting the line head of the thermal head that are subject to main heating, the control unit changes an applied pulse width of the main pulse which is applied with respect to first heater elements, which are respective heater elements constituting the line head of the thermal head that are subject to main heating; or otherwise an applied pulse width of the sub pulse which is applied with respect to second heater elements which are respective heater elements constituting the line head of the thermal head that are subject to auxiliary heating, in an application period wherein an application process is carried out to selectively heat the respective heater elements constituting the line head of the thermal head.

10. The printing apparatus according to claim 2, wherein if a time difference between a main heating end point, showing when application of the main pulse for main heating ends with respect to first heater elements which are heater elements constituting the line head of the thermal head that are subject to main heating, and an auxiliary heating start point, showing when application of the sub pulse for auxiliary heating starts with respect to second heater elements which are respective heater elements constituting the line head of the thermal head that are subject to auxiliary heating, is shorter as compared to a transfer time for transferring applied pattern data required for selectively heating respective heater elements constituting the line head of the thermal head, in an application period wherein an application process is carried out to selectively heat the respective heater elements constituting the line head of the thermal head, the control unit makes the auxiliary heating start point, showing when application of the sub pulse for auxiliary heating starts with respect to second heater elements which are respective heater elements constituting the line head of the thermal head that are subject to auxiliary heating, coincide with the main heating end point showing when application of the main pulse for main heating ends with respect to first heater elements which are respective heater elements constituting the line head of the thermal head that are subject to main heating.

11. The printing apparatus according to claim 2, wherein if a time difference between a main heating end point, showing when application of the main pulse for main heating ends with respect to first heater elements which are heater elements constituting the line head of the thermal head that are subject to main heating, and an auxiliary heating start point, showing when application of the sub pulse for auxiliary heating starts with respect to second heater elements which are respective heater elements constituting the line head of the thermal head that are subject to auxiliary heating, is shorter as compared to a transfer time for transferring applied pattern data required for selectively heating respective heater elements constituting the line head of the thermal head, in an application period wherein an application process is carried out to selectively heat the respective heater elements constituting the line head of the thermal head, the control unit makes the main heating end point, showing when application of the main pulse for main heating ends with respect to first heater elements which are respective heater elements constituting the line head of the thermal head that are subject to main heating, coincide with the auxiliary heating start point, showing when application of the sub pulse for auxiliary heating starts with respect to second heater elements which are respective heater elements constituting the line head of the thermal head that are subject to auxiliary heating.

12. The printing apparatus according to claim 2, wherein the control unit carries out application of the sub pulse for auxiliary heating which, when applied independently, cannot cause the printing medium to develop color, but, when applied so as to compensate main heating by the main pulse as applied in a next application period can cause the printing medium to develop color, with respect to each of the heater elements constituting the line head of the thermal head, in accordance with said constraint (1) and an additional constraint (2) as follows:

(2) a main heating end point showing when application of the main pulse for main heating ends with respect to first heater elements which are respective heater elements constituting the line head of the thermal head that are subject to main heating, and an auxiliary heating start point, showing when application of the sub pulse for auxiliary heating starts with respect to second heater elements which are respective heater elements constituting the line head of the thermal head that are subject to auxiliary heating, are made to coincide in an application period wherein an application process is carried out to selectively heat the respective heater elements constituting the line head of the thermal head.

13. The printing apparatus according to claim 12, wherein the control unit carries out application of the sub pulse for auxiliary heating which, when applied independently, cannot cause the printing medium to develop color, but, when applied so as to compensate main heating by the main pulse as applied in the next application period can cause the printing medium to develop color, with respect to each of the heater elements constituting the line head of the thermal head, in accordance with the said constraints (1) and (2) and an additional constraint (3) as follows:

(3) an auxiliary heating end point showing when application of the sub pulse ends in the current application period and a main heating start point showing when application of the main pulse starts in the next application period are made to coincide with each other.

14. The printing apparatus according to claim 12, further comprising a detection unit for detecting environmental data inside the printing apparatus, wherein the control unit changes an applied pulse width of the sub pulse which is applied with respect to second heater elements which are respective heater elements constituting the line head of the thermal head that are subject to auxiliary heating, based on the environmental data detected by the detection unit, in an application period wherein an application process is carried out to selectively heat the respective heater elements constituting the line head of the thermal head.

15. The printing apparatus according to claim 14, wherein when the main pulse for main heating is applied with respect to the first heater elements which are respective heater elements constituting the line head of the thermal head that are subject to main heating, in accordance with the change in the applied pulse width of the sub pulse which is applied with respect to the second heater elements which are respective heater elements constituting the line head of the thermal head that are subject to auxiliary heating, in an application period wherein an application process is carried out to selectively heat the respective heater elements constituting the line head of the thermal head, the control unit configures the main pulse to be comprised of a rectangular pulse and a chopping pulse and changes the ratio between an applied pulse width of the rectangular pulse and an applied pulse width of the chopping pulse.

16. The printing apparatus according to claim 1, wherein the control unit carries out application of the sub pulse for auxiliary heating which, when applied independently, cannot cause the printing medium to develop color, but, when applied so as to compensate main heating by the main pulse as applied in the next application period can cause the printing medium to develop color, with respect to second heater elements adjacent first heater elements, which are respective heater elements constituting the line head of the thermal head to which the main pulse is applied for main heating to cause the printing medium to develop color in the next application period, in accordance with a following constraint (1) which further limits said constraint (A):

(1) the sub pulse is applied in the current application period wherein the printing medium is not caused to develop color, in the case the next application period wherein the printing medium is not caused to develop color starts immediately after the current application period wherein the printing medium is not caused to develop color.

17. The printing apparatus according to claim 16, wherein the control unit carries out application of the sub pulse for auxiliary heating which, when applied independently, cannot cause the printing medium to develop color, but, when applied so as to compensate main heating by the main pulse as applied in the next application period can cause the printing medium to develop color, with respect to each of the heater elements constituting the line head of the thermal head, in accordance with a following constraint (2):

(2) the sub pulse is applied in the current application period wherein the printing medium is not caused to develop color, if the next application period wherein the main pulse for main heating is applied to cause the printing medium to develop color starts immediately after the current application period wherein the printing medium is not caused to develop color.

18. The printing apparatus according to claim 16, wherein the control unit carries out application of the sub pulse for auxiliary heating which, when applied independently, cannot cause the printing medium to develop color, but, when applied so as to compensate main heating by the main pulse as applied in the next application period can cause the printing medium to develop color, with respect to second heater elements adjacent first heater elements, which are respective heater elements constituting the line head of the thermal head to which the main pulse is applied for main heating to cause the printing medium to develop color in the next application period, in accordance with said constraint (1) and an additional constraint (1') as follows:

(1') with respect to the second heater element that has both sides adjacent to two first heater elements to which the main pulse is applied for main heating to cause the printing medium to develop color in the next application period, said constraint (1) is not applied, and the sub pulse is not applied in the current application period wherein the printing medium is not caused to develop color even if the next application period wherein the printing medium is not caused to develop color starts immediately after the current application period wherein the printing medium is not caused to develop color.

19. The printing apparatus according to claim 18, wherein the control unit carries out application of the sub pulse for auxiliary heating which, when applied independently, cannot cause the printing medium to develop color, but, when applied so as to compensate main heating by the main pulse as applied in the next application period can cause the printing medium to develop color, with respect to each of the heater elements constituting the line head of the thermal head, in accordance with a following constraint (2):

(2) the sub pulse is applied in the current application period wherein the printing medium is not caused to develop color if the next application period wherein the main pulse for main heating is applied to cause the printing medium to develop color starts immediately after the current application period wherein the printing medium is not caused to develop color.

* * * * *